US006764587B2

(12) United States Patent
Sawada et al.

(10) Patent No.: US 6,764,587 B2
(45) Date of Patent: Jul. 20, 2004

(54) PROCESS FOR PRODUCING ALUMINUM SUPPORT FOR PLANOGRAPHIC PRINTING PLATE, ALUMINUM SUPPORT FOR PLANOGRAPHIC PRINTING PLATE, AND PLANOGRAPHIC PRINTING MASTER PLATE

(75) Inventors: Hirokazu Sawada, Shizuoka-ken (JP); Akio Uesugi, Shizuoka-ken (JP); Atsuo Nishino, Shizuoka-ken (JP); Yoshitaka Masuda, Shizuoka-ken (JP)

(73) Assignee: Fuji Photo Film Co. Ltd., Kanagawa (JP)

( * ) Notice: Subject to any disclaimer, the term of this patent is extended or adjusted under 35 U.S.C. 154(b) by 9 days.

(21) Appl. No.: 09/951,406

(22) Filed: Sep. 14, 2001

(65) Prior Publication Data

US 2002/0056648 A1 May 16, 2002

(30) Foreign Application Priority Data

| | | |
|---|---|---|
| Sep. 14, 2000 | (JP) | 2000-279766 |
| Sep. 26, 2000 | (JP) | 2000-293097 |
| Sep. 26, 2000 | (JP) | 2000-293098 |
| Sep. 26, 2000 | (JP) | 2000-293099 |
| Mar. 27, 2001 | (JP) | 2001-090960 |

(51) Int. Cl.[7] ..... C25D 11/16; C25D 11/04; C25D 11/18

(52) U.S. Cl. ..... 205/214; 205/324; 205/201; 205/203

(58) Field of Search ..... 205/214, 324, 205/201, 203

(56) References Cited

U.S. PATENT DOCUMENTS

| | | | | |
|---|---|---|---|---|
| 4,087,341 A | | 5/1978 | Takahashi et al. | |
| 4,561,944 A | * | 12/1985 | Sasaki et al. | 204/33 |
| 4,576,686 A | | 3/1986 | Hirokazu et al. | |
| 5,114,825 A | | 5/1992 | Takizawa et al. | |
| 5,834,129 A | * | 11/1998 | Dhillon et al. | 428/654 |
| 6,103,087 A | * | 8/2000 | Mori | 205/214 |

FOREIGN PATENT DOCUMENTS

| | | |
|---|---|---|
| EP | 0272528 A2 | 6/1988 |
| EP | 0 659 909 A1 | 6/1995 |
| EP | 0774692 A2 | 5/1997 |

* cited by examiner

*Primary Examiner*—Edna Wong
(74) *Attorney, Agent, or Firm*—Sughrue Mion, PLLC

(57) ABSTRACT

A process for producing an aluminum support for a planographic printing plate, the process comprising the steps of: (a) preparing an aluminum plate; (b) disposing said aluminum plate in an aqueous acidic solution; and (c) electrochemically surface-roughening said aluminum plate using an alternating current, wherein a ratio $Q_C/Q_A$ of a cathode-time quantity of electricity of said aluminum plate $Q_C$ to an anode-time quantity of electricity of said aluminum plate $Q_A$ is from 0.95 to 2.5. An aluminum support for a planographic printing plate formed by the process. A planographic printing master plate comprising at least a positive-type or negative-type light-sensitive layer on the aluminum support.

4 Claims, 2 Drawing Sheets

PROCESS FOR PRODUCING ALUMINUM SUPPORT FOR PLANOGRAPHIC PRINTING PLATE, ALUMINUM SUPPORT FOR PLANOGRAPHIC PRINTING PLATE, AND PLANOGRAPHIC PRINTING MASTER PLATE

BACKGROUND OF THE INVENTION

1. Field of the Invention

The present invention relates to a process for producing an aluminum support for a planographic printing plate which can remarkably reduce raw material costs and which enables high image-quality printing, and to an aluminum support for a planographic printing plate and a planographic printing master plate. Also, the present invention relates to a process for producing an aluminum support for a planographic printing plate having excellent printability with regard to resistance to severe ink soiling and blanket soiling, an aluminum support for a planographic printing plate and a planographic printing master plate. Furthermore, the present invention relates to an aluminum support for a planographic printing plate which can remarkably reduce raw material costs and which has fine crystal grains, giving high image quality and printing durability.

2. Description of the Related Art

Generally, an aluminum support for a planographic printing plate (hereinafter simply called "support" or "planographic printing plate-use aluminum support" as the case may be) is produced by carrying out, for example, a roughening treatment for one or both surfaces of an aluminum plate. Also, a planographic printing master plate is produced by disposing, for example, a light-sensitive layer on the support. In most of the above supports, the surface of the aluminum plate is treated by anodic oxidation after the surface-roughening treatment to improve the wear resistance of the planographic printing plate during printing. Also, the surface of the light-sensitive layer is occasionally provided with fine irregularities called a matt layer to shorten a time required for vacuum adhesion during plate-making. The planographic printing master plate produced in this manner is made into a planographic printing plate through a plate-making process including image exposure, developing and washing with water. As a method for image exposure, a method in which a lith film on which an image is printed is made to adhere to the surface of the support and irradiated with light to thereby make an image portion different from a non-image portion, a method in which an image portion or a non-image portion is directly written by a method using a laser, or a method in which an image is projected thereby making the image portion different from the non-image portion can be used.

Also, after a developing treatment performed after the image exposure, the undissolved portion of the light-sensitive layer serves as an ink-receptor and forms an image portion, and, at a portion where the light-sensitive layer is dissolved and removed, the surface of the aluminum or the anodic oxide film underneath is exposed externally and serves as a water-receptor and forms a non-image portion. After developing, a hydrophilicizing treatment, gum drawing and a further burning treatment may be carried out according to the need.

Such a planographic printing plate is attached to a cylindrical print drum of a printer and ink and damping water are supplied to the print drum. This results in the ink sticking to the lipophilic image portion and the water sticking to the hydrophilic non-image portion. The planographic printing plate works to transfer the ink of the image portion to a blanket drum and then an image is printed from the blanket drum on paper.

However, there are cases where ink is occasionally stuck to the non-image portion in dot or ring patterns, giving rise to the problem that dot-like or ring-like spots on paper (severe ink spots) are caused resultantly.

In order to restrain the occurrence of such severe ink spots and the like, it has been considered to adopt a method using an aluminum alloy material containing a virgin metal and predetermined additive element components as an aluminum alloy material to be used for the support. However, these materials have the drawback that the costs of these materials themselves are high.

It has also been considered to adopt a method using waste aluminum which is generated in aluminum factories and of which the alloy composition is known. Although the method has the advantage that yield from raw materials is improved, this waste aluminum is not cheap.

On the other hand, if the adhesion between the image portion and the light-sensitive layer is insufficient when the ink of the image portion is transferred to the blanket drum and the image is printed from the blanket drum on paper, this pose the problem that a lower number of copies can be printed before termination of printing. As methods for improving the adhesion between the image and the light-sensitive layer, a method in which an intermediate layer is interposed between the aluminum alloy plate and the light-sensitive layer and a method in which the aluminum alloy plate is uniformly roughened are known.

An amino acid or its salts (e.g., alkali metal salts such as Na salts and K salts; ammonium salts; hydrochlorides; oxalates; acetates; and phosphates) as disclosed in Japanese Patent Application Laid-open (JP-A) No. 60-149491, amines having a hydroxyl group or salts thereof (e.g., hydrochlorides; oxalates; and phosphates) as disclosed in JP-A-60-232998 or compounds having an amino group and a phosphonic acid group or salts thereof as disclosed in Japan Patent Application No. 63-165183 may be used for an undercoating intermediate layer. Also, compounds having a phosphonic acid group as disclosed in JP-A-4-282637 may be used for the intermediate layer. Moreover, it is known that after treatment using an alkali metal silicate is carried out, a high molecular compound containing an acid group and an onium group as disclosed in JP-A-9-264309 (JP-A-11-109637) is used for the intermediate layer. However, the method in which an intermediate layer for improving adhesion is formed between the roughened surface and the light-sensitive layer, as a matter of course, poses the problem of increased production costs for the formation of the intermediate layer.

On the other hand, it is known that in order to carry out a surface-roughening treatment uniformly, alloy components which are contained in the aluminum alloy and adversely affect the formation of a rough surface should be limited.

Many proposals have been disclosed as a method for limiting alloy components. Technologies concerning, for example, the material of JIS 1050 are disclosed in JP-A-59-153861, JP-A-61-51395, JP-A-62-146694, JP-A-60-215725, JP-A-60-215726, JP-A-60-215727, JP-A-60-215728, JP-A-61-272357, JP-A-58-11759, JP-A-58-42493, JP-A-58-221254, JP-A-62-148295, JP-A-4-254545, JP-A-4-165041, Japanese Patent Application Publication (JP-B) No. 3-68939, JP-A-3-234594, JP-B-1-47545 and JP-A-62-

140894 by the inventors of the present invention. Also, JP-B-1-35910, JP-B-55-28874 and the like are known. Technologies concerning the material of JIS 1070 are disclosed in JP-A-7-81264, JP-A-7-305133, JP-A-8-49034, JP-A-8-73974, JP-A-8-108659 and JP-A-8-92679 by the inventors of the present invention.

Technologies concerning Al—Mg type alloys are disclosed in JP-B-62-5080, JP-B-63-60823, JP-B-3-61753, JP-A-60-203496, JP-A-60-203497, JP-B-3-11635, JP-A-61-274993, JP-A-62-23794, JP-A-63-47347, JP-A-63-47348, JP-A-63-47349, JP-A-64-61293, JP-A-63-135294, JP-A-63-87288, JP-B-4-73392, JP-B-7-100844, JP-A-62-149856, JP-B-4-73394, JP-A-62-181191, JP-B-5-76530, JP-A-63-30294 and JP-B-6-37116 by the inventors of the present invention. Also, JP-A-2-215599 and JP-A-61-201747 are known.

Technologies concerning Al—Mn type alloys are disclosed in JP-A-60-230951, JP-A-1-306288 and JP-A-2-293189 by the inventors of the present invention. Also, JP-B-54-42284, JP-B-4-19290, JP-B-4-19291, JP-B-4-19292, JP-A-61-35995, JP-A-64-51992, U.S. Pat. Nos. 500, 972, 5,028,276 and JP-A-4-226394 are known.

Technologies concerning Al—Mn—Mg type alloys are disclosed in JP-A-62-86143 and JP-A-3-222796 by the inventors of the present invention. Also, JP-B-63-60824, JP-A-60-63346, JP-A-60-63347, EP223737, JP-A-1-283350, U.S. Pat. No. 4,818,300, BR1222777 and the like are known.

Technologies concerning Al—Zr type alloys are disclosed in JP-B-63-15978 and JP-A-61-51395 by the inventors of the present invention. Also, JP-A-63-143234, JP-A-63-143235 and the like are known. As to Al—Mg—Si type alloys, BR1421710 and the like are also known.

However, these alloys pose restrictions on alloy materials and have the disadvantages that freedom of selection of materials is decreased and an expensive virgin metal and predetermined additive alloy elements which are expensive are required.

These various alloys are usually manufactured by melting raw materials containing aluminum as a major component, adding predetermined metals to the molten raw materials to prepare a molten bath of an aluminum alloy having predetermined alloy components and, in succession, performing purifying treatment for the aluminum alloy molten bath, followed by casting. As the purifying treatment, a flux treatment for removing unnecessary gases such as hydrogen in the molten bath; a degassing treatment using Ar gas, Cl gas or the like; filtering using a so-called rigid media filter such as a ceramic tube filter or a ceramic foam filter, a filter using alumina flakes or alumina balls as a filter material, or a glass cloth filter; or a treatment comprising a combination of the degassing treatment and filtering is performed. These purifying treatments are preferably performed to prevent defects caused by foreign substances such as non-metallic inclusions and oxides in the molten bath and defects caused by the gas melted into the molten bath.

As aforementioned, a molten bath which has been purified is used to perform casting. Casting methods include methods using a fixed mold, represented by the DC casting method, and methods using a drive mold, represented by the continuous casting method.

In the case of the DC casting method, the cooling rate is designed to be in a range from 1 to 300° C./sec. In the course of the process, a part of the aforementioned alloy component elements are melted as a solid solution in aluminum and components which cannot be melted as a solid solution form various intermetallic compounds and remain in the resulting ingot. In the DC casting method, an ingot having a plate thickness of 300 to 800 mm can be produced. The ingot is subjected to facing according to a usual method wherein a surface layer with a thickness of 1 to 30 mm and preferably 1 to 10 mm is cut. Thereafter, the ingot is subjected to a soaking treatment according to the need. The soaking treatment ensures that among the intermetallic compounds, unstable compounds are changed to more stable compounds and some of the intermetallic compounds are melted as solid solution in the aluminum. Here, the remainder of the intermetallic compounds are afterwards decreased in diameter and dispersed in hot rolling and cold rolling processes but there is no further change in types. Namely, such remaining intermetallic compounds are left in the aluminum alloy plate to be used as a support for a planographic printing plate.

There are cases where, before, after or during cold rolling, a heat treatment called annealing is carried out. In this case, a part of the elements melted as solid solution occasionally precipitate as intermetallic compounds or precipitates of single elements. These precipitates are also left in the aluminum alloy plate.

The aluminum alloy plate which is finished in a given thickness (0.1 to 0.5 mm) by cold rolling may be bettered in flatness by using a remedy machine such as a roller leveler or a tension leveler.

As the casting method, a continuous casting method may also be used. For this method, a twin-roll continuous casting method, represented by the Hunter method or 3C, method or a twin-belt continuous casting method, represented by a belt caster such as the Hazellee method or a block caster such as the Alusuisse method, may be used. In the case where, for example, a twin-roll is used, the cooling rate is designed to be in a range from 100 to 1000° C./sec. On the other hand, in the case where a twin-belt is used, the cooling rate is designed to be in a range from 10 to 500° C./sec. In both methods, the aluminum alloy plate is made to have a given thickness (0.1 to 0.5 mm) by a rolling treatment comprising cold rolling or a combination of hot rolling and cold rolling after the casting operation is finished. Also, at this time, a heat treatment may be carried out optionally. The aluminum alloy plate which is finished in a predetermined thickness by cold rolling may be improved in flatness by using a remedy machine such as a roller leveler or a tension leveler. These continuous casting methods are characterized by the advantage that the running cost is lower than for the DC casting method because the facing process required in the DC casting method can be omitted.

Here, as aluminum used as the raw material, generally, an aluminum ingot having a purity of 99.7% or more, which is called virgin metal, is used or scrap aluminum which is generated in aluminum manufacturing factories and of which the alloy composition is known is used. An aluminum alloy, called the mother alloy, containing predetermined elements is added and a metal ingot consisting of predetermined metal elements is added to manufacture an aluminum alloy material having desired alloy components.

However, the aluminum alloy material containing the virgin metal and predetermined additive element components has the disadvantage that the cost of the material itself is high. Also, the case where scrap aluminum which is generated in aluminum manufacturing factories and of which the alloy composition is known is used has a merit in the point that the yield from the raw material is improved, but is not at all inexpensive.

In regard to the problem that the cost of the raw material is high, a method in which only an aluminum ingot having aluminum in a content of 99.7% or more is used and it is unnecessary to add a mother alloy or metal ingot containing predetermined elements is proposed in JP-A-7-81260. Also, a method in which used planographic printing plates or planographic printing plates which are made inferior in the course of the process are reused as the raw material of the aluminum plate is proposed in JP-A-7-205534.

Even these methods, however, do not bring about large effects because the aluminum ingot itself having aluminum in a content of 99.7% or more is not inexpensive and it is difficult to consistently secure the used planographic printing plates as a raw material.

To solve such problems, there is the idea that materials whose alloy composition is uncontrolled as the raw material, namely, scrap materials containing various impurities or ground metals called secondary metals (recycled metals) which have a commercial price lower than that of the virgin metal and contain many impurity elements be used. However, these materials are not controlled as to the alloy composition and therefore have not been used at all as the raw material of a planographic printing plate for which a high quality appearance of a treated surface and high printability are required. Particularly, because various intermetallic compounds and precipitates are generated in these materials, there are the drawbacks that defects of the anodic oxide film tend to be caused resulting in considerable inferiority in resistance to severe ink soiling and, in addition, the presence of the intermetallic compounds and the precipitates gives rise to causes such as blanket soiling which deteriorates printability. Also, uniform surface-roughening cannot be accomplished, causing the problem of insufficient adhesion to the light-sensitive layer and inferior printing durability.

Further, it is essential for a reduction in energy consumption in the future to make full use of low purity aluminum plates as aluminum supports for planographic printing plates with a view to suppressing energy consumption in the recycling of used aluminum.

SUMMARY OF THE INVENTION

It is an object of the present invention to provide a process for producing a high quality planographic printing plate-use aluminum support, the process being remarkably reduced in raw material costs by using, as the raw material, a material whose alloy composition is not controlled, namely, a scrap material containing various impurities or a ground metal known as a secondary metal (recycled metal) which has a commercial price lower than that of virgin metal and contains many impurity elements, and being restricted in the occurrence of severe ink soiling and blanket soiling, and also to provide a planographic printing plate-use aluminum support and a planographic printing master plate. Another object of the present invention is to provide a planographic printing plate-use aluminum support which is free from the necessity for provision of an expensive intermediate layer and the necessity of a uniform roughening treatment, which uses very inexpensive raw materials and which has high adhesion to a light-sensitive layer and excellent printing durability.

The aforementioned objects are attained by the following means.

A first aspect of the present invention is a process for producing an aluminum support for a planographic printing plate, the process including the steps of: (a) preparing an aluminum plate; (b) disposing said aluminum plate in an aqueous acidic solution; and (c) electrochemically surface-roughening said aluminum plate using an alternating current, wherein a ratio $Q_C/Q_A$ of a cathode-time quantity of electricity of said aluminum plate $Q_C$ to an anode-time quantity of electricity of said aluminum plate $Q_A$ is from 0.95 to 2.5.

A second aspect of the present invention is an aluminum support for a planographic printing plate formed by electrochemically surface-roughening an aluminum plate in an aqueous acidic solution using an alternating current, wherein a ratio of cathode-time quantity of electricity of said aluminum plate during said surface-roughening to anode-time quantity of electricity of said aluminum plate during said surface-roughening is from 0.95 to 2.5.

A third aspect of the present invention is a planographic printing master plate having at least a positive-type or negative-type light-sensitive layer on an aluminum support for a planographic printing plate, wherein said aluminum support for a planographic printing plate is formed by electrochemically surface-roughening an aluminum plate in an aqueous acidic solution using an alternating current, wherein a ratio of cathode-time quantity of electricity of said aluminum plate during said surface-roughening to anode-time quantity of electricity of said aluminum plate during said surface-roughening is from 0.95 to 2.5.

A fourth aspect of the present invention is an aluminum support for a planographic printing plate including an aluminum alloy plate having an aluminum content of 95 to 99.4 mass %, on which at least a surface-roughening treatment and an anodic oxidation treatment have been performed.

DETAILED DESCRIPTION OF THE PREFERRED EMBODIMENTS

Figure 1:
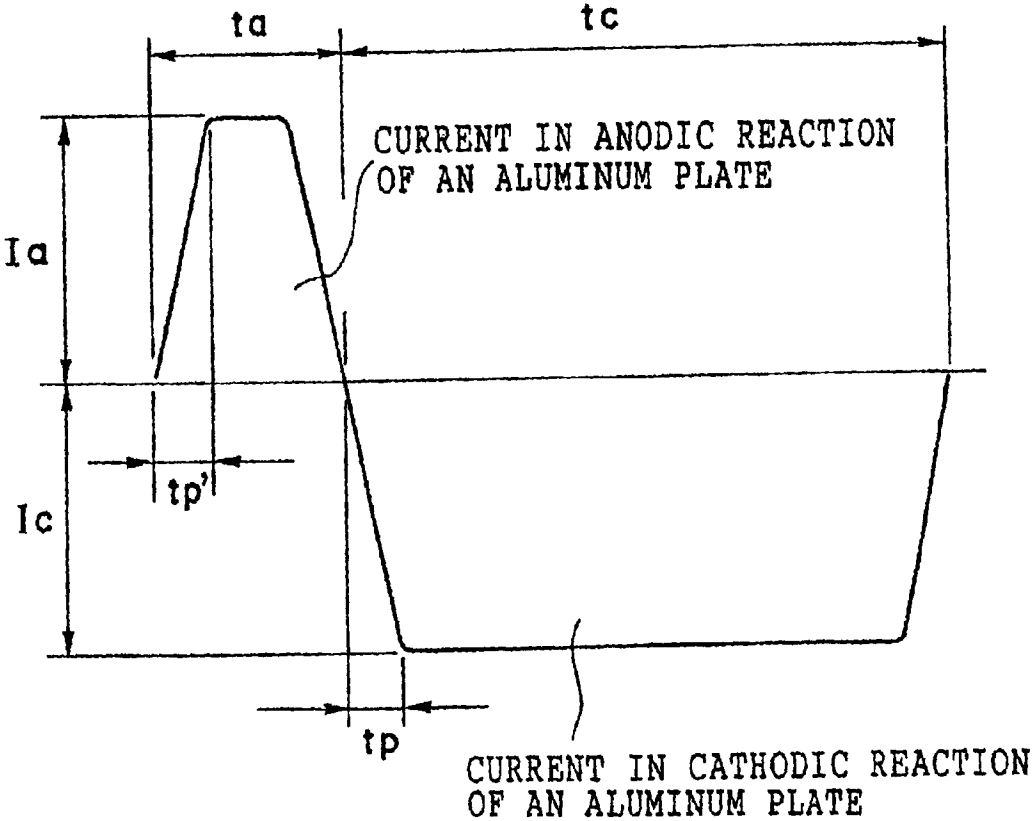
FIG. 1 is an explanatory view of a trapezoidal wave of a.c. current which is preferably used in the present invention.

First, a first embodiment to a third embodiment of the present invention (a process for producing a planographic printing plate-use aluminum support, a planographic printing plate-use aluminum support and a planographic printing master plate) will be explained in detail.

Process for Producing a Planographic Printing Plate-Use Aluminum Support

A planographic printing plate-use aluminum support is usually produced through a degreasing step of removing rolling oil stuck to an aluminum plate, a desmutting step of dissolving smuts on the surface of the aluminum plate, a surface-roughening step of roughening the surface of the aluminum plate and an anodic oxidation step of coating the surface of the aluminum plate with an oxide film.

The process for the production of the support according to the present invention involves the surface-roughening step of roughening the surface of an aluminum plate electrochemically in an aqueous acidic solution by using a.c. current, wherein a ratio ($Q_C/Q_A$) of a cathode-time quantity ($Q_C$) of electricity of the aluminum plate to an anode-time quantity ($Q_A$) of electricity of the aluminum plate is from 0.95 to 2.5. As the aqueous acidic solution, an aqueous acidic solution primarily containing nitric acid or an aqueous acidic solution primarily containing hydrochloric acid and aluminum chloride is preferably used. It is also desirable that the duty ratio ratio of the above a.c. current is from 0.25 to 0.5 and the frequency of the above a.c. current is from 30 to 200 Hz in the above surface-roughening step. Moreover, it is also preferable to carry out such a surface-roughening step two or more times.

The process for the production of the support according to the present invention involves, other than the above surface-roughening step, a step of treating the surface of the aluminum plate by combining a mechanical surface-roughening treatment with a chemical etching treatment performed in an aqueous acidic or alkaline solution and an anodic oxidation step. Further, the production process of the present invention including the surface-roughening step may be either a continuous process or an intermittent process. However, the continuous process is preferably used from the industrial point of view.

The support produced by the production process of the present invention is processed through a sealing step and a hydrophilicizing treatment step and thereafter formed with, for example, an undercoat layer and a positive- or negative-type light-sensitive layer, thereby forming a planographic printing master plate. Also, a matt layer may be formed on the surface of the light-sensitive layer according to the need.

Surface-roughening Step

First, the surface-roughening step in the present invention will be explained.

The surface-roughening step is a step of roughening the surface of an aluminum plate electrochemically by feeding a.c. current using the aluminum plate as an electrode in an aqueous acidic solution and differs from a mechanical surface roughening treatment explained later. In the present invention, the ratio ($Q_C/Q_A$) of the quantity of electricity when the aluminum plate works as a cathode, namely, the cathode-time quantity ($Q_C$) of electricity of the aluminum plate, to the quantity of electricity when the aluminum plate works as an anode, namely, the anode-time quantity ($Q_A$) of electricity of the aluminum plate, is made to fall in a range from 0.95 to 2.5 in the above surface-roughening step. This makes it possible to produce uniform honeycomb pits on the surface of the aluminum plate. If the above $Q_C/Q_A$ is less than 0.95, only non-uniform honeycomb pits tend to be produced and also if the above $Q_C/Q_A$ exceeds 2.5, only non-uniform honeycomb pits tend to be produced. Also, the above $Q_C/Q_A$ preferably falls in a range from 1.5 to 2.0.

In the present invention, it is also desirable that the duty ratio ratio of the a.c. current is in a range from 0.25 to 0.5. This makes it possible to rough the surface of the aluminum plate uniformly. If the duty ratio of the above a.c. current is less than 0.25, the surface of the aluminum plate may be not uniformly roughened and also if the duty ratio exceeds 0.5, the surface of the aluminum plate may be not uniformly roughened. Also, the duty ratio of the above a.c. current is preferably in a range from 0.3 to 0.4. The duty ratio in the present invention is expressed as ta/T wherein time (anodic reaction time) during which the anodic reaction of the aluminum plate is continued at an a.c. current frequency with a period of T is ta. Particularly, on the surface of the aluminum plate during cathodic reaction, in addition to dissolution or breaking of the oxide film, generation of smut components primarily containing aluminum hydroxide is caused. These dissolved or broken positions become the start points of a pitting reaction during the subsequent anode reaction of the aluminum plate. Therefore, the selection of the duty ratio of the a.c. current has a large effect on uniform roughening.

In the present invention, the frequency of the a.c. current in the above surface-roughening treatment is preferably 30 to 200 Hz. This makes it easy to manufacture a system through which large current is allowed to flow. If the frequency is less than 30 Hz, carbon of a main electrode will be considerably fused, and if the frequency exceeds 200 Hz, it may be difficult to manufacture an electrode system. Also, the frequency of the above a.c. current is preferably 40 to 120 Hz.

Examples of the waveform of the a.c. current used in the surface-roughening step include a sine wave, rectangular wave, triangular wave and trapezoidal wave. Among these waveforms, a rectangular wave or trapezoidal wave is preferred.

An example of a trapezoidal wave preferably used in the present invention is shown in FIG. 1. In FIG. 1, the ordinate shows value of current, the abscissa shows time, ta shows the anode reaction time, tc shows the cathode reaction time, tp and tp' show time required for the value of current to reach a peak from 0, Ia shows current when the anode cycle side reaches a peak and Ic shows current when the cathode cycle side reaches a peak. When a trapezoidal wave is used as the waveform of the a.c. current, the times tp and tp' required for the current to reach a peak from 0 are from 0.1 to 2 msec and more preferably from 0.3 to 1.5 msec. If the above times tp and tp' are less than 0.1 msec, a large power voltage will be required at the first transition of the current waveform, because of the effect of impedance of a power circuit, resulting in high system costs. On the other hand, if the above times tp and tp' exceed 2 msec, the influence of minute components in the aqueous acidic solution increases, so that uniform surface-roughening treatment is performed with difficulty.

As to density of current of the above a.c. current in terms of peak value of a trapezoidal wave or rectangular wave, both Iap on the anode cycle side and Icp on the cathode cycle side of the a.c. current are preferably from 10 to 200 A/dm$^2$. Also, the ratio of Icp/Iap is preferably in a range from 0.9 to 1.5. In the above surface-roughening step, the sum of the quantities of electricity required for the anode reaction of the aluminum plate by the time the electrochemical surface-roughening is finished is preferably 50 to 800 C/dm$^2$.

As the aqueous acidic solution to be used in the present invention, those used for electrochemical surface-roughening treatment using general d.c. current or a.c. current may be used. Among these solutions, an aqueous acidic solution primarily containing nitric acid is preferably used. Here, the term "primarily" in the present specification means that an essential component is contained in the aqueous solution in an amount of 30 mass % or more and preferably 50 mass % or more based on the total components. The case of other components hereinbelow is the same.

As the aqueous acidic solution primarily containing nitric acid, those used for electrochemical surface-roughening treatment using general d.c. current or a.c. current may be used as aforementioned. For example, one or more types among aluminum nitrate, sodium nitrate, ammonium nitrate and the like may be used by adding these compounds to an aqueous nitric acid solution with a nitric acid concentration of 5 to 15 g/l in an amount of from 0.01 g/l to a saturation amount. Metals and the like, such as iron, copper, manganese, nickel, titanium, magnesium and silicon, which are to be contained in an aluminum alloy may be dissolved in the aqueous acidic solution primarily containing nitric acid.

As the aqueous acidic solution primarily containing nitric acid, it is preferable to use a solution which contains nitric acid, an aluminum salt and a nitrate, and is obtained by adding aluminum nitrate and ammonium nitrate to an aqueous nitric acid solution with a nitric acid concentration of 5 to 15 g/l such that the amount of aluminum ions is 1 to 15 g/l and preferably 1 to 10 g/l and the amount of ammonium ions is 10 to 300 ppm. The above aluminum ions and ammonium ions increase in a spontaneously generative manner when the electrochemical surface treatment is being carried out. The solution temperature at this time is preferably 10 to 95° C. and more preferably 40 to 80° C.

As the aqueous acidic solution used in the present invention, it is also preferable to use an aqueous acidic solution primarily containing hydrochloric acid and aluminum chloride (hereinafter referred to as "aqueous acidic solution primarily containing hydrochloric acid" as the case may be). "Aqueous acidic solution primarily containing hydrochloric acid and aluminum chloride" in the present invention means that the total amount of hydrochloric acid and aluminum ions to be contained is 30 mass % or more and preferably 50 mass % or more.

As the aqueous acidic solution primarily containing hydrochloric acid, those used for electrochemical surface-roughening treatments using general d.c. current or a.c. current may be used. For example, one or more types among aluminum chloride, sodium chloride, ammonium chloride and the like may be used by adding these compounds to 5 to 15 g/l of hydrochloric acid in an amount of from 1 g/l to a saturation amount. Metals and the like, such as iron, copper, manganese, nickel, titanium, magnesium and silicon, which are to be contained in an aluminum alloy may be dissolved in the aqueous acidic solution primarily containing hydrochloric acid.

As the aqueous acidic solution primarily containing hydrochloric acid, it is preferable to use a solution which is obtained by adding aluminum chloride in hydrochloric acid with a hydrochloric acid concentration of 5 to 15 g/l such that the amount of aluminum ions is 1 to 10 g/l. The above aluminum ions increase in a spontaneously generative manner when the electrochemical surface treatment is being carried out. The liquid temperature at this time is preferably 10 to 95° C. and more preferably 30 to 50° C.

In the production process of the present invention, the above surface-roughening step is preferably carried out two or more times. A surface shape suitable as the planographic printing plate-use aluminum support can be obtained by performing the above surface-roughening step two or more times. In each surface-roughening step, one or more factors among the duty ratio, frequency, ratio of the quantities of electricity, quantities of electricity, liquid composition, liquid temperature and current density are preferably different. Also, in the case where the above surface-roughening step is carried out, for example, two times in the production process of the present invention, a step of performing an alkali etching treatment and desmutting treatment (intermediate treating step) is preferably carried out between the surface-roughening steps. This makes it possible to obtain a more uniform surface shape.

To state concretely, the production process of the present invention preferably comprises a first surface-roughening step of roughening an aluminum plate electrochemically in an aqueous acidic solution primarily containing hydrochloric acid and aluminum chloride by using a.c. current, an intermediate treating step of etching the aluminum plate, which has been surface-roughened electrochemically in the first surface-roughening step, in an aqueous alkaline solution and thereafter performing a desmutting treatment in an acidic solution, and a second surface-roughening step of roughening the aluminum plate, which has been treated in the intermediate treating step, electrochemically in an aqueous acidic solution primarily containing hydrochloric acid and aluminum chloride by using a.c. current.

As the aluminum plate used in the present invention, those comprising known raw materials as described in ALUMINUM HANDBOOK Fourth edition (1990, Light Metal Association), for example, and the materials of JIS 1050, JIS 1100, JIS 3003, JIS 3103 and JIS 3005 may be used. In the present invention, particularly, it is preferable to use an aluminum plate using an aluminum alloy, scrap aluminum material or secondary metal which has an aluminum (Al) content of 95 to 99.4 mass % and contains at least 5 metals among iron (Fe), silicon (Si), copper (Cu), magnesium (Mg), manganese (Mn), zinc (Zn), chromium (Cr) and titanium (Ti) in amounts described later.

In the present invention, an aluminum plate with the content of Al being 95 to 99.4 mass % is preferably used. If the content exceeds 99.4 mass %, the effect of reducing costs may be decreased because the tolerance of impurities is decreased. On the other hand, if the content is less than 95 mass %, impurities are contained in a large amount resultantly and there will be cases where defects such as cracks are caused during rolling. The content of Al is more preferably 95 to 99 mass % and particularly preferably 95 to 97 mass %.

The content of Fe is preferably 0.3 to 1.0 mass %. Fe is an element contained even in a virgin metal in an amount around 0.1 to 0.2 mass %. Fe is scarcely melted in Al as a solid solution and is almost entirely left as intermetallic compounds. If the content of Fe exceeds 1.0 mass %, cracks will tend to be caused in the course of a rolling operation, and if the content of Fe is less than 0.3 mass %, the effect of reducing costs will be decreased and therefore such amounts out of the defined range are undesirable. The content of Fe is more preferably 0.5 to 1.0 mass %.

The content of Si is preferably 0.15 to 1.0 mass %. Si is often contained in scraps of JIS 2000 type, 4000 type and 6000 type materials. Si is also an element contained in a virgin metal in an amount around 0.03 to 0.1 mass % and exists in Al in the state of a solid solution or as intermetallic compounds. When the raw material is heated in the course of the production of the support, Si which has been melted as a solid solution precipitates occasionally as simple Si. Intermetallic compounds between simple Si and FeSi types are known to adversely affect anti-severe ink soiling ability. If the content of Si exceeds 1.0 mass %, Si may be incompletely removed by, for example, the treatment using sulfuric acid (desmutting treatment) which is explained later. On the other hand, if the content is less than 0.15 mass %, cost reducing effects will be decreased. The content of Si is more preferably 0.3 to 1.0 mass %.

The content of Cu is preferably 0.1 to 1.0 mass %. Cu is often contained in scraps of JIS 2000 type and 4000 type materials. Cu is relatively easily melted as a solid solution in Al. If the content of Cu exceeds 1.0 mass %, Cu may be incompletely removed by, for example, the treatment using sulfuric acid which is explained later. On the other hand, if the content is less than 0.1 mass %, cost reducing effects will be decreased. The content of Cu is more preferably 0.3 to 1.0 mass %.

The content of Mg is preferably 0.1 to 1.5 mass %. Mg is often contained in the scraps of JIS 2000 type, 3000 type, 5000 type and 7000 type materials. Mg is contained much in, particularly, can end materials and is therefore a major impurity metal contained in scraps. Mg is also relatively easily melted as a solid solution in Al and combined with Si to form intermetallic compounds. If the content of Mg exceeds 1.5 mass %, Mg may be incompletely removed by, for example, the treatment using sulfuric acid which is explained later. On the other hand, if the content is less than 0.1 mass %, cost reducing effects will be decreased. The content of Mg is more preferably 0.5 to 1.5 mass % and still more preferably 1.0 to 1.5 mass %.

The content of Mn is preferably 0.1 to 1.5 mass %. Mn is often contained in scraps of JIS 3000 type materials. Mn is often contained in, particularly, can body materials and is therefore a major impurity metal in scraps. Mn is also relatively easily melted as a solid solution in Al and combined with AlFeSi to form intermetallic compounds. If the content of Mn exceeds 1.5 mass %, Mn may be incompletely removed by, for example, the treatment using sulfuric acid which is explained later. On the other hand, if the content is less than 0.1 mass %, cost reducing effects will be decreased. The content of Mn is more preferably 0.5 to 1.5 mass % and still more preferably 1.0 to 1.5 mass %.

The content of Zn is preferably 0.1 to 0.5 mass %. Zn is often contained in scraps of JIS 7000 type materials. Zn is also relatively easily melted as a solid solution in Al. If the content of Zn exceeds 0.5 mass %, Zn may be incompletely removed by, for example, the treatment using sulfuric acid which is explained later. On the other hand, if the content is less than 0.1 mass %, cost reducing effects will be decreased. The content of Zn is more preferably 0.3 to 0.5 mass %.

The content of Cr is preferably 0.01 to 0.1 mass %. Cr is an element contained a little in scraps of JIS 5000 type, 6000 type and 7000 type materials. If the content of Cr exceeds 0.1 mass %, Cr may be incompletely removed by, for example, the treatment using sulfuric acid which is explained later. On the other hand, if the content is less than 0.01 mass %, cost reducing effects will be decreased. The content of Cr is more preferably 0.05 to 0.1 mass %.

The content of Ti is preferably 0.03 to 0.5 mass %. Ti is an element usually added as a crystal fining material in an amount of 0.01 to 0.04 mass %. Ti is contained as an impurity metal in relatively large amounts in scraps of JIS 5000 type, 6000 type and 7000 type materials. If the content of Ti exceeds 0.5 mass %, Ti may be incompletely removed by, for example, the treatment using sulfuric acid which is explained later. On the other hand, if the content is less than 0.03 mass %, cost reducing effects will be decreased. The content of Ti is more preferably 0.05 to 0.5 mass %.

As the aluminum plate used in the present invention, a material containing aluminum in the aforementioned content (purity) and including 5 or more elements among the aforementioned group of 8 impurity elements is used as the raw material. The above raw material is cast by a conventional method. The cast material is appropriately processed by rolling treatment and heat treatment to adjust the thickness to 0.1 to 0.7 mm and is then subjected to flatness remedial treatment according to the need, thereby producing the aforementioned aluminum plate.

As the method of producing the above aluminum plate, a DC casting method, a method from the DC casting method excluding a soaking treatment and/or annealing treatment, or a continuous casting method may be used.

Figure 2:
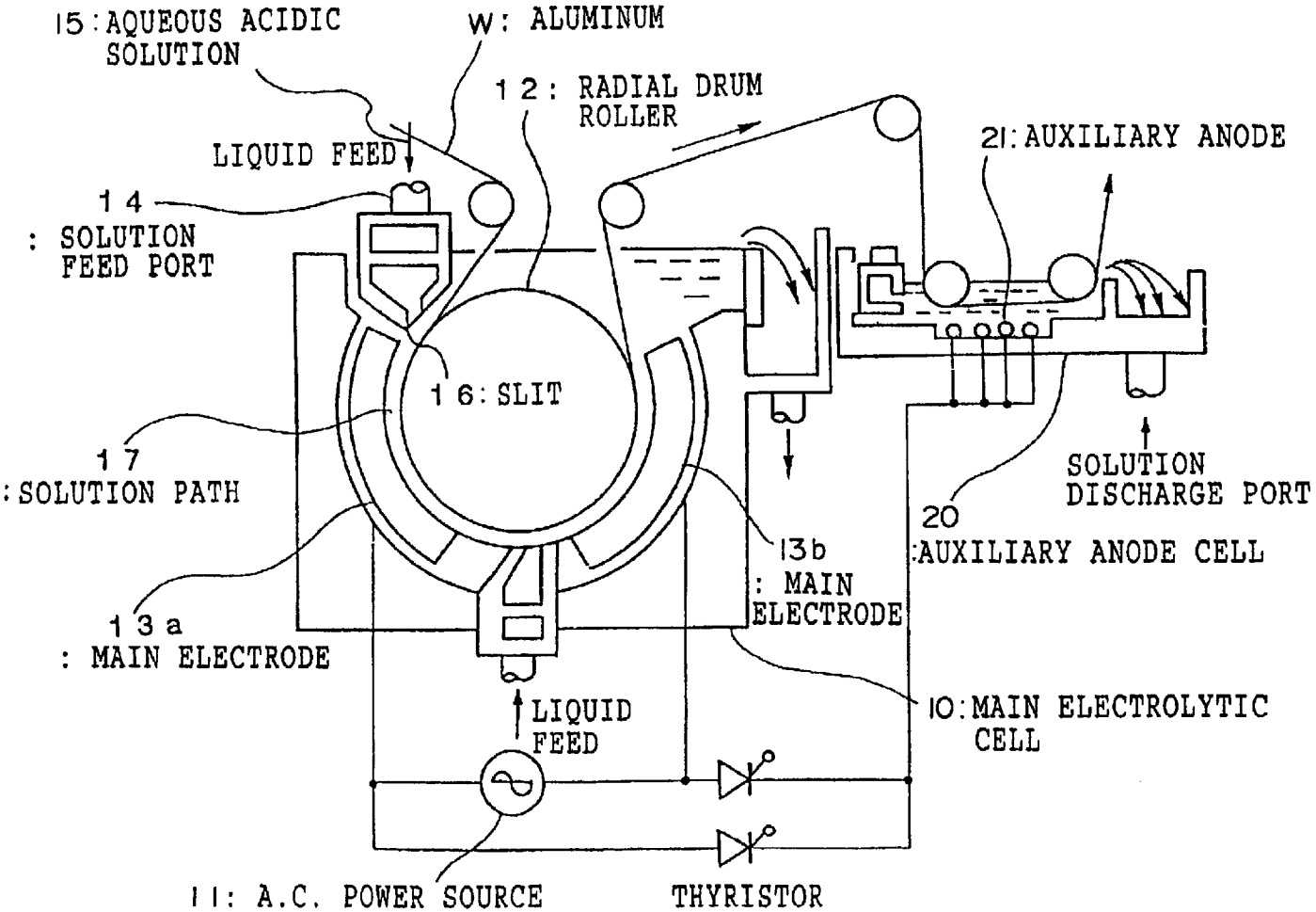
FIG. 2 is a schematic view of a radial type electrolyzer.

As an electrolyzer to be used in the above surface-roughening step, known electrolyzers such as a vertical type, flat type or radial type may be used and a radial type electrolyzer as described in JP-A-5-195300 is particularly preferable. FIG. 2 is a schematic view of a radial type electrolyzer used in the present invention. In the radial type electrolyzer in FIG. 2, an aluminum plate W is carried around a radial drum roller 12 disposed in a main electrolytic cell 10 and electrolyzed by main electrodes 13*a* and 13*b* connected to an a.c. power source 11 while it is conveyed. An aqueous acidic solution 15 is supplied to a solution path 17 disposed between the radial drum roller 12 and the main electrodes 13*a* and 13*b* from a solution supply port 14 through a slit 16. Then, the aluminum plate W treated in the main electrolytic cell 10 is electrolyzed in an auxiliary anode cell 20. In this auxiliary anode cell 20, an auxiliary anode 21 is disposed opposite to the aluminum plate W and the aqueous acidic solution 15 is supplied to flow between the auxiliary anode 21 and the aluminum plate W. The auxiliary anode 21 may be selected from known electrodes used to generate oxygen. Examples of materials used for such known electrodes include ferrites, iridium oxide, platinum or materials obtained by cladding or plating a bulb metal such as titanium, niobium or zirconium with platinum. Materials used for the main electrodes 13*a* and 13*b* may be selected from electrode materials such as carbon, platinum, titanium, niobium, zirconium, stainless steel and electrode materials used for cathodes of fuel cells. Among these materials, carbon is particularly preferable. As the carbon, impermeable graphite for chemical apparatuses, which is commercially available in general, and graphite impregnated with a resin may be used.

The direction in which the aqueous acidic solution passing though the insides of the electrolytic cell 10 and auxiliary anode cell 20 is fed may be either with or counter to the direction of the advance of the aluminum plate W. The relative flow rate of the aqueous acidic solution to the aluminum plate is preferably 10 to 1000 cm/sec.

One or more a.c. power sources may be connected to one electrolyzer. Also, two or more electrolyzers may be used. Electrolytic conditions in each electrolyzer may be the same or different.

It is also desirable that after electrolytic treatment is finished, the water be drained off by a nip roller and washing be carried out by spraying to prevent the treating solution from being carried to a subsequent step.

Moreover, in the above surface-roughening treatment, it is preferable that the concentration of the above aqueous acidic solution be kept constant, by adding nitric acid and water in proportion to the quantity of electricity passed through the aqueous acidic solution in which the anodic reaction of the aluminum plate in the electrolyzer is run, while the amount of each of nitric acid and water is controlled based on the concentration of each of nitric acid and aluminum ions, the concentration being calculated from, for example, (i) the conductance of the aqueous acidic solution, (ii) the propagation speed of ultrasound and (iii) temperature, and by discharging the aqueous acidic solution in a volume equal to the volume of nitric acid and water to be added, by overflowing the aqueous acidic solution point by point from the electrolyzer.

Next, the surface treatment step involving the mechanical surface-roughening treatment, chemical etching treatment performed in an aqueous acidic or alkaline solution and desmutting treatment, as appropriate, will be explained in that order. The surface treatment step is performed in a pre-stage (first treating step) prior to the above surface-roughening step, a stage (second treatment) after the aforementioned surface treatment step, which is plurally repeated, and before the anodic oxidation treatment explained later or in a stage (intermediate treatment step) between, for example, the first surface-roughening step and the second surface-roughening step in a plurality thereof. It is to be noted that each treating step below is an example and the present invention is not limited to the content of the following steps. Also, the following treatments, including the surface treatment step, are carried out optionally.

Surface Treatment Step (Mechanical Surface-roughening Treatment)

The mechanical surface-roughening treatment meant in the present invention is a type of treatment for roughening the surface of the aluminum plate mechanically by using a brush or the like and is preferably performed in the first treating step.

The mechanical surface-roughening treatment is preferably carried out using a rotating nylon brush roll having a hair diameter of 0.07 to 0.57 mm and an abrasive-containing slurry solution supplied to the surface of the aluminum plate. As the abrasive used in the mechanical surface-roughening treatment, a known abrasive may be used and it is preferable to use silica sand, quartz, aluminum hydroxide or a mixture of these materials as described in JP-A-6-135175 and JP-B-50-40047.

A slurry solution having a specific gravity ranging from 1.05 to 1.3 is preferably used. Given as examples of methods of supplying the slurry solution to the surface of the aluminum plate are a method of spraying the slurry solution, a method using a wire brush and a method in which the shape of the surface of a roll with irregularities is transferred to the aluminum plate. Also, methods described in, for example, JP-A-55-074898, JP-A-61-162351 and JP-A-63-104889 may be used. Further, as described in Japanese National Publication No. 9-509108, a method may be used in which the surface of the aluminum plate is polished using a brush in an aqueous slurry containing a mixture of particles consisting of alumina and quartz in a mass ratio ranging from 95:5 to 5:95. At this time, the average particle diameter of the mixture is in a range preferably from 1 to 40 $\mu$m and particularly preferably from 1 to 20 $\mu$m.

The above nylon brush preferably has a low coefficient of water absorption, for example, a Nylon Bristle 200T (6,10-nylon, softening point: 180° C., melting point: 212 to 214° C., specific gravity: 1.08 to 1.09, water content: 1.4 to 1.8 at 20° C. under a relative humidity of 65% and 2.2 to 2.8 at 20° C. under a relative humidity of 100%, dry tension: 4.5 to 6 g/d, dry tensile elongation: 20 to 35%, boiling water shrinkage factor: 1 to 4%, dry tensile resistance: 39 to 45 g/d, Young's modulus (dry): 380 to 440 kg/mm$^2$) is preferable.

(Chemical Etching Treatment in an Aqueous Alkaline Solution (Alkali Etching Treatment))

The alkali etching treatment in the present invention means that the surface of the aluminum plate is chemically etched in an aqueous alkaline solution. The alkali etching treatment is preferably performed in each of the first treating step and the second treating step. The concentration of the aqueous alkaline solution is preferably 1 to 30 mass %. The aqueous alkaline solution may contain alloy components contained in the aluminum plate in an amount of 0.5 to 10 mass %, as well as aluminum.

As the aqueous alkali solution, particularly an aqueous solution primarily containing sodium hydroxide (caustic soda) is preferable.

The aforementioned alkali etching treatment is carried out in conditions of the temperature of the aqueous alkaline solution is from ambient temperature to 95° C. and treating time is 1 to 120 seconds. In the intermediate treating step, the amount of the aluminum plate to be dissolved affects the size of pits formed on the surface of the aluminum plate. Therefore, the amount of the aluminum plate to be dissolved is controlled in the intermediate treating step whereby the size of pits produced in the intermediate treatment step can be controlled.

When a chemical etching solution is first mixed in the aqueous alkaline solution, a treating solution is preferably prepared using liquid sodium hydroxide (caustic soda) and sodium aluminate (aluminic acid soda).

It is also desirable that, after the alkali etching treatment is finished, water be drained off by a nip roller and washing be carried out by spraying to prevent the treating solution from being carried to the next step.

(Etching Treatment in an Aqueous Acidic Solution (Acidic Etching Treatment))

The acidic etching treatment in the prevent invention means treatment in which the aluminum plate is chemically etched in an aqueous acidic solution and is preferably carried out in the second treating step or after the alkali etching treatment is finished. If the above acidic etching treatment for the aluminum plate is performed after the alkali etching treatment is carried out, intermetallic compounds containing silica or simple Si present on the surface of the aluminum plate can be removed and therefore the occurrence of defects of the anodic oxide film generated in the successive anodic oxidation step can be precluded.

Examples of the acid which may be used in the acidic etching treatment include phosphoric acid, nitric acid, sulfuric acid, chromic acid, hydrochloric acid and a mixed acid containing two or more of these acids. Among these acids, particularly an aqueous sulfuric acid solution is preferable. The concentration of the aqueous acidic solution is preferably 300 to 500 g/l and the aqueous acidic solution may contain alloy components contained in the aluminum plate as well as aluminum.

The acidic etching treatment is carried out in conditions of the temperature of the solution is 60 to 90° C. and preferably 70 to 80° C. and treating time is 1 to 10 seconds. The amount of the aluminum plate to be dissolved at this time is preferably 0.001 to 0.2 g/m$^2$. Also, the concentration of the acid, for example, the concentration of the acid and the concentration of aluminum are preferably selected from a range where no precipitation arises at ambient temperature. The concentration of aluminum ions is preferably 0.1 to 15 g/l and particularly preferably 5 to 15 g/l.

It is desirable that after the acidic etching treatment is finished, the water be drained off by a nip roller and spray washing be carried out to prevent the treating solution from being carried to the next step.

(Desmutting Treatment in an Acidic Solution)

In general, when a chemical etching treatment is carried out using an aqueous alkali solution, smuts are produced on the surface of the aluminum plate. It is therefore preferable to carry out the so-called desmutting treatment for dissolving the smuts in an acidic solution containing phosphoric acid, nitric acid, sulfuric acid, chromic acid, hydrochloric acid or a mixed acid consisting of two or more of these acids. The desmutting treatment is appropriately carried out preferably in the first treating step or second treating step and more preferably in succession to the alkali etching treatment or the like.

The concentration of the above aqueous acidic solution is preferably 1 to 300 g/l. Further, besides aluminum, the alloy components contained in the aluminum plate may be dissolved in the aqueous acidic solution in an amount of 1 to 15 g/l.

In the desmutting treatment, the temperature of the acidic solution is preferably 20° C. to 95° C. and more preferably 30 to 70° C. Also, treating time is preferably 1 to 120 seconds and more preferably 2 to 60 seconds.

It is desirable that after the desmutting treatment is finished, water be drained off by a nip roller and spray washing be carried out to prevent the treating solution from being carried to the next step.

As the desmutting treating solution (acidic solution), the use of waste aqueous acidic solution used in the above surface-roughening treatment is desirable with the view of reducing amounts of waste liquid.

In the first treating step performed in the pre-stage prior to the aforementioned surface roughening step in the present invention, the above desmutting treatment in the acidic solution is preferably performed after providing the aluminum plate with the aforementioned mechanical surface-roughening treatment and/or the alkali etching treatment such that the amount of the aluminum plate to be dissolved is 0.01 to 5 g/m$^2$.

In the second treating step performed, in the pre-stage prior to the anodic oxidation step explained later, after the aforementioned surface-roughening step or after the aforementioned plural surface-roughening steps, preferably the aluminum plate is treated by acidic etching in an aqueous sulfuric acid solution at 60 to 90° C. for 1 to 10 seconds or by alkali etching performed to dissolve 0.01 to 5 g/m$^2$ of the aluminum plate in an aqueous alkaline solution. Then the desmutting treatment is performed in the acidic solution or the acidic etching treatment is performed in an aqueous sulfuric acid solution at 60 to 90° C. for 1 to 10 seconds. When the aluminum plate is treated by alkali etching, it is desirable to perform the above acidic etching treatment in conditions of the solution temperature is 60 to 90° C. and treating time is 1 to 10 seconds to remove intermetallic compounds containing silica or simple Si present on the surface of the aluminum plate. The provision of the acidic etching treatment, as aforementioned, makes it possible to prevent defects of the anodic oxide film being generated in the sunbsequent anodic oxidation step. As a consequence, a problem called dust-like soiling, in which spots of ink adhere to a non-image portion, can be ameliorated.

In the intermediate treating step performed between the first surface-roughening step and the second surface-roughening step, the alkali etching treatment and desmutting treatment are preferably performed. The amount of the aluminum plate to be dissolved in the alkali etching treatment in the intermediate treating step is preferably 0.01 to 10 g/m$^2$ and more preferably 0.1 to 5 g/m$^2$.

Anodic Oxidation Step

In the process for the production of the support according to the present invention, anodic oxidation treatment is preferably carried out after the above surface-roughening step or second treating step (anodic oxidation step) to improve the wear resistance of the surface of the aluminum plate. The anodic oxidation treatment in the present invention means the treatment for generating the anodic oxide film on the surface of the aluminum plate by dipping the aluminum plate as an anode in an electrolyte and by allowing current to flow through the electrolyte.

As the electrolyte used in the anodic oxidation treatment of the aluminum plate, any material may be used as long as it produces a porous oxide film. Generally, sulfuric acid, phosphoric acid, oxalic acid, chromic acid or a mixed solution of these acids is used. The concentration of each of these electrolytes is appropriately determined according to the type of electrolyte.

The conditions of the anodic oxidation treatment cannot be specified as a whole because these conditions differ depending on the type of electrolyte to be used. However, the following ranges for these conditions of the electrolyte are generally desirable: concentration: 1 to 80 mass %, solution temperature: 5 to 70° C., current density: 1 to 60 A/dm$^2$, voltage: 1 to 100 V and electrolytic time: 10 seconds to 300 seconds.

The sulfuric acid method using an aqueous sulfuric acid solution as the electrolyte is usually applied using d.c. current; however, a.c. current may be used. The quantity of the anodic oxide film to be formed is in a range appropriately from 1 to 10 g/m$^2$ and particularly appropriately from 1.1 to 5 g/m$^2$. If the quantity is less than 1 g/m$^2$, only insufficient printing durability will be obtained, causing flaws to be easily produced with the result that a phenomenon, so-called flaw soiling, in which ink adheres to a non-image portion of a planographic printing plate tends to occur.

In addition, if the quantity of the anodic oxide film is excessive, the anodic oxide film is localized on the edge part of the aluminum. Therefore, a difference in the quantity of the anodic oxide film between the edge part and the center part of the aluminum plate is preferably 1 g/m$^2$ or less.

In the anodic oxidation treatment, sulfuric acid is preferably used as the electrolyte. The use of sulfuric acid is described in JP-A-54-128453 and JP-A-48-45303 in detail. In the above aqueous sulfuric acid solution, it is preferable that the concentration of sulfuric acid be in a range from 10 to 300 g/l and the concentration of aluminum ions be in a range from 1 to 25 g/l. It is more preferable that the concentration of aluminum ions be made 2 to 10 g/l by adding aluminum sulfate and that the aqueous sulfuric acid solution has a concentration of 50 to 200 g/l. The solution temperature is preferably 30 to 60° C.

In the case of adopting a d.c. current method using d.c. current, the density of current is preferably 1 to 60 A/dm$^2$ and more preferably 5 to 40 A/dm$^2$.

If the anodic oxidation treatment for the aluminum plate (aluminum sheet) is carried out continuously, the anodic oxidation treatment is preferably performed at current densities set as follows; the current density is first as low as 5 to 10 A/dm$^2$ and is gradually increased up to 30 to 50 A/dm$^2$ or more toward the latter half of the treatment, to prevent localization of current, called burning, of the aluminum plate. At this time, it is preferable to raise the density of current gradually by 5 to 15 steps. Also, it is preferable to dispose an independent power unit in each step and to control the above density of current by the current of this power unit. As the power feed method, a liquid power feed system using no conductor roller is preferable. In general, iridium oxide or lead may be used for the anode and aluminum used for the cathode. As an example of the system used for the anodic oxidation treatment, one described in, for example, the specification of JP-A-11-178624 is given.

Minute component elements contained in the aluminum plate may be dissolved in the aforementioned aqueous sulfuric acid solution. Also, because aluminum is eluted in the aqueous sulfuric acid solution during the anodic oxidation treatment, it is necessary to control the concentration of sulfuric acid and the concentration of aluminum ions to control the step. If the concentration of aluminum ions is set to a low value, it is necessary to frequently renew the aqueous sulfuric acid solution used to run anodic oxidation, leading to an increase in the amount of wastes, which is not only uneconomical but also poses environmental problems. On the other hand, if the concentration of aluminum ions is set to a high value, electrolytic voltage is increased, resulting in increased power cost and such a high concentration is therefore uneconomical.

Preferable combinations of the concentration of sulfuric acid, the concentration of aluminum ions and the solution temperature for the anodic oxidation are as follows: (i) the concentration of sulfuric acid is 100 to 200 g/l and more preferably 130 to 180 g/l, the concentration of aluminum ions is 2 to 10 g/l and more preferably 3 to 7 g/l and the solution temperature is 30 to 40° C. and more preferably 33 to 38° C.; or (ii) the concentration of sulfuric acid is 50 to 125 g/l and more preferably 80 to 120 g/l, the concentration of aluminum ions is 2 to 10 g/l and more preferably 3 to 7 g/l and the solution temperature is 40 to 70° C. and more preferably 50 to 60° C.

Hydrophilicizing Treatment Step

The aluminum plate is preferably subjected to a hydrophilicizing treatment performed on the surface thereof according to the need in a hydrophilicizing treatment step after the anodic oxidation treatment is performed in the anodic oxidation step. As the hydrophilicizing treatment, it is preferable to use an alkali metal silicate (e.g., aqueous sodium silicate solution) method as disclosed in the specifications of U.S. Pat. Nos. 2,714,066, 3,181,461, 3,280,734 and 3,902,734. In this method, the support is dipped in aqueous sodium silicate or electrolyzed in the aqueous solution. Other preferable methods to be used include a method of treating using potassium fluorozirconate as disclosed in JP-B-36-22063 and a method of treating using polyvinylphosphonic acid as disclosed in the specifications of U.S. Pat. Nos. 3,276,868, 4,153,461 and 4,689,272. Among these methods, it is preferable to carry out hydrophilicizing treatment by using an aqueous sodium silicate or polyvinylphosphonic acid solution.

Sealing Treatment Step

In the present invention, a sealing treatment is preferably carried out to seal holes called micropores that are generated in the anodic oxide film after the anodic oxidation treatment is performed in the anodic oxidation step. Such sealing treatment is carried out, for example, by dipping the plate in an aqueous hot solution containing hot water and an inorganic or organic salt or by placing the plate in a steam bath. It is also preferable to carry out the aforementioned hydrophilicizing treatment after the sealing treatment. As examples of the inorganic salt, silicates, borates, phosphates and nitrates are given and as examples of the organic salt, carboxylates are given.

Production System which can be used in the Production Process of the Present Invention A production system which can be used in the process for producing the planographic printing plate-use aluminum support according to the present invention will be explained.

The process of the production of the support according to the present invention preferably comprises the following steps: (1) the aluminum plate which has been rolled and wound coil-wise is fed from a feeding unit consisting of a multispindle turret, (2) the aluminum plate is dried after the aforementioned each treatment (mechanical surface-roughening treatment, alkali etching treatment, acidic etching treatment, desmutting treatment, electrochemical surface-roughening treatment, anodic oxidation treatment, sealing treatment and hydrophilicizing treatment) and (3) the aluminum plate is wound coil-wise using a take-up unit consisting of the above multispindle turret, or the flatness of the aluminum plate is remedied, and thereafter the aluminum plate is cut to a predetermined length and cut plates are piled. Also, according to the need, a step of forming and drying layers (an undercoat layer, a light-sensitive layer and a matt layer) may be furnished in the above process and the aluminum plate may be made into a planographic printing master plate, which is then wound coil-wise using the above take-up unit.

Also, the production process of the present invention preferably comprises one or more steps of detecting defects generated on the surface of the aluminum plate by using a device for detecting these defects and applying a label as a mark to the edge portion of the found defect. Moreover, in the production method of the present invention, it is preferable to install a reservoir which keeps the running speed of the aluminum plate constant in the aforementioned each step even if the running of the aluminum plate is suspended when the aluminum coil is exchanged at the step of feeding the aluminum plate or the step of winding the aluminum plate, and a step of joining aluminum plates with each other by ultrasound or arc welding is preferably furnished in succession to the step of feeding the aluminum coil.

The production system used in the production process of the present invention is preferably provided with one or more units for detecting the running position of the aluminum plate and correcting the running position. The production system is also preferably provided with a drive unit to reduce the tension of the aluminum plate and to control running speed, and one or more dancer roll units to control tension.

Also, it is desirable to use a tracking unit to keep records as to whether or not each step is in a state fulfilling desired conditions and to apply a label to the edge part of the aluminum web before the aluminum coil is wound so as to judge afterwards whether or not the state after applying the label fulfills desired conditions.

Preferably the aluminum plate and a laminating paper are charged with electricity to make the both adhere to each other and are thereafter cut and/or slit to a predetermined length. Also, it is preferable that based on the information of the label applied to the edge portion of the aluminum plate, the label be used as a mark to classify the aluminum plate as a good product or an inferior product after the aluminum plate is cut to the predetermined length or before the aluminum plate is cut, and that only the good product be piled.

In each step including the aforementioned feeding step, it is important to set optimum tension in each condition according to the size (thickness and width) of the aluminum plate, the quality of aluminum or the running speed of the aluminum web. For this, it is preferable to furnish plural tension controllers which provide feedback control for controlling signals from a tension sensor by utilizing a driving device to educe tension and to control running speed and a dancer roll to control tension. The driving device usually uses a control method using a combination of a d.c. motor and a main drive-roller. As the material of the main drive-roller, rubber is generally used. However, a roller made by laminating nonwoven fabric may be used in a step in which the aluminum web is in a wet condition. Also, rubber or a metal is used for each pass roller. At a part where the aluminum web tends to slip, an auxiliary driving device may be installed to prevent the slip, and a motor and a speed reducer are connected to each pass roller to achieve roll control at a constant speed based on signals from a main driving device.

The planographic printing plate-use aluminum support preferably has the following structure as described in JP-A-10-114046. Specifically, a difference ($R^1-R^2$) between the average surface roughness ($R^1$) in terms of arithmetical average surface roughness (Ra) in a rolling direction and the average surface roughness ($R^2$) in a direction perpendicular to the rolling direction is within 30% of the average surface roughness ($R^1$) in the rolling direction. Further, the average curvature in a rolling direction is within $1.5\times10^{-3}$ $mm^{-1}$, the distribution of curvature in the direction of width is within $1.5\times10^{-3}$ $mm^{-1}$ and the curvature in a direction perpendicular to the rolling direction is within $1.0\times10^{-3}$ $mm^{-1}$.

The planographic printing plate-use aluminum support produced by performing the aforementioned surface-roughening treatment and the like is preferably remedied using a remedy roller having a roll diameter of 20 mm to 80 mm and a rubber hardness of 50 to 95 degrees. This ensures that an aluminum coil crude plate cam be supplied having flatness free from exposure misregistration of the planographic printing master plate in an automatic carriage step in a planographic light-sensitive printer. In JP-A-9-194093, a method and device for measuring the curling of a web, a method and device for repairing curling, and a web cutter are described.

Also, when the planographic printing plate-use aluminum support is continuously produced, whether or not an operation in each step is conducted in appropriate conditions is electrically monitored, a tracking unit is used to keep records as to whether or not each step is in a state fulfilling desired conditions, and a label is applied to the edge part of the aluminum web before the aluminum coil is wound so as to judge afterwards whether or not the state fulfilled desired conditions. This makes it possible to judge whether that part is good or inferior when the aluminum coil is cut or the aluminum plate is piled.

In the system used in the surface-roughening step for treating the aluminum plate, preferably one or more factors among the temperature, specific gravity and conductance of the solution and the propagation speed of ultrasound in the solution are measured, the composition of the solution is found and a feedback control and/or a feed-forward control are provided for controlling the density of the solution to a constant value.

Components including aluminum ions and contained in the aluminum plate are dissolved in the aqueous acidic solution in the aforementioned treating system along with the progress of the surface treatment of the aluminum plate. For this, in order to allow each of the concentration of aluminum ions and the concentration of an acid or alkali to be kept constant, it is preferable to keep the solution composition constant by adding water and an acid, or water and an alkali, intermittently. The concentration of the acid or alkali to be added here is preferably 10 to 98 mass %.

For example, the following method is desirable to control the concentration of the acid or alkali.

First, the conductance, specific gravity or propagation speed of each component solution having a concentration falling in the range intended to be used are measured at each temperature to make a data table. Then, the concentration of a sample solution is found based on the data of the conductance, specific gravity or the propagation speed and temperature of the sample solution with reference to the data table made in advance for the sample solution. A method of measuring the propagation time of ultrasound highly stably with high accuracy is disclosed in JP-A-6-235721. Also, an instrument for measuring density by utilizing the propagation speed of ultrasound is disclosed in JP-A-58-77656. Also, a method in which a data table noting correlations is made for every solution component from plural data and the concentration of a multi-component solution with reference to the data table is disclosed in JP-A-4-19559.

If the method of measuring density by using the propagation speed of ultrasound is combined with the conductance and temperature of the sample solution and this combination is applied to the step of roughening the surface of a planographic printing plate-use aluminum support, the process can be controlled in real time with high accuracy. Therefore, a product having a fixed quality can be produced, leading to improved yield. Also, not only the combination of temperature, the propagation speed of ultrasound and conductance but also a data table of each physical quantity such as specific gravity and conductance relative to temperature is prepared in advance for every concentration and temperature, for example, a data table noting each of the correlations between temperature and specific gravity, temperature and conductance and temperature, conductance and specific gravity. Then, if the method in which the concentration of a multi-component solution is found with reference to the data table is applied to the step of roughening the surface of the aluminum plate for a planographic printing plate, the same effect as above is obtained.

Also, the specific gravity and temperature are measured to find the slurry concentration of the sample material with reference to a data table prepared in advance, whereby the concentration of a slurry can be measured rapidly with high accuracy.

The above measurement of the propagation speed of ultrasound is easily affected by air bubbles in a solution. It is therefore more preferable that the measurement be conducted in a pipe which is vertically disposed and in which a flow directing upwards from the underside exists. The propagation speed of ultrasound is preferably measured when the pressure in the pipe is in a range from 1 to 10 $kg/cm^2$. The frequency of the ultrasonic wave is preferably 0.5 to 3 MHz.

The measurements of the specific gravity, conductance and propagation speed of ultrasound are easily affected by temperature and therefore preferably conducted in a pipe which is in a thermally insulated condition and in which a variation in temperature is controlled to within ±0.3° C. Further, because the conductance and the specific gravity or the conductance and the propagation speed of ultrasound are preferably measured at the same temperature, it is particularly preferable that these measurements be conducted in the same pipe or the same pipe flow. A variation in pressure in the measurement is preferably as small as possible because it is associated with a variation in temperature. Also, the distribution of flow rate in the pipe used for the measurement is preferably as small as possible. Moreover, because the aforementioned measurements are easily affected by a slurry, dusts and air bubbles, it is preferable that a solution which has been passed through a filter and a deaerator be subjected to measurement.

Planographic Printing Plate-Use Aluminum Support

Undercoat Layer

The planographic printing plate-use aluminum support which is produced by the production method of the present invention may be provided with an organic undercoat layer before the light-sensitive layer is formed by application on the surface of the support.

The organic compound used for the organic undercoat layer is selected from, for example, phosphonic acids having an amino group such as carboxymethyl cellulose, dextrin, gum arabic or 2-aminoethylphosphonic acid, organic phosphonic acids such as phenylphosphonic acid, naphthylphosphonic acid, alkylphosphonic acid, glycerophosphonic acid, methylenediphosphonic acid and ethylenediphosphonic acid which may have a substituent, organic phosphoric acids such as phenylphosphoric acid, naphthylphosphoric acid, alkylphosphoric acid and glycerophosphoric acid which may have a substituent, organic phosphinic acids such as phenylphosphinic acid, naphthylphosphinic acid, alkylphosphinic acid and glycerophosphinic acid which may have a substituent, amino acids such as glycine and β-alanine and hydrochlorides of amine having a hydroxyl group such as a hydrochloride of triethanolamine. These compounds may be used by mixing two or more thereof.

The aforementioned organic undercoat layer may be formed using, for example, the following methods: (a) a method in which a solution which is prepared by dissolving the above organic compound in water or an organic solvent such as methanol, ethanol or methyl ethyl ketone or a mixed solvent of these solvents is applied to the support of the present invention, followed by drying to form the undercoat layer or (b) a method in which the support of the present invention is dipped in a solution prepared by dissolving the above organic compound in water or an organic solvent such as methanol, ethanol or methyl ethyl ketone or a mixed solvent of these solvents to make the organic compound adsorb to the support, followed by washing and drying to form the organic undercoat layer.

In the above method (a), a solution containing 0.005 to 10 mass % of the above organic compound may be applied using various methods. Any method such as bar coater coating, rotation coating, spray coating or curtain coating may be used.

In the above method (b), the concentration of the above organic solvent solution is 0.01 to 20 mass % and preferably 0.05 to 5 mass %, dipping temperature is 20 to 90° C. and preferably 25 to 50° C. and dipping time is 0.1 seconds to 20 minutes and preferably 2 seconds to 1 minute. The pH of the solution used in the method is adjusted using a basic material such as ammonia, triethylamine or potassium hydroxide or an acidic material such as hydrochloric acid or phosphoric acid such that the solution can be used in a pH range from 1 to 12. A yellow dye may be added to improve tone reproducibility of the light-sensitive planographic printing plate.

The amount of the above organic undercoat layer to be applied is appropriately 2 to 200 mg/m$^2$ and preferably 5 to 100 mg/m$^2$ after the undercoat layer is dried. If the coating amount is less than 2 mg/m$^2$, sufficient printing durability may not be obtained. An amount exceeding 200 mg/m$^2$ brings about the same result.

Backcoat Layer

The planographic printing master plate using the support obtained by the production process of the present invention may be provided with a coating layer (hereinafter referred to as "backcoat layer" as the case may be) comprising an organic high molecular compound as required on the back face (on the side where the light-sensitive layer is not formed) of the plate so that the light-sensitive layer is not damaged when the planographic printing master plate is superposed thereon.

As a major component of the above backcoat layer, at least one resin selected from the group consisting of saturated copolymer polyester resins, phenoxy resins, polyvinylacetal resins and vinylidene chloride copolymer resins which have a glass transition point of 20° C. or more is preferably used.

The saturated copolymer polyester resin comprises a dicarboxylic acid unit and a diol unit. Examples of the dicarboxylic acid unit of a polyester include aromatic dicarboxylic acids such as phthalic acid, terephthalic acid, isophthalic acid, tetrabromophthalic acid and tetrachlorophthalic acid; and saturated aliphatic dicarboxylic acids such as adipic acid, azelaic acid, succinic acid, oxalic acid, suberic acid, sebacic acid, malonic acid and 1,4-cyclohexanedicarboxylic acid.

Dyes and pigments for coloring, silane coupling agents, diazo resins made from a diazonium salt, organic phosphonic acids, organic phosphoric acids and cationic polymers for improving adhesion to the support of the present invention and waxes, higher fatty acids, higher fatty acid amides, silicone compounds comprising dimethylpolysiloxane, denatured dimethylsiloxane and polyethylene powders which are usually used as lubricants may be further added to the backcoat layer.

The backcoat layer may basically have a thickness sufficient to prevent damage to the light-sensitive layer even if a laminating paper is not present and preferably has a thickness ranging from 0.01 to 8 μm. If the thickness is less than 0.01 μm, it will be difficult to prevent abrasion of the light-sensitive layer when the support is handled in conditions where the planographic printing plate is superposed on the backcoat layer. Also, if the thickness exceeds 8 μm, the backcoat layer may be swollen by a chemical used for the peripheries of the planographic printing master plate during printing and therefore the thickness may fluctuate and printing pressure may change, which deteriorates printing characteristics.

As a method of coating the back face of the support with the backcoat layer, various methods may be applied. Examples include a method in which the components for the above backcoat layer are dissolved in an appropriate solvent to prepare a solution or an emulsion dispersion which is then applied and dried, a method in which a film prepared in advance by molding these components is applied to the support of the present invention by using an adhesive or heat and a method in which a melt film comprising these components is formed using a melt extruder and applied to the support of the present invention. Among these methods, the method in which the components for the backcoat layer are dissolved in an appropriate solvent to prepare a solution which is then applied and dried is most preferable to secure the aforementioned coating amount. As the solvent used here, organic solvents as described in JP-A-62-251739 may be used either singly or mixed.

Also, when the planographic printing master plate is produced, either of the backcoat layer on the back face and the light-sensitive composition layer on the front surface may be applied first or both may be applied simultaneously.

Planographic Printing Master Plate

The support of the present invention may be provided with the following light-sensitive layers to prepare the planographic printing master plate of the present invention. This planographic printing master plate is then put in a state fulfilling the requirements for printing, thereby obtaining a planographic printing plate which can be subjected to exposure and developing and have an image formed thereon.

[I] Case of Disposing a Light-sensitive Layer Containing o-naphthoquinonediazidosulfonate and a Novolac Resin Made of a Mixture of Phenol and Cresol The support of the present invention may be provided with a light-sensitive layer containing o-naphthoquinonediazidosulfonate and a novolac resin made of a mixture of phenol and cresol.

The o-quinonediazide compound previously mentioned is an o-naphthoquinonediazide compound and is described in, for example, various publications as well as the specifications of U.S. Pat. Nos. 2,766,118, 2,767,092, 2,772,972, 2,859,112, 3,102,809, 3,106,465, 3,635,709 and 3,647,443. These o-naphthoquinonediazide compounds may be preferably used.

Among these compounds, particularly o-naphthoquinonediazidosulfonate or o-naphthoquinonediazidocarboxylate which is an aromatic hydroxy compound and o-naphthoquinonediazidosulfonic acid amide or o-naphthoquinonediazidocarboxylic acid amide which is an aromatic amino compound are preferable. Particularly, significantly excellent examples include compounds prepared by ester-reacting o-naphthoquinonediazidosulfonic acid with a condensate of pyrogallol and acetone as described in the specification of U.S. Pat. No. 3,635,709, compounds prepared by ester-reacting o-naphthoquinonediazidosulfonic acid or o-naphthoquinonediazidocarboxylic acid with a polyester having a hydroxy group at its terminal as described in the specification of U.S. Pat. No. 4,028,111, compounds prepared by ester-reacting o-naphthoquinonediazidosulfonic acid or o-naphthoquinonediazidocarboxylic acid with a homopolymer of p-hydroxystyrene or a copolymer of the homopolymer with another copolymerizable monomer as described in the specification of U.K. Patent No. 1,494,043 and compounds prepared by amide-reacting o-naphthoquinonediazidosulfonic acid or o-naphthoquinonediazidocarboxylic acid with a copolymer of p-aminostyrene and another copolymerizable monomer as described in the specification of U.S. Pat. No. 3,759,711.

The above o-quinoneazide compound may be used singly but is preferably used by mixing it with an alkali-soluble resin. Preferable examples of the alkali-soluble resin include novolac type phenol resins, specifically, phenolformaldehyde resins, o-cresolformaldehyde resins and m-cresolformaldehyde resins. Further, it is preferable to use a condensate of a phenol or cresol substituted with an alkyl group having 3 to 8 carbon atoms and a formaldehyde such as t-butylphenolformaldehyde resin together with the above phenol resin as described in the specification of U.S. Pat. No. 4,028,111.

Also, to form a visible image by exposure, for example, compounds such as o-naphthoquinonediazido-4-sulfonylchloride, inorganic anion salts of p-diazodiphenylamine, trihalomethyloxadiazole compounds or trihalomethyloxadiazole compounds having a benzofuran ring are added.

On the other hand, an image coloring agent may be used in the aforementioned light-sensitive layer. As the image coloring agent, triphenylmethane dyes such as Victoria Blue BOH, Crystal Violet and Oil Blue are used. Dyes described in JP-A-62-293247 are particularly preferable. Moreover, the light-sensitive layer may contain, as a fat sensitizer, a novolac resin prepared by condensing a phenol substituted with an alkyl group having 3 to 15 carbon atoms, such as t-butylphenol, n-octylphenol or t-butylphenol, with formaldehyde or o-naphthoquinonediazido-4- or -5-sulfonate (e.g., compounds described in JP-A-61-242446) of such novolac resin.

A nonionic surfactant as described in JP-A-62-252740 may be further contained in the light-sensitive layer to improve developing ability. The aforementioned components may be dissolved in a solvent which can dissolve the above each component and then applied to the support of the present invention. Examples of the solvent used here include ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, methyl lactate, ethyl lactate, dimethylsulfoxide, dimethylacetamide, dimethylformamide, water, N-methylpyrrolidone, tetrahydrofurfuryl alcohol, acetone, diacetone alcohol, methanol, ethanol, isopropanol and diethylene glycol dimethyl ether. These solvents may be preferably used either singly or by mixing them.

On the support of the present invention, the light-sensitive composition comprising these components is preferably disposed in a solid amount of 0.5 to 3.0 g/m$^2$.

[II] Case of Disposing a Light-sensitive Layer Containing a Diazo Resin and a Water-insoluble and Lipophilic High Molecular Compound The support of the present invention may be provided with a light-sensitive layer containing a diazo resin and a water-insoluble and lipophilic high molecular compound.

Examples of the diazo resin include diazo resin inorganic salts which are organic solvent-soluble reaction products of a condensate of p-diazodiphenylamine and formaldehyde or acetaldehyde with a hexafluorophosphate and a tetrafluoroborate, and organic solvent-soluble diazo resin organic acid salts which are reaction products of the above condensate with sulfonic acids such as P-toluenesulfonic acid or salts thereof as described in the specification of U.S. Pat. No. 3,000,309, phosphonic acids such as benzenephosphinic acid or salts thereof or hydroxyl group-containing compounds such as 2,4-dihydroxybenzophenone and 2-hydroxy-4-methoxybenzophenone-5-sulfonic acid or salts thereof. Other diazo resins which may be used in the present invention include co-condensates containing, as structural units, an aromatic compound having at least one organic group among a carboxyl group, sulfonic acid group, sulfinic acid group, phosphorus oxygenic acid group and hydroxyl group, and a diazonium compound, preferably an aromatic diazonium compound. As preferable examples of the above aromatic ring, a phenyl group and naphthyl group may be given. As examples of the aromatic compound having at least one organic group among a carboxyl group, sulfonic acid group, sulfinic acid group, phosphorus oxygenic acid group and hydroxyl group, various compounds may be given, but 4-methoxybenzoic acid, 3-chlorobenzoic acid, 2,4-dimethoxybenzoic acid, p-phenoxybenzoic acid, 4-anilinobenzoic acid, phenoxyacetic acid, phenylacetic acid, p-hydroxybenzoic acid, 2,4-dihydroxybenzoic acid, benzenesulfonic acid, p-toluenesulfinic acid, 1-naphthalenesulfonic acid, phenylphosphoric acid and phenylphosphonic acid are preferable.

As the aromatic diazonium compound constituting the structural unit of the co-condensation diazo resin, diazonium salts as described in, for example, JP-B-49-48001 may be used. Particularly diphenylamine-4-diazonium salts are preferable. These diphenylamine-4-diazonium salts are derived from 4-amino-diphenylamines. Examples of these diphenylamine-4-diazonium salts include 4-aminodiphenylamine, 4-amino-3-methoxydiphenylamine, 4-amino-2-methoxydiphenylamine, 4'-amino-2-methoxydiphenylamine, 4'-amino-4-methoxydiphenylamine, 4-amino-3-methyldiphenylamine, 4-amino-3-ethoxydiphenylamine, 4-amino-3-β-hydroxyethoxydiphenylamine, 4-amino-diphenylamine-2-sulfonic acid, 4-amino-diphenylamine-2-carboxylic acid and 4-amino-diphenylamine-2'-carboxylic acid. Among these compounds, 3-methoxy-4-amino-4-diphenylamine and 4-aminodiphenylamine are particularly preferable.

As diazo resins other than the co-condensation diazo resins with an aromatic compound having an acid group, diazo resins condensed using an aldehyde having an acid group or its acetal compound as described in JP-A-4-18559, JP-A-3-163551 and JP-A-3-253857 are preferably used. A counter anion of the diazonium resin includes anions which form salts with the diazo resins and make the resin soluble in an organic solvent.

Examples of these anions include organic carboxylic acids such as decanoic acid and benzoic acid, organic phosphoric acids such as phenylphosphoric acid and sulfonic acids. Typical examples of the anion include, but are not particularly limited to, aliphatic or aromatic sulfonic acids such as methanesulfonic acid, fluoroalkanesulfonic acid such as trifluoromethanesulfonic acid, laurylsulfonic acid, dioctylsulfosuccinic acid, dicyclohexylsulfosuccinic acid, camphorsulfonic acid, tolyloxy-3-propanesulfonic acid, nonylphenoxy-3-propanesulfonic acid, nonylphenoxy-4-butanesulfonic acid, dibutylphenoxy-3-propanesulfonic acid, diamylphenoxy-3-propanesulfonic acid, dinonylphenoxy-3-propanesulfonic acid, dibutylphenoxy-4-butanesulfonic acid, dinonylphenoxy-4-butanesulfonic acid, benzenesulfonic acid, toluenesulfonic acid, mesitylenesulfonic acid, p-chlorobenzenesulfonic acid, 2,5-dichlorobenzenesulfonic acid, sulfosalicylic acid, 2,5-dimethylbenzenesulfonic acid, p-acetylbenzenesulfonic acid, 5-nitro-o-toluenesulfonic acid, 2-nitrobenzenesulfonic acid, 3-chlorobenzenesulfonic acid, 3-bromobenzenesulfonic acid, 2-chloro-5-nitrobenzenesulfonic acid, butylbenzenesulfonic acid, octylbenzenesulfonic acid, decylbenzenesulfonic acid, dodecylbenzenesulfonic acid, butoxybenzenesulfonic acid, dodecyloxybenzenesulfonic acid, 2-hydroxy-4-methoxybenzophenone-5-sulfonic acid, isopropylnaphthalenesulfonic acid, butylnaphthalenesulfonic acid, hexylnaphthalenesulfonic acid, octylnaphthalenesulfonic acid, butoxynaphthalenesulfonic acid, dodecyloxynaphthalenesulfonic acid, dibutylnaphthalenesulfonic acid, dioctylnaphthalenesulfonic acid, triisopropylnaphthalenesulfonic acid, tributylnaphthalenesulfonic acid, 1-naphthol-5-sulfonic acid, naphthalin-1-sulfonic acid, naphthalin-2-sulfonic acid, 1,8-dinitro-naphthalene-3,6-disulfonic acid and dimethyl-5-sulfoisophthalate, hydroxyl group-containing aromatic compounds such as 2,2',4,4'-tetrahydroxybenzophenone, 1,2,3-trihydroxybenzophenone and 2,2',4-trihydroxybenzophenone, halogenated Lewis acids such as hexafluorophosphoric acid and tetrafluoroboric acid and perhalogenic acids such as $HClO_4$ and $HIO_4$. Among these compounds, butylnaphthalenesulfonic acid, dibutylnaphthalenesulfonic acid, hexafluorophosphoric acid, 2-hydroxy-4-methoxybenzophenone-5-sulfonic acid and dodecylbenzenesulfonic acid are particularly preferable.

As to the diazo resin used in the present invention, its molecular weight may take any value by changing the mol ratio of each monomer and condensation conditions variously. However, diazo resins having a molecular weight of about 400 to 100,000 and preferably about 800 to 8,000 are desirable for effective use in the present invention.

As examples of the water-insoluble and lipophilic high molecular compound, copolymers having the monomers shown in the following (1) to (17) as structural units and a molecular weight of usually 10,000 to 200,000 are given.

(1) Acrylamides, methacrylamides, acrylates, methacrylates, hydroxystyrenes having an aromatic hydroxyl group, for example, N-(4-hydroxyphenyl)acrylamide or N-(4-hydroxyphenyl)methacrylamide, o-, m- or p-hydroxystyrene, o-, m- and p-hydroxyphenyl-acrylate or methacrylate.

(2) Acrylates and methacrylates having an aliphatic hydroxyl group, for example, 2-hydroxyethylacrylate or 2-hydroxyethylmethacrylate or 4-hydroxybutylmethacrylate.

(3) Unsaturated carboxylic acids such as acrylic acid, methacrylic acid, maleic acid anhydride and itaconic acid.

(4) (Substituted) alkylacrylates such as methylacrylate, ethylacrylate, propylacrylate, butylacrylate, amylacrylate, hexylacrylate, cyclohexylacrylate, octylacrylate, benzylacrylate, 2-chloroethylacrylate, glycidylacrylate and N-dimethylaminoethylacrylate.

(5) (Substituted) alkylmethacrylates such as methylmethacrylate, ethylmethacrylate, propylmethacrylate, butylmethacrylate, amylmethacrylate, cyclohexylmethacrylate, benzylmethacrylate, glycidylmethacrylate and N-dimethylaminoethylmethacrylate.

(6) Acrylamides or methacrylamides such as acrylamide, methacrylamide, N-methylolacrylamide, N-methylolmethacrylamide, N-ethylacrylamide, N-hexylmethacrylamide, N-cyclohexylacrylamide, N-hydroxyethylacrylamide, N-phenylacrylamide, N-nitrophenylacrylamide and N-ethyl-N-phenylacrylamide.

(7) Vinyl ethers such as ethyl vinyl ether, 2-chloroethyl vinyl ether, hydroxyethyl vinyl ether, propyl vinyl ether, butyl vinyl ether, octyl vinyl ether and phenyl vinyl ether.

(8) vinyl esters such as vinyl acetate, vinyl chloroacetate, vinyl butylate and vinyl benzoate.

(9) Styrenes such as styrene, α-methylstyrene and chloromethylstyrene.

(10) Vinyl ketones such as methyl vinyl ketone, ethyl vinyl ketone, propyl vinyl ketone and phenyl vinyl ketone.

(11) Olefins such as ethylene, propylene, isobutylene, butadiene and isoprene.

(12) N-vinylpyrrolidone, N-vinylcarbazole, 4-vinylpyridine, acrylonitrile, methacrylonitrile or the like.

(13) Unsaturated imides such as maleimide, N-acryloylacrylamide, N-acetylmethacrylamide, N-propionylmethacrylamide and N-(p-chlorobenzoyl) methacrylamide.

(14) Unsaturated sulfonamides including methacrylic acid amides such as N(o-aminosulphonylphenyl) methacrylamide, N-(m-aminosulfonylphenyl) methacrylamide, N-(p-amino)sulfonylphenylmethacrylamide, N-(1-(3-aminosulfonyl)naphthyl) methacrylamide and N-(2-aminosulfonylethyl) methacrylamide and acrylamides having the same substituents as above, and methacrylates such as o-aminosulfonylphenylmethacrylate, m-aminosulfonylphenylmethacrylate, p-aminosulfonylphenylmethacrylate and 1-(3-aminosulfonylnaphthyl)methacrylate and acrylates having the same substituents as above.

(15) Unsaturated monomers having a crosslinking group at the side chain such as N-(2-(methacryloyloxy)-ethyl)-2, 3-dimethylmaleimide and vinyl cinnamate. Further, a monomer which can copolymerize with the above monomer may be copolymerized.

(16) Phenol resins described in the specification of U.S. Pat. No. 3,751,257 and, for example, polyvinylacetal resins such as polyvinylformal resins and polyvinylbutyral resins.

(17) High molecular compounds obtained by solubilizing polyurethanes in an alkali as described in JP-B-54-19773, JP-A-57-904747, JP-A-60-182437, JP-A-62-58242, JP-A-62-123452, JP-A-62-123453, JP-A-63-113450 and JP-A-2-146042.

Also, a polyvinylbutyral resin, polyurethane resin, polyamide resin, epoxy resin, novolac resin or natural resin may be added to the above copolymers according to the need.

In the present invention, dyes may be further compounded in the light-sensitive composition used for the light-sensitive layer with the intention of obtaining a latent image by exposure and a visible image after developing. As to the dyes, triphenylmethane type, diphenylmethane type, oxazine type, xanthene type, iminonaphthoquinone type, azomethine type and anthraquinone type dyes, represented by Victoria Pure Blue BOH (manufactured by Hodogaya Chemical), Oil Blue #603 (manufactured by Orient Chemical), Patent Pure Blue (manufactured by Sumitomo Mikuni Chemical), Crystal Violet, Brilliant Green, Ethyl Violet, Methyl Violet, Methyl Green, Erythrocin B, Basic Fuchsine, Malachite Green, Oil Red, m-cresol purple, Rhodamine B, Auramine, 4-p-diethylaminophenyliminaphthoquinone and cyano-p-diethylaminophenylacetoanilide, are given as examples of discoloring agents which are changed from a colored state to a colorless state or a different tone.

On the other hand, examples of discoloring agents which are changed from a colorless state to a colored state include leuco dyes and primary or secondary arylamine type dyes represented by triphenylamine, diphenylamine, o-chloroaniline, 1,2,3-triphenylguanidine, naphthylamine, diaminodiphenylmethane, p,p'-bis-dimethylamino-diphenylamine, 1,2-dianilinoethylene, p,p',p"-tris-dimethylaminotriphenylmethane, p,p'-bis-dimethylaminodiphenylmethylimine, p,p',p"-triamino-o-methyltriphenylmethane, p,p'-bis-dimethylaminodiphenyl-4-anilinonaphthylmethane and p,p',P"-triamino-triphenylmethane. It is particularly preferable to use triphenylmethane type and diphenylmethane type dyes for effectiveness. Triphenylmethane type dyes are more preferable and Victoria Pure Blue BOH is particularly preferable.

Various additives may be further added to the light-sensitive composition used for the light-sensitive layer in the present invention. For example, alkyl ethers (e.g., ethyl cellulose or methyl cellulose), fluorine type surfactants and nonionic type surfactants (particularly, fluorine type surfactants are preferable) for improving applicability, plasticizers (e.g., butylphthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate and oligomers or polymers of acrylic acid or methacrylic acid, and among these compounds, particularly tricresyl phosphate is preferable) for imparting flexibility and wear resistance of a coating film, fat sensitizers (e.g., half esterification products using an alcohol of a styrene/maleic acid anhydride copolymer as described in JP-A-55-527, novolac resins such as p-t-butylphenol/formaldehyde resins and a 50% fatty acid ester of p-hydroxystyrene) for improving the fat sensibility of an image portion, stabilizers {e.g., phosphoric acid, phosphorus acid and organic acids (citric acid, oxalic acid, dipicolinic acid, benzenesulfonic acid, naphthalenesulfonic acid, sulfosalicylic acid, 4-methoxy-2-hydroxybenzophenone-5-sulfonic acid and tartaric acid)} and developing promoters (e.g., higher alcohols and acid anhydrides) are preferably used.

When the light-sensitive layer containing the above light-sensitive composition is formed on the support of the present invention, the light-sensitive diazo resin, lipophilic high molecular compound and, as required, various additives may be dissolved in a suitable solvent (e.g., methyl cellosolve, ethyl cellosolve, dimethoxyethane, diethylene glycol monomethyl ether, diethylene glycol dimethyl ether, 1-methoxy-2-propanol, methyl cellosolve acetate, acetone, methyl ethyl ketone, methanol, dimethylformamide, dimethylacetamide, cyclohexanone, dioxane, tetrahydrofuran, methyl lactate, ethyl lactate, ethylene dichloride, dimethylsulfoxide, water, or mixtures of these compounds) to prepare a coating solution of the light-sensitive composition, which is then applied to the support and dried. Although the solvent to be used may be used singly, mixtures of a high boiling point solvent such as methyl cellosolve, 1-methoxy-2-propanol or methyl lactate and a low boiling point solvent such as methanol or methyl ethyl ketone are more preferable.

The concentration of solids of the light-sensitive composition when the light-sensitive composition is applied to the support of the present invention is preferably in a range from 1 to 50 mass %. Here, the amount of the light-sensitive composition to be applied is of the order of 0.2 to 10 g/m$^2$ (dry mass) and more preferably 0.5 to 3 g/m$^2$.

Negative-Type Recording Material for an Infrared Laser

In the case of producing the planographic printing master plate of the present invention as a negative-type planographic printing master plate enabling exposure using an infrared laser, it is preferable to form the light-sensitive layer using an effective negative light-sensitive material for infrared laser use. As the negative light-sensitive material for infrared laser use, effective compositions contain (A) a compound which is decomposed by light or heat to generate an acid, (B) a crosslinking agent which is crosslinked by acid, (C) an alkali-soluble resin, (D) an infrared absorber and (E) a compound represented by the formula $(R^1—X)_n—Ar—(OH)_m$ {$R^1$: alkyl or alkenyl group having 6 to 32 carbon atoms, X: single bond, O, S, COO, or CONH, Ar: aromatic hydrocarbon group, aliphatic hydrocarbon group or heterocyclic group, n=1 to 3 and m=1 to 3}.

A negative-type planographic printing master plate has drawbacks in that it is easily soiled by a fingerprint after it has developed and the strength of an image portion is low. However, these drawbacks can be eliminated by forming the light-sensitive layer using the above structural components. The structural components of this negative-type planographic printing master plate will be hereinafter explained in detail.

As examples of the compound (A) which is decomposed by light or heat to generate an acid, compounds which are decomposed by light to generate a sulfonic acid and are represented by iminosulfonates and the like described in the specification of Japanese Patent Application No. 3-140109 are given and also compounds which generate an acid when irradiated with light having a wavelength of 200 to 500 nm or heated at 100° C. or more are given. As preferable acid-generating agents, a photo-cationic polymerization initiator, photo-radical polymerization initiator, photo-decolorant for decoloring dyes and photo-discoloring agent may be used. These acid-generating agents are respectively added in an amount of 0.01 to 50 mass % based on total solids of the image recording material.

As the crosslinking agent (B) which is crosslinked by an acid, (i) aromatic compounds substituted with an alkoxymethyl group or a hydroxyl group, (ii) compounds having an N-hydroxymethyl group, N-alkoxymethyl group or N-acyloxymethyl group and (iii) epoxy compounds are preferable.

As examples of the alkali-soluble resin (C), novolac resins and polymers having a hydroxyaryl group at the side chain are given.

Given as examples of components for the infrared absorber (D) are commercially available dyes such as azo dyes, anthraquinone dyes and phthalocyanine dyes which efficiently absorb infrared laser light having a wavelength of 760 to 1200 nm and black pigments, red pigments, metal powder pigments and phthalocyanine type pigments described in a Color Index. Also, an image coloring agent such as Oil Yellow or Oil Blue #603 may be added to improve the clearness of an image. Also, a plasticizer such as polyethylene glycol or a phthalate may be added to improve the flexibility of a coating film.

Positive-Type Recording Material for an Infrared Laser

In the case of producing the planographic printing master plate of the present invention as a positive-type planographic printing master plate enabling exposure using an infrared laser, it is preferable to form the light-sensitive layer using an effective positive light-sensitive material for an infrared laser. As the positive light-sensitive material for infrared laser use, an effective positive-type light sensitive material for infrared laser use contains (A) an alkali-soluble polymer, (B) a compound which is dissolved mutually in the alkali-soluble polymer to decrease alkali solubility and (C) an infrared absorbers.

The use of the above positive-type light-sensitive material for infrared laser use ensures that a deficiency of a non-image portion with respect to solubility in an alkaline developing agent can be remedied and a planographic printing plate which is resistant to damage and has good anti-alkali developing aptitude and developing stability can be formed.

As the alkali-soluble polymer (A), (i) a polymer compound having a phenolic hydroxyl group, represented by a phenol resin, cresol resin, novolac resin and pyrogallol resin, (ii) a compound obtained by polymerizing a polymerizable monomer having a sulfonamide group singly or by copolymerizing the above monomer with another polymerizable monomer and (iii) a compound having an active imide group represented by N-(p-toluenesulfonyl)methacrylamide or N-(p-toluenesulfonyl)acrylamide in its molecule are preferable.

As examples of the compound (B), compounds, such as sulfone compounds, ammonium salts, sulfonium salts and amide compounds, which interact with the above component (A) are given. For example, if component (A) is a novolac resin, a cyanine dye is preferable as component (B).

As component (C), materials which have an absorption region in the infrared region with a wavelength of 750 to 1200 nm and also have a light/heat conversion function are preferable. Examples of the materials having such a function include squarylium dyes, pyrylium salt dyes, carbon black, insoluble azo dyes and anthraquinone type dyes. It is preferable that these pigments respectively have sizes in the range from 0.01 $\mu$m to 10 $\mu$m. The dye is added, dissolved using methanol or methyl ethyl ketone as an organic solvent and applied to an aluminum plate such that the mass after drying is 1 to 3 g/m$^2$, followed by drying to prepare a dye layer.

Photopolymerization Type Photo-Polymer Recording Material for a Laser

As examples of light-sensitive layer materials which are useful when a negative-type planographic printing master plate enabling exposure using an infrared laser is produced and can be exposed by the laser, photopolymerization type photo-polymer light-sensitive materials are given.

When a photopolymerization type photo-polymer type light-sensitive material is used, an adhesive layer containing a silicone compound having a functional group as described in JP-A-3-56177 and JP-A-8-320551 is preferably formed on the support, to improve the adhesion between the support of the present invention and the light-sensitive layer, before the light-sensitive layer is applied. Specifically, a silane compound such as ethylenetetramethoxysilane or ethylenetetraethoxysilane is dissolved in a solvent such as methanol or ethanol in a proportion of 1 to 20 mass % and hydrolyzed in the presence of an acid catalyst such as hydrochloric acid, nitric acid, phosphoric acid or sulfonic acid. Then, a —Si—O—Si— bond is formed to make a sol, which can be then formed as an adhesive layer on the support of the present invention.

At this time, it is preferable that the above silane compound be dissolved in an appropriate solvent such as methanol to control the viscosity to within a range of 0.2 mPa.s (0.2 cp) to 2000 mPa.s (20 cp) so that the coating mass after drying is 1 to 100 mg/m$^2$.

A light-sensitive layer having a polymerizable compound (compound having a terminal ethylenic photopolymerizable group) having an addition polymerizable unsaturated bond which is a photopolymerization type photo-polymer light-sensitive material can be formed on the surface of the aforementioned adhesive layer. The light-sensitive layer may contain a photoinitiator, organic high molecular binder, coloring agent, plasticizer and thermal polymerization inhibitor.

Examples of the compound having a terminal ethylenic unsaturated bond include esters (e.g., acrylates, methacrylates, itaconates and maleates) of an unsaturated carboxylic acid and an aliphatic polyhydric alcohol compound, and amides (e.g., methylenebisacrylamides and xylylenebisacrylamides) of an unsaturated carboxylic acid and an aliphatic polyvalent amine compound.

As the photoinitiator, titanocene compounds and sensitizers including triazine types, benzophenone types and benzoimidazole types may be used. Also, sensitizers such as cyanine dyes, merocyanine dyes, xanthene dyes and cumarin dyes may be used.

A negative-type planographic printing master plate enabling exposure using an infrared laser can be manufactured by forming a light-sensitive layer produced by applying the light-sensitive composition having such components to the surface of the support of the present invention in a coating amount of 1 to 3 g/m$^2$.

Photo-Crosslinking Type Photo-Polymer Type Recording Material for a Laser

Also, a photo-crosslinking type photo-polymer may be used for the above material for a light-sensitive layer.

As the photo-crosslinking type photo-polymer, for example, polyester compounds as disclosed in JP-A-52-96696 and polyvinyl cinnamate type resins as described in the specification of U.K. Patent No. 1,112,277 are preferable and those having a maleimide group at the side chain as described in JP-A-62-78544 are more preferable.

Sulfonate Type Recording Material for an Infrared Laser

Moreover, a sulfonate type recording material for an infrared laser may be used as the material for the light-sensitive layer.

As the sulfonate type recording material for an infrared laser, for example, sulfonate compounds as described in registered U.S. Pat. No. 270,480 and registered U.S. Pat. No. 2,704,872 may be used. Also, light-sensitive materials which generate sulfonic acid by heat generated by irradiation with an infrared laser so as to become soluble in water, light-sensitive materials which are produced by solidifying styrene sulfonate by a sol-gel and are thereafter changed in surface polarity by irradiation with an infrared laser, and light-sensitive materials having the characteristic that a hydrophobic surface is made hydrophilic by laser exposure as described in the specification of JP-A-9-89816, the specification of JP-A-10-22406 and the specification of JP-A-10-027655 may be used.

In order to further improve the characteristics of the light-sensitive layer comprising a high molecular compound capable of generating a sulfonic acid group by heat, it is preferable to use a combination of the methods given below. Specifically, examples of such methods may include (1) a method using an acid or base generating agent together as described in the specification of JP-A-10-7062, (2) a method in which a specific intermediate layer is formed as described in the specification of JP-A-9-340358, (3) a method using a specific crosslinking agent together as described in the specification of JP-A-9-248994, (4) a method in which a specific layer structure is formed as described in the specification of JP-A-10-43921 and (5) a method in which a light-sensitive layer with a structure in which the surface of a solid particle is modified as described in the specification of JP-A-10-11535.

Other examples of the composition which changes the hydrophilicity/hydrophobicity of the light-sensitive layer by making use of the heat generated by laser exposure include compositions which include a Werner complex and are made hydrophobic by heat as described in the specification of U.S. Pat. No. 2,764,085, specific saccharides as described in JP-A-46-27219, compositions, such as melamine formaldehyde resins, which are made hydrophilic by exposure, compositions which are made hydrophobic by heat mode exposure as described in JP-B-51-63704, compositions comprising a polymer, such as a phthalylhydrazide polymer, which is dehydrated and made to be hydrophobic by heat as described in the specification of U.S. Pat. No. 4,081,572, compositions which have a tetrazolium salt structure and are made hydrophilic by heat as described in JP-B-3-58100, compositions which include a sulfonic acid modified polymer and are made hydrophobic by exposure, compositions which include an imide precursor polymer and are made hydrophobic by exposure as described in JP-A-64-3543 and compositions which include a carbon fluoride polymer and are made hydrophilic by exposure as described in the specification of JP-A-51-74706.

Further examples of the composition include compositions which include a hydrophobic crystalline polymer and are made hydrophilic by exposure as described in JP-A-3-197190, compositions which include a polymer whose insolubilized side chain is changed to a hydrophilic one by heat and a light-heat converting agent, as described in JP-A-7-186562, compositions which include a hydrophilic binder containing microcapsules, are crosslinked three-dimensionally and are made hydrophobic by exposure as described in JP-A-7-1849, compositions which are isomerized in atomic valence or proton transfer as described in JP-A-8-3463, compositions which are changed in phase structure in the layer (made to be mutually soluble) by heat to change the hydrophilicity/hydrophobicity as described in JP-A-8-141819 and compositions which are changed in the structure of the surface and in the hydrophilicity/hydrophobicity by heat as described in JP-A-60-228.

Other preferable examples of the light-sensitive layer material may include compositions which change adhesion between the light-sensitive layer and the support by the so-called heat mode exposure utilizing the heat generated by high power, high density laser light. Specifically, compositions comprising a thermally fusible and thermally reactive material as described in JP-B-44-22957 may be used.

Electrophotographic Light-Sensitive Resin Type Recording Material for a Laser

Also, as the light-sensitive layer of the planographic printing master plate of the present invention, for example, a ZnO light-sensitive layer as disclosed in the specification of U.S. Pat. No. 3,001,872 may be formed, and also, a light-sensitive layer using an electrophotographic light-sensitive resin as described in each of JP-A-56-161550, JP-A-60-186847 and JP-A-61-238063 may be formed. The coating amount of the light-sensitive layer to be disposed on the support of the present invention is about 0.1 to 7 g/m$^2$ and preferably 0.5 to 4 g/m$^2$ as dry mass after application.

The basic patent concerning the electrophotographic method is disclosed in JP-B-37-17162. Besides this method, the methods disclosed in JP-B-56-107246 and JP-B-59-36259 may be used. Although the aforementioned electrophotographic light-sensitive resin primarily comprises a photoconductive compound and a binder, known pigments, dyes, chemical sensitizers and other necessary additives may be used for the purpose of improving sensitivity and obtaining a desired light-sensitive wavelength.

The planographic printing master plate in the present invention may be provided with an intermediate layer according to the need for the purposes of heightening the adhesion between the support of the present invention and the light-sensitive layer and preventing the light-sensitive layer from remaining after development, or preventing halation. In order to improve the adhesion, it is generally preferable to use a diazo resin and a phosphoric acid compound, amino compound and carboxylic acid compound which adsorb to, for example, aluminum. In order to prevent the light-sensitive layer from remaining after development, it is preferable to dispose the intermediate layer using a highly soluble material. Hence, the use of a highly soluble polymer or water-soluble polymer is preferred. In order to prevent halation, the intermediate layer preferably includes dyes and UV absorbers.

The thickness of the intermediate layer is optional except that it must be enough to enable a uniform coupling reaction with the light-sensitive layer thereabove when exposed. Generally, the proportion of the coating is preferably about 1 to 100 mg/m$^2$ and more preferably 5 to 40 mg/m$^2$ as dry solids.

Also, a matt layer structured by projections formed independently of each other may be disposed. The object in disposing the matt layer is to improve vacuum adhesiveness between a negative image film and the light-sensitive planographic printing plate in contact exposure, thereby shortening vacuuming time and preventing fine shading dots from being lost due to adhesion failures during exposure.

Examples of a method of applying the matt layer include a method in which a solid powder treated by powdering is thermally fused as described in JP-A-55-12974 and a method in which polymer-containing water is sprayed and dried as described in JP-A-58-182636. Although an appropriate method may be selected from these methods, a method in which the matt layer itself is dissolved in an aqueous alkaline developing solution containing substantially no organic solvent and a method in which the matt layer can be removed by the same solution are preferable.

Planographic Printing Plate

The planographic printing master plate provided with the light-sensitive layer on the support of the present invention is exposed using an infrared laser or the like and developed using an alkaline developing solution to obtain a planographic printing plate. As a light source to be used for the exposure, an infrared laser having a wavelength of 700 to 1200 nm may be used. In the plate-making and printing fields in recent years, an automatic developing machine for printing plates has been widely used for rationalization and standardization of plate-making works. In the method of the present invention, this automatic developing machine is preferably used.

For development of the exposed planographic printing master plate of the present invention, a developing solution containing an alkali silicate such as sodium silicate or potassium silicate as its major component, as described in JP-A-54-62004, or a developing solution which has neither a free aldehyde group nor a ketone group, but contains, as its major component, a non-reducing sugar such as saccharose or trehalose which shows no reducibility, as described in JP-A-8-305039, may be used.

Further, an alkali agent such as potassium hydroxide, a developing stabilizer such as a polyethylene glycol adduct of sugar alcohol as disclosed in JP-A-6-282079, a reducing agent such as hydroquinone, a water softener such as ethylenediamine, a nonionic, anionic or amphoteric surfactant and a polyoxyethylene/polyoxypropylene block polymerization type surfactant as disclosed in JP-B-3-54339 may be added to the developing solution.

In the case of the alkali silicate, the mol ratio of $SiO_2/M_2O$ (M represents an alkali metal) is preferably in a range from 0.3 to 3.0. Si can be stuck to the surface by a developing treatment using this compound. Also, the amount of Si element present on the surface can be measured by ESCA. Moreover, the amount of each of C, Al, O, S, Si and Ca is measured to calculate the ratio (atom. %) of each element.

The amount of Si is preferably 1 to 25 atom. % and particularly 5 to 20 atom. %. If the amount of Si is in this range, this is effective to prevent halation when infrared laser light is applied.

On the other hand, in the case of the developing solution containing nonreducing sugar, it is necessary to make the surface of the aluminum support hydrophilic in advance by, for example, a silicate treatment. In this case, the amount of Si stuck to the surface after developing is preferably 1 to 25 atom. %. In the case of using this developing solution, developing is preferably carried out using an automatic developing machine. In this case, the developing process can be continued stably for a long period of time by adding a replenishing solution having a higher alkali strength than the developing solution to the developing solution. An anionic type or other type surfactant may be added to this replenishing solution to improve dispersion of developing residues and affinity of a print image portion to ink. Moreover, an antifoaming agent and a water softener may be added according to the need.

The surface of the planographic printing master plate which is developed is preferably after-treated using a rinsing solution containing a surfactant or a fat-insensitizing solution containing gum arabic or a starch derivative. When an aqueous solution containing gum arabic or a starch derivative in an amount of 5 to 15 mass % as solid concentration is used, the surface after development is protected with the wet amount of this coating being 1 to 10 $ml/m^2$. The amount of the coating after dried is preferably 1 to 5 $g/m^2$.

When higher printing durability is required, it is preferable to perform a burning treatment as described in JP-B-61-2518. As a coating method, a method in which a surface regulating solution is applied to the surface of the printing plate by using sponge or absorbent cotton as disclosed in JP-B-55-28062 and a method of applying using an automatic coater are exemplified. When the surface regulating solution is used, it is appropriate to apply the solution in an amount of 0.3 to 0.8 $g/m^2$ (dry mass) in general.

As aforementioned, after the planographic printing master plate of the present invention is exposed to an image, it is subjected to treatments including developing treatment to form a resin image, whereby a planographic printing plate is obtained. In the case of, for example, the light-sensitive planographic printing master plate having the aforementioned light-sensitive layer [I], after image exposure it is developed using an aqueous alkali solution as described in the specification of U.S. Pat. No. 4,259,434 and the exposed portion is thereby removed to obtain the planographic printing plate. In the case of the light-sensitive planographic printing master plate having the aforementioned light-sensitive layer [II], after image exposure it is developed using a developing solution as described in the specification of U.S. Pat. No. 4,186,006 and the light-sensitive layer of the unexposed portion is removed by the development to obtain the planographic printing plate. Also, a composition of an aqueous alkali developing solution which is used when a positive-type planographic printing master plate is developed as described in JP-A-59-84241, JP-A-57-192952 and JP-A-62-24263 may be used.

Next, the above-mentioned fourth aspect (planographic printing plate-use aluminum support) of the present invention will be explained in detail.

The planographic printing plate-use aluminum support according to the present invention is produced by providing an aluminum alloy plate having an aluminum content of 95 to 99.4 mass % with at least a surface-roughening treatment and an anodic oxidation treatment. At least one type among an Al recycled metal and a scrap material is preferably contained in the raw material of the aluminum alloy plate in an amount of 1 mass % or more. As the scrap material, used beverage cans (UBC) and the like are desirable. The use of this recycled metal and scrap material enables the raw material costs to be further decreased. The above surface-roughening treatment preferably involves at least an alkali etching step, an electrolytic surface roughening step and a desmutting step, and the desmutting step preferably involves at least an alkali treatment step and an acid treatment step using an acid.

The planographic printing plate-use aluminum support according to the present invention will be hereinafter explained in detail with reference to a process for the production of the support.

(Process for the Production of a Planographic Printing Plate-use Aluminum Support)

The planographic printing plate-use aluminum support according to the present invention is produced by preparing, for example, an aluminum alloy plate web (hereinafter referred to as "aluminum band body") made of an aluminum alloy and by subjecting the plate to at least the surface-roughening treatment and the anodic oxidation treatment. Concretely, the surface-roughening treatment preferably involves at least (1) a mechanical surface-roughening step and an alkali etching step, (2) an electrolytic surface-roughening step and (3) a desmutting step. After the surface-roughening treatment is finished, (4) the anodic oxidation treatment (anodic oxidation step) is performed whereby the planographic printing plate-use aluminum support is finally produced. As to the surface-roughening treatment in the steps (1) and (2), both the mechanical surface-roughening treatment and the electrolytic surface-roughening treatment may be carried out or either one may be carried out.

In actuality, the aluminum raw material is cast using a usual method and the cast material is rolled and heat-treated appropriately to prepare an aluminum alloy plate having a thickness of 0.1 to 0.7 mm. The flatness of the plate is remedied as required to obtain an aluminum alloy plate for a planographic printing plate, which is then made into an aluminum band body. This aluminum band body is continuously treated in the aforementioned steps (1) to (4) and then taken up coilwise to produce the planographic printing plate-use aluminum support.

Here, as the aluminum alloy which may be used in the process of producing the planographic printing plate-use aluminum support according to the present invention, rather than an aluminum ingot called virgin metal, which has a purity of 99.7% or more, aluminum ingots having low purity, such as scrap aluminum material, secondary metal and recycled metals may be exemplified. The use of the low purity aluminum ingot as the raw material makes it possible to produce the planographic printing plate-use aluminum support at a lower cost than in the case of using conventional methods.

In a preferable process for the production of the aluminum support for a planographic printing plate according to the present invention, an aluminum alloy plate having an aluminum content (purity) of 95 to 99.4 mass % is used. If the purity is higher than 99.4 mass %, the tolerance of impurities will be decreased, leading to a reduction in cost reducing effects. If the purity is lower than 95 mass %, many impurities are contained resultantly, causing defects such as cracks during rolling. The purity of the aluminum is more preferably 95 to 99 mass % and still more preferably 95 to 97 mass %.

At least Si and Mn are contained in a total amount of, preferably 0.5 mass % or more and more preferably 0.8 to 2.0 mass %. If the total amount of Si and Mn is less than 0.5 mass %, the cost reducing effect may not be produced. It is also preferable that Cu be contained in an amount of at least 0.05 mass % or more and desirably 0.1 mass % or more. If the amount of Cu is less than 0.05 mass %, cost reducing effects will be decreased and in addition, non-uniform electrolytic roughening results caused by much Mn contained in the scrap material and there will be cases where the generation of abnormal coarse pebbles cannot be limited.

Here, an abnormal coarse pebble means a pebble made coarse, resulting from the abnormal growth horizontal of one generated electrolytic pit.

The content of Si is preferably 0.15 to 1.0 mass %. Si is often contained in scraps of JIS 2000 type, 4000 type and 6000 type materials. Si is also contained in virgin metal in an amount around 0.03 to 0.1 mass % and exists in Al in a state of solid solution or as intermetallic compounds. When the raw material is heated in the process of the production of the support for a planographic printing plate, Si which has been melted as a solid solution precipitates occasionally as simple Si. If the content of Si is less than 0.15 mass %, cost reducing effects will be decreased. The content of Si is more preferably 0.3 to 1.0 mass %.

The content of Mn is preferably 0.1 to 1.5 mass %. Mn is often contained in scraps of JIS 3000 type materials. Mn is often contained in, particularly, can body materials and is therefore a major impurity metal in scraps. Mn is also relatively easily melted as a solid solution in aluminum and combined with AlFeSi to form intermetallic compounds. If the content of Mn is less than 0.1 mass %, cost reducing effects will be decreased. The content of Mn is more preferably 0.5 to 1.5 mass % and still more preferably 1.0 to 1.5 mass %.

The content of Cu is preferably 0.05 to 1.0 mass %. Cu is often contained in scraps of JIS 2000 type and 4000 type materials. Cu is relatively easily melted as a solid solution in aluminum. If the amount of Cu is small, abnormal electrolytic roughening caused by Mn may be unlimitable and, in addition, strict selection of raw material scraps will inevitably be required and therefore cost reducing effects owing to the use of scraps will be decreased. Hence, an excessively small amount of Cu is undesirable. If the content of Cu is less than 0.05 mass %, cost reducing effects will occasionally be decreased. The content of Cu is more preferably 0.08 to 1.0 mass % and particularly preferably 0.12 to 1.0 mass %.

As other metals, at least three or more metals among Fe, Mg, Zn, Cr and Ti are preferably contained in the aluminum alloy.

The content of Fe is preferably 0.3 to 1.0 mass %. Fe is contained even in virgin metal in an amount around 0.1 to 0.2 mass %. Fe is scarcely melted in aluminum as a solid solution and is almost entirely left as intermetallic compounds. If the content of Fe exceeds 1.0 mass %, cracks will tend to be caused in the course of a rolling operation, and if the content of Fe is less than 0.3 mass %, the effect of reducing costs will be decreased and therefore such amounts out of the defined range are undesirable. The content of Fe is more preferably 0.5 to 1.0 mass %.

The content of Mg is preferably 0.1 to 1.5 mass %. Mg is often contained in scraps of JIS 2000 type, 3000 type, 5000 type and 7000 type materials. Mg is often contained in, particularly, can end materials and is therefore a major impurity metal in scraps. Mg is also relatively easily melted as a solid solution in aluminum and combined with Si to form intermetallic compounds. If the content of Mg is less than 0.1 mass %, cost reducing effects will be decreased. The content of Mg is more preferably 0.5 to 1.5 mass % and still more preferably 1.0 to 1.5 mass %.

The content of Zn is preferably 0.03 to 0.5 mass %. Zn is often contained in scraps of JIS 7000 type materials. Zn is relatively easily melted as a solid solution in aluminum. If the content of Zn exceeds 0.1 mass %, cost reducing effects will be decreased. The content of Zn is more preferably 0.06 to 0.5 mass % and particularly preferably 0.1 to 0.5 mass %.

The content of Cr is preferably 0.01 to 0.1 mass %. Cr is contained a little in scraps of JIS 5000 type, 6000 type and 7000 type materials. If the content of Cr is less than 0.01 mass %, cost reducing effects will be decreased. The content of Cr is more preferably 0.05 to 0.1 mass %.

The content of Ti is preferably 0.03 to 0.5 mass %. Ti is usually added as a crystal fining material in an amount of 0.01 to 0.04 mass %. Ti is contained in a relatively large amount in scraps of JIS 5000 type, 6000 type and 7000 type materials. If the content of Ti is less than 0.03 mass %, cost reducing effects will be decreased. The content of Ti is more preferably 0.05 to 0.3 mass %.

Each step in the process for the production of the planographic printing plate-use aluminum support according to the present invention will be hereinafter explained step by step. However, the following steps are examples and the present invention is not limited by the content of the following steps.

1. Mechanical Surface-roughening Step and Alkali Etching Step

First, the mechanical surface-roughening treatment of the aluminum band body is carried out by brush grains using a Pamiston suspension (mechanical surface-roughening step). After that, the aluminum band body is processed to smooth irregularities of the surface thereof and subjected to alkali etching treatment using an aqueous alkaline agent to remove an abradant left on the surface (alkali etching step). As the alkaline agent used for the alkali etching treatment, caustic soda, caustic potash, sodium methasilicate, sodium carbonate, sodium aluminate and sodium gluconate are preferable. The concentration of the alkaline agent in the aqueous solution is preferably 0.01 to 30 mass %. Treating temperature is preferably designed to be 60 to 80° C. to improve productivity. The quantity of the aluminum band body to be etched is preferably 0.1 to 15 g/m$^2$. Treating time is in a range preferably from 2 seconds to 5 minutes corresponding to the quantity of etching and more preferably from 2 to 10 seconds to improve productivity.

It is to be noted that the step of the mechanical surface-roughening treatment is optional and an electrolytic surface-roughening treatment may be carried out directly on the aluminum band body after alkali etching is performed without performing such mechanical surface-roughening treatment, and then subsequent treatments may be performed. Also, after the alkali etching treatment, a desmutting treatment (nitric acid treatment) may be carried out to remove smuts formed on the surface of the aluminum band body.

2. Electrolytic Surface-roughening Step

In recent production processes of producing a planographic printing plate-use aluminum support from an aluminum band body, electrolytic surface-roughening treatments for the aluminum band body have been mostly carried out using an electrolyte primarily containing hydrochloric acid or nitric acid to improve adhesion between the light-sensitive layer in an image portion formed in the planographic printing plate and the surface of the aluminum band body and to improve water retentivity in a non-image portion. This electrolytic surface-roughening treatment may be carried out on the surface of the aluminum band body in succession to the mechanical surface-roughening treatment using brush grains or the like, or carried out directly after the surface of the aluminum bond body is pretreated by, for example, alkali washing.

The electrolytic surface-roughening treatment for the aluminum band body is performed by carrying out etching using a.c. current as electrolytic current in an electrolyte primarily containing hydrochloric acid or nitric acid. The frequency of the a.c. electrolytic current is designed to be in a range preferably from 0.1 to 100 Hz and more preferably from 10 to 60 Hz. As to the electrolyte, the concentration of the solution is preferably 3 to 150 g/l and more preferably 5 to 50 g/l in both the case of using hydrochloric acid and the case of using nitric acid.

The amount of aluminum to be dissolved in an electrolytic cell is preferably 50 g/l or less and more preferably 2 to 20 g/l. Various additives may be compounded in the electrolyte as required. However, such additives make it difficult to control the concentration of the electrolyte and therefore appropriate additives must be selected.

Also, the density of current is preferably 5 to 100 A/dm$^2$ and more preferably 10 to 80 A/dm$^2$. The waveform of electrolytic current is appropriately selected according to the quality to be required and the components of the aluminum band body to be used and it is preferable to use a specific a.c. waveform as disclosed in JP-B-56-19280 or JP-B-55-19191. Such a waveform of electrolytic current and conditions of the electrolyte are appropriately selected corresponding to the quantity of electricity to be supplied per unit area of the aluminum band body, required qualities, the components of the aluminum band body and the like.

Moreover, an important factor in alternating current electrolysis is duty ratio. Referring to the labels in FIG. 1, the duty ratio is defined as ta/(ta+tc). The duty ratio is preferably from 0.25 to 0.5, more preferably from 0.3 to 0.5 and particularly preferably from 0.3 to 0.4.

3. Desmutting Step

Smuts and intermetallic compounds exist on the surface of the aluminum band body which is electrolytically surface-roughened as aforementioned. Here, to remove only the smuts, an at least two-stage desmutting treatment (desmutting step) in which an alkali treatment (alkali treatment step) using an alkaline solution and then an acid treatment using a low temperature acidic solution are performed.

First, as the alkali treatment, the aluminum band body is treated using the alkaline solution to dissolve the smuts. Although there are various types, such as caustic soda, as the alkaline solution, it is preferable to treat the aluminum band body using an alkaline solution having a pH of 10 or more at a solution temperature of 25 to 80° C. At this time, the solution temperature of the alkaline solution is designed to be 60 to 80° C. in view of improving productivity. By setting the solution temperature to 60 to 80° C., the alkali treatment for the aluminum band body can be accomplished in an extremely short time, such as 1 to 10 seconds. For the alkali treatment using the alkaline solution, a dipping system, a shower method, a method in which the alkali solution is applied to the aluminum band body or the like may be adopted.

Next, the aluminum band body is acid-treated using an acidic solution (acid treatment step). As the acidic solution, solutions primarily containing sulfuric acid are desirable. As the treating system, the system described in Japanese Patent Application No. 2000-123805 is preferably used. The concentration of the solution (acid concentration) is preferably 100 to 200 g/l. If the acid concentration is less than 100 g/l, the effect of removing smuts will be decreased. On the other hand, if the acid concentration is higher than 200 g/l, intermetallic compounds will start to be removed, leading to a reduction in the adhesion between the light-sensitive layer and the aluminum alloy plate, and therefore such a concentration is undesirable. The acid concentration is more preferably 120 to 190 g/l.

The solution temperature of the acidic solution is preferably 20 to 50° C. If the solution temperature is less than 20° C., a cooler for temperature control will be required and therefore such a temperature is undesirable in view of system costs. If the solution temperature is higher than 50° C., removal of the intermetallic compounds will be promoted, leading to a reduction in the adhesion between the light-sensitive layer and the aluminum alloy plate, and therefore such a concentration is undesirable. For the acid treatment using an acidic solution, a dipping system, a shower method or a method in which the solution is applied to the aluminum band body may be adopted in general. The above desmutting treatment ensures that smuts can be removed and an area density (existential ratio) of intermetallic compounds having a diameter (particle diameter) of 0.1 $\mu$m or more on the planographic printing plate-use aluminum support can be 5000 to 35000/mm$^2$ in number.

4. Anodic Oxidation Step

The anodic oxidation treatment (anodic oxidation step) is performed for the aluminum band body which has been processed by the desmutting treatment using an alkaline solution and an acidic solution as aforementioned. An anodic oxide film is formed on the surface layer portion by this treatment. The amount of the anodic oxide film to be formed is preferably 0.1 to 10 g/m$^2$ and more preferably 0.3 to 5 g/m$^2$. Other conditions in the anodic oxidation treatment are not determined for all cases because each set value must be changed in accordance with the type of electrolyte (e.g., sulfuric acid, phosphoric acid, oxalic acid and chromic acid) to be used. In general, preferably the concentration (acid concentration) of the electrolyte is 1 to 80 mass %, the temperature of the solution is 5 to 70° C., the density of current is 0.5 to 60 A/dm$^2$, the voltage is 1 to 100 V and the electrolytic time is 1 second to 5 minutes.

The aluminum band body processed by the above steps is rolled as a coil, and thus a planographic printing plate-use aluminum support is produced.

According to the process for the production of a planographic printing plate-use aluminum support as aforementioned, a predetermined alkali treatment and acid treatment are carried out in order as the desmutting treatment prior to the anodic oxidation treatment. This ensures that harmful smuts can be removed from the surface of the aluminum band body and a fixed amount of intermetallic compounds is made to remain so that the surface of the aluminum band body can be roughened moderately. Therefore, the generation of defects of an anodic oxide film caused by smuts can be suppressed in the subsequent anodic oxidation treatment and the adhesion between the light-sensitive layer and the planographic printing plate-use aluminum support can be improved when the light-sensitive layer is further formed to prepare the planographic printing plate-use aluminum support.

The anodic oxide film formed on the aluminum band body itself is stable and has high hydrophilicity. Therefore, the light sensitive layer can be formed by applying a light-sensitive material directly to the surface of the anodic oxide film and a surface treatment may be carried out as required. The surface treatment includes, for example, provision of a silicate layer comprising an alkali metal silicate and an undercoat layer comprising a hydrophilic high molecular compound and the like on the surface of the aluminum band body. At this time, the amount of the undercoat layer to be applied is preferably 1 to 150 mg/m$^2$.

The light-sensitive layer is formed on the planographic printing plate-use aluminum support, formed with the undercoat layer as required in this manner, to manufacture the planographic printing master plate. Also, the matt layer may be formed by application after the light-sensitive layer is formed by application and dried.

The planographic master plate obtained in the above manner is made into a planographic printing plate through steps such as an image exposure step and a developing step and the resulting planographic printing plate is set in a printer.

According to the production process as aforementioned, a planographic printing plate-use aluminum support can be produced from low purity aluminum raw materials such as aluminum scrap materials without strictly controlling the alloy composition of the aluminum raw material that is the starting material or the process steps. When a planographic printing master plate and a planographic printing plate are manufactured using such a planographic printing plate-use aluminum support and used, high adhesion between the light-sensitive layer and the aluminum alloy plate during printing can be obtained and printing durability can be improved.

(Planographic Printing Plate-use Aluminum Support)

The planographic printing plate-use aluminum support according to the present invention is preferably produced by a production process as described above. It is preferable that intermetallic compounds having a diameter (particle diameter) of 0.1 $\mu$m or more exist in an amount of 5000 to 35000/mm$^2$ on a portion of the roughened surface of the planographic printing plate-use aluminum support. The intermetallic compounds act as spikes and therefore the adhesion is improved, resulting in high printing durability.

If the area density of intermetallic compounds is less than 5000/mm$^2$, effects as aforementioned may be obtained insufficiently, and if the area density is greater than 35000/mm$^2$, defects of the anodic oxide film will tend to occur, and therefore area densities out of the above range are undesirable. The area density of intermetallic compounds is more preferably 10000 to 30000/mm$^2$. Also, the diameters (particle diameters) of the intermetallic compounds are preferably 0.1 $\mu$m or more and more preferably 0.2 to 2.0 $\mu$m. If the diameters (particle diameters) of the intermetallic compounds are less than 0.1 $\mu$m, the adhesion to the light-sensitive layer disposed on the surface of the planographic printing plate-use aluminum support will be inferior.

The diameter (particle diameter) and existential ratio of the intermetallic compound can be regulated by appropriately changing the conditions in the production of the planographic printing plate-use aluminum support. For example, treating temperature, the acid concentration of sulfuric acid and the like in the acid treatment step involved in the desmutting step may be reduced to lower the ability of the acid to remove the intermetallic compounds, thus appropriately changing these respective conditions within predetermined ranges.

Also, the area density of the intermetallic compounds can be easily calculated by observing the roughened surface with an SEM (scanning electron microscope) or the like and counting the number of intermetallic compounds at, for example, 5 places (n=5) having an area of 60 $\mu$m×50 $\mu$m, the counted number being converted into a number per 1 mm$^2$.

EXAMPLES

The present invention will be hereinafter explained in detail by way of examples, which, however, are not intended to be limiting of the present invention.

Examples A1 to A5 and Comparative Examples A1 to A3

Aluminum plates to be used in Examples according to the present invention and Comparative Examples were produced from five aluminum alloy molten baths having alloy components of compositions A to E shown in Table 1 respectively. These aluminum plates were produced in the following manner. First, each aluminum alloy molten bath was subjected to a molten bath treatment including degassing and filtration to prepare a 500-mm-thick ingot by the DC casting method. After the surface of the ingot was surface-cut by 10 mm, the ingot was heated to start hot-rolling at 400° C. without performing a soaking treatment and rolled to a plate thickness of 4 mm. Then, the plate was cold-rolled to a plate thickness of 1.5 mm, followed by intermediate annealing and then cold-rolled again to a finished thickness of 0.24 mm. After the flatness of the plate was remedied, the aluminum plates to be used for Examples according to the present invention and Comparative Examples were produced.

With regard to the compositions A to D, the purity of Al and the content of each of all impurity elements are respectively within a predetermined range and within a range preferable in the present invention. The composition E is a composition in which the purity of Al and the content of each of 5 impurity elements, Fe, Si, Mn, Mg and Zn are respectively within a predetermined range and within a range preferable in the present invention.

TABLE 1

| | Fe | Si | Cu | Ti | Mn | Mg | Zn | Cr | Others total | Al |
|---|---|---|---|---|---|---|---|---|---|---|
| Composition A | 0.70 | 0.50 | 0.50 | 0.10 | 1.40 | 1.40 | 0.10 | 0.05 | 0.01 | 95.24 |
| Composition B | 0.30 | 0.15 | 0.10 | 0.03 | 0.10 | 0.10 | 0.10 | 0.01 | 0.01 | 99.10 |
| Composition C | 0.50 | 0.30 | 0.30 | 0.05 | 0.50 | 0.50 | 0.30 | 0.05 | 0.01 | 97.49 |

TABLE 1-continued

| | Fe | Si | Cu | Ti | Mn | Mg | Zn | Cr | Others total | Al |
|---|---|---|---|---|---|---|---|---|---|---|
| Composition D | 0.50 | 0.30 | 0.30 | 0.05 | 1.00 | 1.00 | 0.30 | 0.05 | 0.01 | 96.49 |
| Composition E | 0.70 | 0.50 | 0.05 | 0.02 | 1.30 | 1.45 | 0.40 | 0.005 | 0.01 | 95.57 |

Note:
Because the above values are rounded off to a significant figure, sums of the metal contents may not be exactly 100%.

Using the aluminum plates having the compositions shown in Table 1, a surface-roughening treatment was carried out using the procedures shown below to manufacture planographic printing plate-use aluminum supports in Examples A1 to A5 and Comparative Examples A1 to A3. Also, liquid was drained off by a nip roller after the surface treatment and water washing. The water washing was conducted by spraying water from a spraying pipe.

(1) Mechanical Surface-roughening Treatment

Mechanical surface-roughening was carried out using a brush roller with a rotating nylon brush while supplying a suspension consisting of quartz sand and water and having a specific gravity of 1.12 (abrasives, average particle diameter: 25 $\mu$m) as an abrasive material to the surface of the aluminum plate.

The material of the nylon brush was Nylon-6, 10 having a hair length of 50 mm and a hair diameter of 0.48 mm. The nylon brush was produced by forming holes in a solid stainless cylinder having a diameter (Φ) of 300 mm, and implanting hairs densely into the holes.

The brush roller used three nylon brushes and the distance between two support rollers (Φ: 200 mm) disposed under the brushes was 300 mm.

The brush roller was operated as follows: load of a driving motor for rotating the brushes was controlled in contrast to a load before the nylon brush was pressed against the aluminum plate, and the nylon brush was pressed against the aluminum plate such that the average surface roughness (Ra) of the aluminum plate after surface-roughening would be 0.45 $\mu$m. The direction of rotation of the brush was the same as the direction of movement of the aluminum plate. Thereafter, the aluminum plate was washed with water.

For control of the concentration of the abrasives in the solution, the concentration of abrasives was found from the temperature and specific gravity of the solution by reference to a table, made in advance, of the relationship between the concentration of the abrasives and the temperature and specific gravity of the solution. Water and the abrasives were added by feedback control to keep the concentration of the abrasives constant. Also, because the surface shape of the roughened aluminum plate would change if the abrasives were crushed into small grains, abrasives having a small grain size were successively discharged out of the system by using a cyclone. The particle diameter of the abrasive was in a range from 1 to 35 $\mu$m.

(2) Etching Treatment in an Aqueous Alkaline Solution

An aqueous solution containing 27 mass % of NaOH and 6.5 mass % of aluminum ions and having a temperature of 70° C. was sprayed on the aluminum plate to carry out alkali etching treatment for the aluminum plate. The amount of the aluminum plate dissolved on the side surface which was to be processed afterwards by an electrochemical surface-roughening treatment was 8 g/m$^2$ and the amount of the aluminum plate dissolved on the back face side was 2 g/m$^2$.

For control of the concentration of the etching solution, the concentration of the etching solution was found from the temperature, specific gravity and conductance of the solution by reference to a table, made in advance, of the relationship between the NaOH concentration, aluminum ion concentration, temperature, specific gravity and conductance of the solution. Water and an aqueous 48 mass % NaOH solution were added by feedback control to keep the concentration of the etching solution constant. Thereafter, the plate was washed with water.

(3) Desmutting Treatment

Then, an aqueous nitric acid solution having a solution temperature of 35° C. was sprayed on the aluminum plate using a spray to carry out a desmutting treatment for 10 seconds. As the aqueous nitric acid solution used in this desmutting treatment, effluent that had overflowed from an electrolyzer to be used in the next step was used. The desmutting treatment solution was supplied to the aluminum plate from spraying pipes which were disposed at 5 places for spraying the desmutting treatment solution to prevent the surface of the aluminum plate from being dried.

(4) Electrochemical Surface-roughening Treatment in an Aqueous Nitric Acid Solution Using an a.c. current having a trapezoidal wave as shown in FIG. 1 and two cells as shown in FIG. 2 as the electrolyzer, an electrochemical surface-roughening treatment was carried out continuously. As the aqueous acidic solution, an aqueous nitric acid solution (containing 0.5 mass % of aluminum ions and 0.007 mass % of ammonium ions) containing 1 mass % of nitric acid was used and the solution temperature was 50° C. For the a.c. current, each of times tp and tp' required for the value of current to reach a peak from 0 was 1 msec and a carbon electrode was used as a counter electrode. The current density of the a.c. current when the current reached the peak was 50 A/dm$^2$ both when the aluminum plate worked as an anode and as a cathode. Further, the ratio ($Q_C/Q_A$) of the cathode-time quantity of electricity of the aluminum plate ($Q_C$) to the anode-time quantity of electricity of the aluminum plate ($Q_A$), duty ratio, frequency and the sum of the quantity of electricity when the aluminum plate worked as an anode were as shown in Table 3. After that, the plate was washed with water by spraying.

Control of the concentration of the aqueous nitric acid solution was made by adding an undiluted 67 mass % nitric acid solution and water in proportion to the quantity of electricity passed through the solution and discharging the aqueous acidic solution (aqueous nitric acid solution) by overflowing it successively from the electrolyzer in the same volume as the nitric acid and water which were added. Also, the concentration of the aqueous nitric acid solution was found from the temperature and conductance of the aqueous nitric acid solution and the propagation speed of ultrasound in the solution by reference to a table, made in advance, of the relationship between the nitric acid concentration, aluminum ion concentration, temperature and conductance of the solution and the propagation speed of ultrasound in the solution, and control was performed to successively regulate the amounts of the undiluted nitric acid solution and water to be added to keep the concentration of the aqueous nitric acid solution constant.

(5) Etching Treatment in an Aqueous Alkaline Solution

An aqueous solution containing 26 mass % of NaOH and 6.5 mass % of aluminum ions and having a temperature of 45° C. was sprayed on the aluminum plate to carry out alkali etching treatment on the aluminum plate. The amount of the aluminum plate dissolved was 1 g/m$^2$. For control of the concentration of the etching solution, the concentration of the etching solution was found from the temperature, specific gravity and conductance of the solution by reference to a table, made in advance, of the relationship between the NaOH concentration, aluminum ion concentration, temperature, specific gravity and conductance of the solution. Water and an aqueous 48 mass % NaOH solution were added by feedback control to keep the concentration of the etching solution constant. Thereafter, the plate was washed with water.

(6) Etching Treatment in an Aqueous Acidic Solution

Next, using sulfuric acid as an acidic etching solution, the acidic etching solution was sprayed on the aluminum plate from a spraying pipe in the conditions shown in Table 2 to carry out acid etching treatment. The concentration of the acid etching solution was kept constant by finding the concentration of the solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plate was washed with water.

TABLE 2

| | Etching | | | |
|---|---|---|---|---|
| | Sulfuric acid concentration (g/l) | $Al^{3+}$ concentration (g/l) | Temperature (° C.) | Time (sec) |
| A1 | 500 | 3 | 60 | 3 |
| A2 | 500 | 1 | 70 | 5 |
| A3 | 300 | 15 | 70 | 8 |
| A4 | 300 | 5 | 80 | 2 |
| A5 | 400 | 8 | 70 | 10 |
| A6 | 500 | 3 | 60 | 3 |
| A7 | 500 | 3 | 60 | 3 |
| A8 | 500 | 3 | 60 | 3 |
| Comparative Example A1 | 100 | 5 | 35 | 3 |
| Comparative Example A2 | 100 | 5 | 35 | 10 |
| Comparative Example A3 | 100 | 1 | 35 | 10 |

(7) Anodic Oxidation Treatment

Using an aqueous solution (containing 0.5 mass % of aluminum ions) having a sulfuric acid concentration of 15 mass % and a solution temperature of 35° C. as an anodic oxidation solution, an anodic oxidation treatment was carried out using a d.c. voltage at a current density of 2 A/dm$^2$ such that the amount of the anodic oxide film was 2.4 g/m$^2$. The concentration of the anodic oxidation solution was kept constant by finding the concentration of the solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the respective plates were washed with water by spraying to manufacture planographic printing plate-use aluminum supports as Examples A1 to A5 and Comparative Examples A1 to A3.

(8) Production of a Planographic Printing Plate

These planographic printing plate-use aluminum supports processed by the aforementioned treatments were dried and an undercoat layer and a light-sensitive layer with a dry film thickness of 2.0 g/m$^2$ were formed on the roughened surface by application and drying to manufacture positive-type planographic printing master plates of Examples A1 to A5 and Comparative Examples A1 to A3. These planographic printing master plates were subjected to treatments such as exposure and developing to form planographic printing plates. The planographic printing plates of Examples A1 to A5 shown in Table 3 each had a uniform surface shape when observed in an SEM photograph with a magnification of 750, showing that they were good printing plates. On the other hand, the planographic printing plates of Comparative Examples A1 to A3 each had a uniform shape but a portion corresponding to a non-image portion of a printed product was easily soiled. The planographic printing plates of Comparative Examples A1 to A3 respectively had a non-uniform shape when observed in an SEM photograph.

Evaluation

Printing was performed using the planographic printing plates produced in the aforementioned Examples A1 to A5 and Comparative Examples A1 to A3. A condition of soiling on the surface of each planographic printing plate after the completion of the printing was visually observed to evaluate anti-soiling characteristics according to the following standard. The results are shown in Table 3.

Standard

A: Extremely little ink was stuck to the non-image portion.

C: The non-image portion was significantly soiled by ink stuck thereto.

Example A6

The planographic printing plate-use aluminum support obtained after the anodic oxidation treatment was finished in Example A1 was further dipped in boiled distilled water to carry out a sealing treatment. After that, the support was dipped in an aqueous solution containing 2.5 mass % of sodium silicate at a solution temperature of 70° C. for 14 seconds for the purpose of performing a hydrophilicizing treatment, then washed with water and dried to produce a planographic printing plate-use aluminum support as Example A6. The concentration of the solution used in the above hydrophilicizing treatment was kept constant by finding the concentration of the solution from the temperature and conductance of the solution by reference to a table, made in advance, of the relationship between the sodium silicate concentration, temperature and conductance of the solution and adding water and an undiluted No. 3 sodium silicate solution by feedback control.

An undercoat layer and a negative-type light-sensitive layer were formed by application on the planographic printing plate-use aluminum support produced in the above manner and dried to manufacture a positive-type planographic printing master plate of Example A6. The planographic printing master plate was subjected to treatments such as exposure and developing to form a planographic printing plate. Using this planographic printing plate, an evaluation was made with the same conditions as for Example A1, which showed that it was a good printing plate. The results are shown in Table 3.

Example A7

The planographic printing plate-use aluminum support obtained after the anodic oxidation treatment was finished in Example A1 was dipped in an aqueous solution containing 2.5 mass % of sodium silicate at a solution temperature of 70° C. for 5 seconds for the purpose of performing a hydrophilicizing treatment, then washed with water using a spray and dried, followed by exposing and developing to produce a planographic printing plate-use aluminum support as Example A7. An undercoat layer and a negative-type light-sensitive layer were formed by application on the planographic printing plate-use aluminum support and dried to manufacture a negative-type planographic printing master plate of Example A7. The planographic printing master plate was subjected to treatments such as exposure and developing to form a negative-type planographic printing plate. Using this planographic printing plate, an evaluation was made with the same conditions as for Example A1, which showed that it was a good printing plate. The results are shown in Table 3.

Example A8

The planographic printing plate-use aluminum support obtained after the anodic oxidation treatment was finished in Example A1 was dipped in an aqueous solution containing 1.5 mass % of polyvinylphosphonic acid at a solution temperature of 70° C. for 5 seconds for the purpose of performing a hydrophilicizing treatment, then washed with water by using a spray and dried to produce a planographic printing plate-use aluminum support as Example A8. The concentration of the solution used in the above hydrophilicizing treatment was kept constant by finding the concentration of the solution from the temperature and conductance of the solution by reference to a table, made in advance, of the relationship between the polyvinylphosphonic acid concentration, temperature and conductance of the solution and adding water and an undiluted polyvinylphosphonic acid solution by feedback control.

An undercoat layer and a negative-type light-sensitive layer were formed by application on the planographic printing plate-use aluminum support and dried to manufacture a negative-type planographic printing master plate of Example A8 The planographic printing master plate was subjected to treatments such as exposure and developing to form a planographic printing plate. Using this planographic printing plate, an evaluation was made with the same conditions as for Example A1, and showed that it was a good printing plate. The results are shown in Table 3.

According to Table 3, the planographic printing plates of Examples A1 to A5 were resistant to the occurrence of soiling even after 5000 copies were printed, showing that these planographic printing plates were good printing plates. In contrast, the planographic printing plates of Comparative Examples A1 to A3 showed the dirt and therefore these printing plates could not be said to be good printing plates.

Examples B1 to B5 and Comparative Examples B1 and B2

Using a JIS 1050-H18 aluminum rolled plate manufactured without performing intermediate annealing and soaking treatments, the following treatments were carried out to manufacture planographic printing plate-use aluminum supports as Examples B1 to B5 and Comparative Examples B1 and B2. After each treatment was finished, each plate was washed with water and water was drained off using a nip roller. The washing was carried out by spraying water from a spraying pipe.

(1) Mechanical Surface-roughening Treatment

This was the same as "(1) Mechanical surface-roughening treatment" in Examples A1 to A5 and Comparative Examples A1 to A3.

(2) Etching Treatment in an Aqueous Alkaline Solution

This was the same as "(2) Etching treatment in an aqueous alkaline solution" in Examples A1 to A5 and Comparative Examples A1 to A3.

(3) Desmutting Treatment

Then, an aqueous acidic solution primarily containing hydrochloric acid and having a solution temperature of 35° C. was sprayed on the aluminum plate using a spray to carry out a desmutting treatment for 10 seconds. As the aqueous acidic solution used in this desmutting treatment, effluent that had overflowed from an electrolyzer to be used in the next step was used. The desmutting treatment solution was supplied to the aluminum plate from spraying pipes which were disposed at 5 places for spraying desmutting treatment solution to prevent the surface of the aluminum plate from being dried.

(4) Electrochemical Surface-roughening Treatment in an Aqueous Acidic Solution Primarily Containing Hydrochloric Acid Using a.c. current having a trapezoidal waveform as shown in FIG. 1 and two cells as shown in FIG. 2 as the electrolyzer, an electrochemical surface-roughening treatment was carried out continuously. As the aqueous acidic

TABLE 3

| | Electrochemical surface-roughening | | | | | |
|---|---|---|---|---|---|---|
| | Aluminum used | Duty ratio | Frequency (Hz) | Quantity of electricity ($C/dm^2$) | Electricity quantities ratio ($Q_C/Q_A$) | |
| A1 | Composition A | 0.33 | 42 | 210 | 1.9 | A |
| A2 | Composition B | 0.33 | 42 | 210 | 1.5 | A |
| A3 | Composition C | 0.33 | 84 | 180 | 1.9 | A |
| A4 | Composition D | 0.33 | 84 | 180 | 1.9 | A |
| A5 | Composition E | 0.40 | 70 | 200 | 1.9 | A |
| A6 | Composition A | 0.33 | 42 | 210 | 1.9 | A |
| A7 | Composition A | 0.33 | 42 | 210 | 1.9 | A |
| A8 | Composition A | 0.33 | 42 | 210 | 1.9 | A |
| Comparative Example A1 | Composition A | 0.33 | 42 | 210 | 0.9 | C |
| Comparative Example A2 | Composition A | 0.50 | 42 | 210 | 0.9 | C |
| Comparative Example A3 | Composition A | 0.50 | 30 | 210 | 4.0 | C |

solution, a solution obtained by adding aluminum chloride to a hydrochloric acid solution containing 7.5 g/l of HCl such that the amount of aluminum ions was 4.5 g/l was used and the solution temperature was 35° C. For the a.c. current, each of the times tp and tp' required for the value of current to reach a peak from 0 was 1 msec and a carbon electrode was used as a counter electrode. The current density of the a.c. current when the current reached the peak was 50 A/dm$^2$ both when the aluminum plate worked as an anode and as a cathode. Further, the ratio ($Q_C/Q_A$) of the cathode-time quantity of electricity of the aluminum plate ($Q_C$) to the anode-time quantity of electricity of the aluminum plate ($Q_A$), duty ratio, frequency and the sum of the quantity of electricity when the aluminum plate worked as an anode were as shown in Table 4. After that, the plate was washed with water by spraying.

The control of the concentration of the aqueous acidic solution primarily containing hydrochloric acid was made by adding an undiluted 35 mass % hydrochloric acid solution and water in proportion to the quantity of electricity passed through the solution and discharging the aqueous acidic solution (aqueous acidic solution primarily containing hydrochloric acid) externally from the circulation tank system by overflowing it successively from the circulation tank in the same volume as the hydrochloric acid and water which were added. Also, the concentration of the aqueous acidic solution was found from the temperature and conductance of the aqueous acidic solution and the propagation speed of ultrasound in the solution by reference to a table, made in advance, of the relationship between the hydrochloric acid concentration, aluminum ion concentration, temperature and conductance of the solution and the propagation speed of ultrasound in the solution, and control was performed to successively regulate the amounts of the undiluted hydrochloric acid solution and water to be added to keep the concentration of the solution constant.

(5) Etching Treatment in an Aqueous Alkaline Solution

An aqueous solution containing 5 mass % of NaOH and 0.5 mass % of aluminum ions and having a temperature of 45° C. was sprayed on the aluminum plate to carry out an alkali etching treatment. The amount of each aluminum plate to be dissolved was as shown in Table 4. In Example B3, no alkali etching treatment was performed. The concentration of the etching solution was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution, and adding water and an aqueous 48 mass % NaOH solution by feedback control. Thereafter, the plate was washed with water.

(6) Etching Treatment in an Aqueous Acidic Solution

Next, using sulfuric acid as an acidic etching solution, the acidic etching solution was sprayed on the aluminum plate from a spraying pipe in the conditions shown in Table 4 to carry out acid etching treatment. The concentration of the acid etching solution was kept constant by finding the concentration of the acidic etching solution from the temperature, specific gravity and conductance of the solution by reference to a table, made in advance, of the relationship between the sulfuric acid concentration, aluminum ion concentration, temperature, specific gravity and conductance of the solution and adding water and 98 mass % sulfuric acid by feedback control. Thereafter, the plate was washed with water.

(7) Anodic Oxidation Treatment

Using an aqueous solution (containing 0.5 mass % of aluminum ions) having a sulfuric acid concentration of 15 mass % and a solution temperature of 35° C. as an anodic oxidation solution, an anodic oxidation treatment was carried out using a d.c. voltage at a current density of 2 A/dm$^2$ such that the amount of the anodic oxide film was 2.4 g/m$^2$. The concentration of the anodic oxidation solution was kept constant by finding the concentration of the solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plate was washed with water by spraying to manufacture planographic printing plate-use aluminum supports as Examples B1 to B5 and Comparative Examples B1 and B2.

(8) Production of a Planographic Printing Plate

These planographic printing plate-use aluminum supports processed by the aforementioned treatment were dried and an undercoat layer and a light-sensitive layer with a dry film thickness of 2.0 g/m$^2$ were formed on the roughened surface by application and drying to manufacture positive-type planographic printing master plates of Examples B1 to B5 and Comparative Examples B1 and B2. These planographic printing master plates were subjected to treatments such as exposure and developing to form planographic printing plates. The planographic printing plates of Examples B1 to B5 shown in Table 4 were observed in an SEM photograph with a magnification of 750 and it was found that these plates each had a surface shape in which honeycomb-like pits were uniformly formed and piled fine irregularities having a pitch of 0.1 to 0.5 $\mu$m were formed in each honeycomb pit. Also, the planographic printing plates of Examples B1 to B5 were good printing plates having high adhesion to the light-sensitive layer. Further, a treatment irregularity known as "streaking", which is caused by differences in crystal orientation between aluminum crystal particles, was not observed.

On the other hand, the planographic printing plate of Comparative Example B1 had a non-uniform pit shape when observed in an SEM photograph the same as above. Also, evaluation of the planographic printing plate of Comparative Example B1 as described later showed that a blanket cylinder of a printer was easily soiled.

The planographic printing plate of Comparative Example B2 has a uniform surface shape; however, evaluation of the planographic printing plate of Comparative Example B2 as described later showed that the part corresponding to a non-image portion of a printed product was easily soiled spot-wise.

Evaluation

Printing was performed using the planographic printing plates produced in the aforementioned Examples B1 to B5 and Comparative Examples B1 and B2. The condition of soiling on the surface of each planographic printing plate after the completion of the printing was visually observed to evaluate anti-soiling characteristics according to the following standard. The results are shown in Table 4.

Standard

A: Extremely little ink was stuck to the non-image portion.

C: The non-image portion was significantly soiled by ink stuck thereto.

Example B6

The planographic printing plate-use aluminum support obtained after the anodic oxidation treatment was finished in Example B1 was further dipped in boiled distilled water to carry out a sealing treatment. After that, the support was dipped in an aqueous solution containing 2.5 mass % of sodium silicate at a solution temperature of 70° C. for 14 seconds for the purpose of performing a hydrophilicizing treatment, then washed with water by spraying and dried to produce a planographic printing plate-use aluminum support as Example B6. The concentration of the solution used in the above hydrophilicizing treatment was kept constant by finding the concentration of the solution from the temperature and conductance of the solution by reference to a table, made in advance, of the relationship between the sodium silicate concentration, temperature and conductance of the solution and adding water and an undiluted No. 3 sodium silicate solution by feedback control.

An undercoat layer and a negative-type light-sensitive layer were formed by application on the planographic printing plate-use aluminum support produced in the above manner and dried to manufacture a positive-type planographic printing master plate of Example B6. The planographic printing master plate was subjected to treatments such as exposure and developing to form a planographic printing plate. Using this planographic printing plate, evaluation was made with the same conditions as for Example B1, which showed that it was a good printing plate. The results are shown in Table 4.

Example B7

The planographic printing plate-use aluminum support obtained after the anodic oxidation treatment was finished in Example B1 was further dipped in an aqueous solution containing 2.5 mass % of sodium silicate at a solution temperature of 70° C. for 5 seconds for the purpose of performing hydrophilicizing treatment, then washed with water using a spray and dried, followed by exposing and developing to produce a planographic printing plate-use aluminum support as Example B7. An undercoat layer and a negative-type light-sensitive layer were formed by application on the planographic printing plate-use aluminum support and dried to manufacture a negative-type planographic printing master plate of Example B7. The planographic printing master plate was subjected to treatments such as exposure and developing to form a negative-type planographic printing plate. Using this planographic printing plate, an evaluation was made with the same conditions as for Example B1, which showed that it was a good printing plate. The results are shown in Table 4.

Example B8

The planographic printing plate-use aluminum support obtained after the anodic oxidation treatment was finished in Example B1 was further dipped in an aqueous solution containing 1.5 mass % of polyvinylphosphonic acid at a solution temperature of 70° C. for 5 seconds for the purpose of performing a hydrophilicizing treatment, then washed with water using a spray and dried to produce a planographic printing plate-use aluminum support as Example B8. The concentration of the solution used in the above hydrophilicizing treatment was kept constant by finding the concentration of the solution from the temperature and conductance of the solution by reference to a table, made in advance, of the relationship between the polyvinylphosphonic acid concentration, temperature and conductance of the solution and adding water and an undiluted polyvinylphosphonic acid by feedback control.

An undercoat layer and a negative-type light-sensitive layer were formed by application on the planographic printing plate-use aluminum support and dried to manufacture a negative-type planographic printing master plate of Example B8. The planographic printing master plate was subjected to treatments such as exposure and developing to form a planographic printing plate. Using this planographic printing plate, an evaluation was made with the same conditions as for Example B1, which showed that it was a good printing plate. The results are shown in Table 4.

Example B9

Aluminum plates to be used in Example B9 were produced from five aluminum alloy molten baths having alloy components of compositions A to E shown in Table 1 respectively. These aluminum plates were produced in the following manner. First, the aluminum alloy molten bath was subjected to a molten bath treatment comprising degassing and filtration to prepare a 500-mm-thick ingot by the DC casting method. After the surface of the ingot was surface-cut by 10 mm, the ingot was heated to start hot-rolling at 400° C. without performing a soaking treatment and rolled to a plate thickness of 4 mm. Then, the plate was cold-rolled to a plate thickness of 1.5 mm, followed by performing intermediate annealing and then cold-rolled again to a finished thickness of 0.24 mm. After the flatness of the plate was remedied, the aluminum plates to be used for Examples B9-1 to B9-5 were produced.

With regard to the compositions A to D, the purity of Al and the content of each of all impurity elements were respectively within a predetermined range and within a range preferable in the present invention. The composition E was a composition in which the purity of Al and the content of each of 5 impurity elements, Fe, Si, Mn, Mg and Zn were respectively within a predetermined range and within a range preferable in the present invention.

The aluminum plates having the compositions shown in Table 1 were subjected to the same treatments as in Example B1 to manufacture five planographic printing plate-use aluminum supports as Example B9.

These resulting planographic printing plate-use aluminum supports were each dried and an undercoat layer and a light-sensitive layer were formed by application on the roughened surface, followed by drying to produce a positive-type planographic printing master plate with a dry film thickness of 2.0 g/m$^2$. These planographic printing master plates were subjected to treatments such as exposure and developing to form planographic printing plates. These planographic printing plates were evaluated with the same conditions as for Example B1, which showed that these planographic printing plates were good printing plates. The results are shown in Table 4.

The five planographic printing plates in Example 9 were observed in an SEM photograph with a magnification of 750 and it was found that these plates each had a surface shape in which honeycomb-like pits were uniformly formed and piled fine irregularities having a pitch of 0.1 to 0.5 $\mu$m were formed in each honeycomb pit. Also, the planographic printing plates were good printing plates free from spot-like soiling in a non-image portion when evaluated as above. Further, the treatment irregularity known as "streaking", which is caused by differences in crystal orientation between aluminum crystal particles, was not observed.

Example B10

Using a JIS 1050-H18 aluminum rolled plate manufactured without performing intermediate annealing and soaking treatment, the following treatments were carried out to manufacture a planographic printing plate-use aluminum support as Example B10. After each treatment was finished, the plate was washed with water and water was drained off using a nip roller. The washing was carried out by spraying water from a spraying pipe.

(1) Etching Treatment in an Aqueous Alkaline Solution

An aqueous solution containing 27 mass % of NaOH and 6.5 mass % of aluminum ions and having a temperature of 70° C. was sprayed on the aluminum plate by a spraying pipe to carry out alkali etching treatment for the aluminum plate. The amount of the aluminum plate dissolved on the side surface which was to be processed afterwards by an electrochemical surface-roughening treatment was 6 g/m$^2$ and the amount of the aluminum plate dissolved on the back face side was 2 g/m$^2$.

The concentration of the etching solution used in the above alkali etching treatment was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution, and adding water and an aqueous 48 mass % NaOH solution by feedback control. Thereafter, the plate was washed with water.

(2) Desmutting Treatment

Then, an aqueous acidic solution primarily containing hydrochloric acid and having a solution temperature of 35° C. was sprayed on the aluminum plate by using a spray to carry out a desmutting treatment for 10 seconds. As the aqueous acidic solution used in this desmutting treatment, effluent that had overflowed from an electrolyzer to be used in the next step was used.

(3) Electrochemical Surface-roughening Treatment in an Aqueous Acidic Solution Primarily Containing Hydrochloric Acid Using an a.c. current having a trapezoidal waveform as shown in FIG. 1 and two cells as shown in FIG. 2 as the electrolyzer, an electrochemical surface-roughening treatment was carried out continuously. As the aqueous acidic solution, a solution obtained by adding aluminum chloride to a hydrochloric acid solution containing 7.5 g/l of HCl such that the amount of aluminum ions was 4.5 g/l was used and the solution temperature was 35° C. For the a.c. current, each of the times tp and tp' required for the value of current to reach a peak from 0 was 1 msec and a carbon electrode was used as a counter electrode. The current density of the a.c. current when the current reached the peak was 50 A/dm$^2$ both when the aluminum plate worked as an anode and as a cathode. Further, the ratio ($Q_C/Q_A$) of the cathode-time quantity of electricity of the aluminum plate ($Q_C$) to the anode-time quantity of electricity of the aluminum plate ($Q_A$) was 1.9, the duty ratio of the a.c. current was 0.33, the frequency of the a.c. current was 42 Hz and the sum of the quantity of electricity when the aluminum plate worked as an anode was 200 C/dm$^2$. After that, the plate was washed with water by spraying.

Control of the concentration of the aqueous acidic solution primarily containing hydrochloric acid was performed by adding an undiluted 35 mass % hydrochloric acid solution and water in proportion to the quantity of electricity passed through the solution and discharging the aqueous acidic solution (aqueous hydrochloric acid solution) externally from the circulation tank system by overflowing it successively from the circulation tank in the same volume as the hydrochloric acid and water which were added. Also, the concentration of the aqueous acidic solution primarily containing hydrochloric acid was found from the temperature and conductance of the aqueous acidic solution and the propagation speed of ultrasound in the solution by reference to a table, made in advance, of the relationship between the hydrochloric acid concentration, aluminum ion concentration, temperature and conductance of the solution and the propagation speed of ultrasound in the solution, and control was performed to successively regulate the amounts of the undiluted hydrochloric acid solution and water to be added to keep the concentration of the solution constant.

(4) Etching Treatment in an Aqueous Alkaline Solution

An aqueous solution containing 5 mass % of NaOH and 0.5 mass % of aluminum ions and having a temperature of 45° C. was sprayed on the aluminum plate to carry out an alkali etching treatment. The amount of the aluminum plate to be dissolved was 0.1 g/m$^2$. The concentration of the etching solution was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution and adding water and an aqueous 48 mass % NaOH solution by feedback control. Thereafter, the plate was washed with water.

(5) Etching Treatment in an Aqueous Acidic Solution

Next, using, as an acidic etching solution, an aqueous sulfuric acid solution having a temperature 70° C. and a sulfuric acid concentration of 300 g/l and containing 1 g/l of aluminum ions, the acidic etching solution was sprayed on the aluminum plate from a spraying pipe to carry out an acid etching treatment for 60 seconds. The concentration of the acid etching solution was kept constant by finding the concentration of the acidic etching solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plate was washed with water.

(6) Anodic Oxidation Treatment

Using an aqueous solution (containing 0.5 mass % of aluminum ions) having a sulfuric acid concentration of 10 mass % and a solution temperature of 35° C. as an anodic oxidation solution, an anodic oxidation treatment was carried out using d.c. voltage at a current density of 2 A/dm$^2$ such that the amount of the anodic oxide film was 2.4 g/m$^2$. The concentration of the anodic oxidation solution was kept constant by finding the concentration of the solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plate was washed with water by spraying to manufacture a planographic printing plate-use aluminum support as Example B10.

(7) Production of a Planographic Printing Plate

The planographic printing plate-use aluminum support processed by the aforementioned treatment was dried and an undercoat layer and a light-sensitive layer with a dry film thickness of 2.0 g/m$^2$ were formed on the roughened surface by application and dried to manufacture a positive-type planographic printing master plate of Example B10. The planographic printing master plate was subjected to treatments such as exposure and developing to form a planographic printing plate. The planographic printing plate was observed in an SEM photograph with a magnification of 750 and it was found that the plate had a surface shape in which honeycomb-like pits having a diameter of 4 to 10 μm were uniformly formed and piled fine irregularities having a pitch of 0.1 to 0.5 μm were formed in each honeycomb pit. Also, the planographic printing plate was a good printing plate having high adhesion to the light-sensitive layer. Further, the treatment irregularity known as "streaking", which is caused by differences in crystal orientation between aluminum crystal particles, was not observed.

TABLE 4

| | Electrochemical surface-roughening treatment | | | | Alkali etching treatment | Acid etching solution | | | | |
|---|---|---|---|---|---|---|---|---|---|---|
| Example | Duty ratio | Frequency (Hz) | Quantity of electricity ($C/dm^2$) | Electricity quantities ratio ($Q_C/Q_A$) | Dissolution amount ($g/m^2$) | Sulfuric acid concentration (g/l) | $Al^{3+}$ concentration (g/l) | Temperature (° C.) | Time (sec) | Soiling resistance |
| B1 | 0.33 | 84 | 180 | 1.9 | 0.1 | 300 | 15 | 60 | 3 | A |
| B2 | 0.33 | 84 | 180 | 1.5 | 0.1 | 300 | 5 | 70 | 5 | A |
| B3 | 0.33 | 84 | 180 | 1.9 | None | 300 | 15 | 70 | 8 | A |
| B4 | 0.33 | 84 | 180 | 1.9 | 0.3 | 300 | 15 | 70 | 8 | A |
| B5 | 0.33 | 111 | 120 | 1.9 | 0.1 | 300 | 10 | 80 | 5 | A |
| B6 | 0.33 | 84 | 180 | 1.9 | 0.1 | 300 | 15 | 60 | 3 | A |
| B7 | 0.33 | 84 | 180 | 1.9 | 0.1 | 300 | 15 | 60 | 3 | A |
| B8 | 0.33 | 84 | 180 | 1.9 | 0.1 | 300 | 15 | 60 | 3 | A |
| B9-1 | 0.33 | 84 | 180 | 1.9 | 0.1 | 300 | 15 | 60 | 3 | A |
| B9-2 | 0.33 | 84 | 180 | 1.9 | 0.1 | 300 | 15 | 60 | 3 | A |
| B9-3 | 0.33 | 84 | 180 | 1.9 | 0.1 | 300 | 15 | 60 | 3 | A |
| B9-4 | 0.33 | 84 | 180 | 1.9 | 0.1 | 300 | 15 | 60 | 3 | A |
| B9-5 | 0.33 | 84 | 180 | 1.9 | 0.1 | 300 | 15 | 60 | 3 | A |
| B10 | 0.33 | 42 | 200 | 1.9 | 0.1 | 300 | 1 | 70 | 60 | A |
| Comparative Example B1 | 0.5 | 60 | 180 | 0.9 | 0.1 | 300 | 5 | 35 | 3 | B |
| Comparative Example B2 | 0.33 | 84 | 180 | 0.9 | 0.1 | 300 | 5 | 35 | 3 | B |

According to Table 4, the planographic printing plates of Examples B1 to B10 were resistant to the occurrence of soiling even after 5000 copies were printed, showing that these planographic printing plates were good printing plates. In contrast, the planographic printing plates of Comparative Examples B1 and B2 showed the dirt and therefore these printing plates could not be said to be good printing plates.

Examples C1 to C4

Using a JIS 1050-H18 aluminum rolled plate manufactured without performing intermediate annealing and soaking treatments, the following treatments were carried out to manufacture planographic printing plate-use aluminum supports as Examples C1 to C4. After each treatment was finished, each plate was washed with water and water was drained off using a nip roller. The washing was carried out by spraying water from a spraying pipe.

(1) Etching Treatment in an Aqueous Alkaline Solution

An aqueous solution containing 27 mass % of NaOH and 6.5 mass % of aluminum ions and having a temperature of 70° C. was sprayed on the aluminum plate by a spraying pipe to carry out an alkali etching treatment for the aluminum plate. The amount of the aluminum plate dissolved on the side surface which was processed afterwards by an electrochemical surface-roughening treatment was 6 $g/m^2$ and the amount of the aluminum plate dissolved on the back face side was 2 $g/m^2$.

The concentration of the etching solution used in the above alkali etching treatment was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution, and adding water and an aqueous 48 mass % NaOH solution by feedback control. Thereafter, the plate was washed with water.

(2) Desmutting Treatment

Then, an aqueous acidic solution primarily containing hydrochloric acid and having a solution temperature of 35° C. was sprayed on the aluminum plate by using a spray to carry out a desmutting treatment for 10 seconds. As the aqueous acidic solution used in this desmutting treatment, effluent that had overflowed from an electrolyzer to be used in the next step was used. The desmutting treatment solution was supplied to the aluminum plate from spraying pipes which were disposed at several places for spraying the desmutting treatment solution to prevent the surface of the aluminum plate from being dried.

(3) Electrochemical Surface-roughening Treatment in an Aqueous Acidic Solution Primarily Containing Hydrochloric Acid (First Surface-roughening Treatment)

Using a.c. current having a trapezoidal wave as shown in FIG. 1 and two cells as shown in FIG. 2 as the electrolyzer, an electrochemical surface-roughening treatment was carried out continuously. As the aqueous acidic solution, a solution obtained by adding aluminum chloride to a hydrochloric acid solution containing 7.5 g/l of HCl such that the amount of aluminum ions was 4.5 g/l was used and the solution temperature was 35° C. For the a.c. current, each of the times tp and tp' required for the value of current to reach a peak from 0 was 1 msec and a carbon electrode was used as a counter electrode. The current density of the a.c. current when the current reached the peak was 50 $A/dm^2$ when the aluminum plate took part in an anodic reaction and 47.5 $A/dm^2$ when the aluminum plate took part in a cathodic reaction. Further, the ratio ($Q_C/Q_A$) of the cathode-time quantity ($Q_C$) of electricity of the aluminum plate to the anode-time quantity ($Q_A$) of electricity of the aluminum plate, duty ratio, frequency and the sum of the quantity of electricity when the aluminum plate takes part in an anode reaction were as shown in Table 5. After this, the plate was washed with water by spraying.

The control of the concentration of the aqueous acidic solution primarily containing hydrochloric acid was made by adding an undiluted 35 mass % hydrochloric acid solution and water in proportion to the quantity of electricity passed through the solution and discharging the aqueous acidic solution (aqueous acidic solution primarily containing hydrochloric acid) externally from the circulation tank system by overflowing it successively from the circulation tank in the same volume as the hydrochloric acid and water which were added. Also, the concentration of the aqueous acidic solution was found from the temperature and conductance of the aqueous acidic solution and the propagation speed of ultrasound in the solution by reference to a table, made in advance, of the relationship between the hydrochloric acid concentration, aluminum ion concentration, temperature and conductance of the solution and the propagation speed of ultrasound in the solution, and control was performed to successively regulate the amounts of the undiluted hydrochloric acid solution and water to be added to keep the concentration of the solution constant.

TABLE 5

| | Duty ratio | Frequency (Hz) | Quantity of electricity ($C/dm^2$) | Solution temperature (° C.) | Peak current density ($A/dm^2$) Anode-time | Peak current density ($A/dm^2$) Cathode-time | Electricity quantities ratio ($Q_C/Q_A$) |
|---|---|---|---|---|---|---|---|
| Example C1 | 0.5 | 120 | 200 | 35 | 50 | 47.5 | 0.95 |
| Example C2 | 0.33 | 42 | 200 | 40 | 50 | 47.5 | 1.9 |
| Example C3 | 0.5 | 120 | 200 | 35 | 50 | 47.5 | 0.95 |
| Example C4 | 0.5 | 120 | 180 | 35 | 50 | 47.5 | 0.95 |

(4) Etching Treatment in an Aqueous Alkaline Solution Carried Out Between Electrochemical Surface-roughening Treatments An aqueous solution containing 27 mass % of NaOH and 6.05 mass % of aluminum ions and having a temperature of 45° C. was sprayed on the aluminum plate to carry out an alkali etching treatment. The amount of the aluminum plate to be dissolved on the side roughened in a second surface-roughening treatment was as shown in Table 6. In Example C3, no alkali etching treatment was performed. The concentration of the etching solution was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution and adding water and an aqueous 48 mass % NaOH solution by feedback control. Thereafter, the plate was washed with water.

TABLE 6

| | Amount of aluminum plate dissolved | Remarks |
|---|---|---|
| Example C1 | 0.3 $g/m^2$ | |
| Example C2 | 5.0 $g/m^2$ | |

TABLE 6-continued

| | Amount of aluminum plate dissolved | Remarks |
|---|---|---|
| Example C3 | 0.0 $g/m^2$ | No etching |
| Example C4 | 5.0 $g/m^2$ | |

(5) Desmutting Treatment Carried Out Between Electrochemical Surface-roughening Treatments Then, an aqueous acidic solution primarily containing hydrochloric acid and having a solution temperature of 35° C. was sprayed on the aluminum plate by using a spray to carry out a desmutting treatment for 3 seconds. As the aqueous acidic solution used in this desmutting treatment, an effluent that had overflowed from an electrolyzer to be used for an electrochemical surface-roughening treatment was used. The desmutting treatment solution was supplied to the aluminum plate from spraying pipes which were disposed at several places for spraying the desmutting treatment solution to prevent the surface of the aluminum plate from being dried.

(6) Electrochemical Surface-roughening Treatment in an Aqueous Acidic Solution Primarily Containing Hydrochloric Acid (Second Surface-roughening Treatment)

Using an a.c. current having a trapezoidal wave as shown in FIG. 1 and two cells as shown in FIG. 2 as the electrolyzer, the electrochemical surface-roughening treatment was carried out continuously. As the aqueous acidic solution, a solution obtained by adding aluminum chloride to a hydrochloric acid solution containing 7.5 g/l of HCl such that the amount of aluminum ions was 4.5 g/l was used and the solution temperature was 35° C. For the a.c. current, each of the times tp and tp' required for the value of current to reach a peak from 0 was 1 msec and a carbon electrode was used as a counter electrode. The current density of the a.c. current when the current reached the peak was 50 $A/dm^2$ when the aluminum plate took part in an anodic reaction and 47.5 $A/dm^2$ when the aluminum plate took part in a cathodic reaction. Further, the ratio ($Q_C/Q_A$) of the cathode-time quantity ($Q_C$) of electricity of the aluminum plate to the anode-time quantity ($Q_A$) of electricity of the aluminum plate, duty ratio, frequency and the sum of the quantity of electricity when the aluminum plate takes part in an anode reaction were as shown in Table 7. After that, the plate was washed with water by spraying.

Control of the concentration of the aqueous acidic solution primarily containing hydrochloric acid was performed by adding an undiluted 35 mass % hydrochloric acid solution and water in proportion to the quantity of electricity passed through the solution and discharging the aqueous acidic solution (aqueous acidic solution primarily containing hydrochloric acid) externally from a circulation tank system by overflowing it successively from a circulation tank in the same volume as the hydrochloric acid and water which were added. Also, the concentration of the aqueous acidic solution was found from the temperature and conductance of the aqueous acidic solution and the propagation speed of ultrasound in the solution by reference to a table, made in advance, of the relationship between the hydrochloric acid concentration, aluminum ion concentration, temperature and conductance of the solution and the propagation speed of ultrasound in the solution, and control was performed to successively regulate the amounts of the undiluted hydrochloric acid solution and water to be added to keep the concentration of the solution constant.

TABLE 7

| | Duty ratio | Frequency (Hz) | Quantity of electricity ($C/dm^2$) | Solution temperature (° C.) | Peak current density ($A/dm^2$) Anode-time | Peak current density ($A/dm^2$) Cathode-time | Electricity quantities ratio ($Q_C/Q_A$) |
|---|---|---|---|---|---|---|---|
| Example C1 | 0.33 | 83 | 150 | 35 | 37.5 | 35.6 | 1.9 |
| Example C2 | 0.33 | 83 | 180 | 40 | 45.0 | 42.7 | 1.9 |
| Example C3 | 0.33 | 83 | 200 | 35 | 50.0 | 47.5 | 1.9 |
| Example C4 | 0.33 | 83 | 220 | 35 | 55.0 | 50.0 | 1.9 |

(7) Etching Treatment in an Aqueous Alkaline Solution

An aqueous solution containing 5 mass % of NaOH and 0.5 mass % of aluminum ions and having a temperature of 45° C. was sprayed on the aluminum plate to carry out an alkali etching treatment. The amount of the aluminum plate to be dissolved was 0.1 $g/m^2$. The concentration of the etching solution was kept constant by finding the concentration of the etching solution from the temperature, specific gravity and conductance of the solution by reference to a table, made in advance, of the relationship between the NaOH concentration, aluminum ion concentration, temperature, specific gravity and conductance of the solution and adding water and an aqueous 48 mass % NaOH solution by feedback control. Thereafter, the plate was washed with water.

(8) Etching Treatment in an Aqueous Acidic Solution

Next, using sulfuric acid as an acidic etching solution, the acidic etching solution was sprayed on the aluminum plate from a spraying pipe in the conditions shown in Table 8 to carry out an acid etching treatment on the aluminum plate. The concentration of the acid etching solution was kept constant by finding the concentration of the acidic etching solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plate was washed with water.

TABLE 8

| | Sulfuric acid concentration (g/l) | $Al^{3+}$ concentration (g/l) | Temperature (° C.) | Time (sec) |
|---|---|---|---|---|
| Example C1 | 300 | 15 | 60 | 3 |
| Example C2 | 300 | 5 | 70 | 5 |
| Example C3 | 500 | 1 | 70 | 3 |
| Example C4 | 400 | 1 | 70 | 10 |

(9) Anodic Oxidation Treatment

Using an aqueous solution (containing 0.5 mass % of aluminum ions) having a sulfuric acid concentration of 15 mass % and a solution temperature of 35° C. as an anodic oxidation solution, an anodic oxidation treatment was carried out using d.c. voltage at a current density of 2 $A/dm^2$ such that the amount of the anodic oxide film was 2.4 $g/m^2$. The concentration of the anodic oxidation solution was kept constant by finding the concentration of the solution from the temperature, specific gravity and conductance of the solution by reference to a table, made in advance, of the relationship between the sulfuric acid concentration, aluminum ion concentration, temperature, specific gravity and conductance of the solution and adding water and 50 mass % sulfuric acid by feedback control. Thereafter, the plates were washed with water by spraying to manufacture planographic printing plate-use aluminum supports as Examples C1 to C4.

(10) Production of a Planographic Printing Plate

These planographic printing plate-use aluminum supports processed by the aforementioned treatments were each dried and an undercoat layer and a light-sensitive layer with a dry film thickness of 1.5 $g/m^2$ were formed on the roughened surface by application and dried to manufacture positive-type planographic printing master plates of Examples C1 to C4 which could be exposed by an infrared laser. These planographic printing master plates were subjected to treatments such as exposure and developing to form planographic printing plates. The planographic printing plates of Examples C1 to C4 were good in view of appearance of damping water on a printer when they were evaluated as explained later. The planographic printing plates were observed in an SEM photograph with a magnification of 750 and it was found that these plates each had a surface shape in which honeycomb-like pits were uniformly formed and piled fine irregularities having a pitch of 0.1 to 0.5 $\mu$m were formed in each honeycomb pit. Also, the planographic printing plates of Examples C1 to C4 were good printing plates having high adhesion to the light-sensitive layer. Further, the treatment irregularity known as "streaking", which is caused by differences in crystal orientation between aluminum crystal particles, was not observed.

The average surface roughness (Ra) of the aluminum plate after the anodic oxidation treatment was as shown in Table 9.

Evaluation

Printing was performed using the planographic printing plates produced in the aforementioned Examples C1 to C4. The condition of soiling on the surface of each planographic printing plate after the completion of the printing was visually observed to evaluate anti-soiling characteristics according to the following standard. The results are shown in Table 9.

Standard

A: Extremely little ink was stuck to the non-image portion.
C: The non-image portion was significantly soiled by ink stuck thereto.

Example C5

The planographic printing plate-use aluminum support obtained after the anodic oxidation treatment was finished in Example C1 was further dipped in boiled distilled water to carry out a sealing treatment. After that, the support was dipped in an aqueous solution containing 2.5 mass % of sodium silicate at a solution temperature of 70° C. for 14 seconds for the purpose of performing a hydrophilicizing treatment, then washed with water by spraying and dried to produce a planographic printing plate-use aluminum support as Example C5. The concentration of the solution used in the above hydrophilicizing treatment was kept constant by finding the concentration of the solution from the temperature and conductance of the solution by reference to a table, made in advance, of the relationship between the sodium silicate concentration, temperature and conductance of the solution and adding water and an undiluted No. 3 sodium silicate solution by feedback control.

An undercoat layer and a negative-type light-sensitive layer were formed by application on the planographic printing plate-use aluminum support produced in the above manner and dried to manufacture a positive-type planographic printing master plate of Example C5. The planographic printing master plate was subjected to treatments such as exposure and developing to form a planographic printing plate. Using this planographic printing plate, an evaluation was made with the same conditions as for Example C1, which showed that it was a good printing plate. The results are shown in Table 9.

Example C6

The planographic printing plate-use aluminum support obtained after the anodic oxidation treatment was finished in Example C2 was dipped in an aqueous solution containing 2.5 mass % of sodium silicate at a solution temperature of 70° C. for 5 seconds for the purpose of performing a hydrophilicizing treatment, then washed with water using a spray and dried to produce a planographic printing plate-use aluminum support as Example C6. An undercoat layer and a negative-type light-sensitive layer were formed by application on the planographic printing plate-use aluminum support and then dried to manufacture a negative-type planographic printing master plate of Example C6. The planographic printing master plate was subjected to treatments such as exposure and developing to form a negative-type planographic printing plate. Using this planographic printing plate, an evaluation was made with the same conditions as for Example C2, which showed that it was a good printing plate. The results are shown in Table 9.

Example C7

The planographic printing plate-use aluminum support obtained after the anodic oxidation treatment was finished in Example C3 was dipped in an aqueous solution containing 1.5 mass % of polyvinylphosphonic acid at a solution temperature of 70° C. for 5 seconds for the purpose of performing a hydrophilicizing treatment, then washed with water by using a spray and dried to produce a planographic printing plate-use aluminum support as Example C7. The concentration of the solution used in the above hydrophilicizing treatment was kept constant by finding the concentration of the solution from the temperature and conductance of the solution by reference to a table, made in advance, of the relationship between the polyvinylphosphonic acid concentration, temperature and conductance of the solution and adding water and an undiluted polyvinylphosphonic acid solution by feedback control.

An undercoat layer and a negative-type light-sensitive layer were formed by application on the planographic printing plate-use aluminum support and dried to manufacture a negative-type planographic printing master plate of Example C7. The planographic printing master plate was subjected to treatments such as exposure and developing to form a planographic printing plate. Using this planographic printing plate, an evaluation was made with the same conditions as for Example C3, which showed that it was a good printing plate. The results are shown in Table 9.

Example C8

Aluminum plates to be used in Example C8 were produced from five aluminum alloy molten baths having alloy components of compositions A to E, as shown in Table 1, respectively. These aluminum plates were produced in the following manner. First, each aluminum alloy molten bath was subjected to a molten bath treatment comprising degassing and filtration to prepare a 500-mm-thick ingot by the DC casting method. After the surface of the ingot was surface-cut by 10 mm, the ingot was heated to start hot-rolling at 400° C. without performing a soaking treatment and rolled to a plate thickness of 4 mm. Then, the plate was cold-rolled to a plate thickness of 1.5 mm, followed by performing intermediate annealing and then cold-rolled again to a finished thickness of 0.24 mm. After the flatness of the plate was remedied, the aluminum plates to be used for Examples C8-1 to C8-5 were produced.

With regard to the compositions A to D, the purity of Al and the content of each of all impurity elements were respectively within a predetermined range and within a range preferable in the present invention. The composition E was a composition in which the purity of Al and the content of each of 5 impurity elements, Fe, Si, Mn, Mg and Zn were respectively within a predetermined range and within a range preferable in the present invention.

The aluminum plates having the compositions shown in Table 1 were subjected to the same treatments as in Example C2 to manufacture 5 planographic printing plate-use aluminum supports as Example C8.

These planographic printing plate-use aluminum supports processed by the aforementioned treatments were dried and an undercoat layer and a light-sensitive layer were formed by application on the roughened surface, followed by drying to produce positive-type planographic printing master plates with a dry film thickness of 1.5 g/m$^2$. These planographic printing master plates were subjected to treatments such as exposure and developing to form planographic printing plates. These planographic printing plates were evaluated with the same conditions as for Example C2, which showed that these planographic printing plates were good printing plates. The results are shown in Table 9.

These five planographic printing plates in Example C8 were observed in an SEM photograph with a magnification of 750 and it was found that these plates each had a surface shape in which honeycomb-like pits were uniformly formed and piled fine irregularities having a pitch of 0.1 to 0.5 $\mu$m were formed in each honeycomb pit. Also, the planographic printing plates were good printing plates free from spot-like soiling in a non-image portion when evaluated in the above manner. Further, the treatment irregularity known as "streaking", which is caused by differences in crystal orientation between aluminum crystal particles, was not observed.

Example C9

A planographic printing plate-use aluminum support and a planographic printing master plate of Example C9 were manufactured in the same manner as in Example C4 except that the alkali etching treatment (7) in Example C4 was not performed. The planographic printing master plate was subjected to treatments such as exposure and developing to obtain a planographic printing plate. This planographic printing plate was evaluated with the same conditions as for Example C4, which showed that it was good printing plate. The results are shown in Table 9.

Comparative Example C1

A planographic printing plate-use aluminum support and a planographic printing master plate of Comparative Example C1 were manufactured in the same manner as in Example C3 except that (4) the etching treatment in an aqueous alkaline solution carried out between electrochemical surface-roughening treatments, (5) the desmutting treatment carried out between electrochemical surface-roughening treatments and (6) the electrochemical surface-roughening treatment in an aqueous acidic solution primarily containing hydrochloric acid (second surface-roughening treatment) were not performed. The planographic printing original plate was subjected to treatments such as exposure and developing to obtain a planographic printing plate. The planographic printing plate was evaluated with the same conditions as for Example C3. The planographic printing plate showed significant stripe-like treatment irregularities and was therefore unsuitable as a planographic printing plate-use aluminum support. This planographic printing plate also had inferior anti-soiling characteristics during printing. The results are shown in Table 9.

TABLE 9

| | Average surface roughness (Ra) | Soiling resistance |
|---|---|---|
| Example C1 | 0.32 $\mu$m | A |
| Example C2 | 0.30 $\mu$m | A |
| Example C3 | 0.35 $\mu$m | A |
| Example C4 | 0.33 $\mu$m | A |
| Example C5 | — | A |
| Example C6 | — | A |
| Example C7 | — | A |
| Example C8-1 | — | A |
| Example C8-2 | — | A |
| Example C8-3 | — | A |
| Example C8-4 | — | A |
| Example C8-5 | — | A |
| Example C9 | — | A |
| Comparative Example C1 | — | C |

According to Table 9, the planographic printing plates of Examples C1 to C9 were resistant to the occurrence of soiling even after 5000 copies were printed, showing that these planographic printing plates were good printing plates. Also, the size of the pits varied corresponding to the amount of aluminum dissolved in the alkali etching treatment performed between the electrochemical surface-roughening treatments. For example, the pit size was the largest in Example C2 and the smallest in Example C3 among Examples C1 to C3. Comparative Example C1 had inferior anti-soiling characteristics.

Examples D1 to D5 and Comparative Examples D1 to D4

Aluminum alloy plates to be used as a raw material for planographic printing plate-use aluminum supports in Examples D1 to D5 and Comparative Examples D1 to D4 were manufactured from aluminum alloy molten baths having alloy components as shown in Table 10. These aluminum alloy plates were produced in the following manner. First, each aluminum alloy molten bath was adjusted so as to have the composition shown in Table 10 and subjected to a molten bath treatment comprising degassing and filtration to prepare a 500-mm-thick ingot by the DC casting method. After the surface of the ingot was surface-cut by 10 mm, the ingot was heated to carry out hot-rolling at 400° C. without performing a soaking treatment to a plate thickness of 4 mm. Then, the plate was cold-rolled to a plate thickness of 1.5 mm, followed by performing intermediate annealing and then cold-rolled again to a finished thickness of 0.24 mm. The flatness of the plate was remedied to produce aluminum alloy plate to be used as the raw material of aluminum supports of Examples D1 to D5 and Comparative Examples D1 to D4 for planographic printing plates.

TABLE 10

| | Fe | Si | Cu | Ti | Mn | Mg | Zn | Cr | Others (total) | Al | Present Invention? |
|---|---|---|---|---|---|---|---|---|---|---|---|
| Example-D1 | 0.7 | 0.5 | 0.5 | 0.1 | 1.4 | 1.4 | 0.1 | 0.05 | 0.01 | 95.24 | Within range |
| Example-D2 | 0.3 | 0.15 | 0.1 | 0.03 | 0.1 | 0.1 | 0.1 | 0.01 | 0.01 | 99.1 | Within range |
| Example-D3 | 0.5 | 0.3 | 0.3 | 0.05 | 0.5 | 0.5 | 0.3 | 0.05 | 0.01 | 97.49 | Within range |
| Example-D4 | 0.5 | 0.3 | 0.3 | 0.05 | 1 | 1 | 0.3 | 0.05 | 0.01 | 96.49 | Within range |
| Example-D5 | 0.7 | 0.5 | 0.05 | 0.02 | 1.3 | 1.45 | 0.4 | 0.005 | 0.01 | 95.57 | Within range |
| Comparative Example-D1 | 0.9 | 0.9 | 0.9 | 0.5 | 1.4 | 1.4 | 0.5 | 0.09 | 0.01 | 93.4 | Out of range |
| Comparative Example-D2 | 0.28 | 0.08 | 0.02 | 0.03 | 0.002 | 0.002 | 0.002 | 0.001 | 0.005 | 99.58 | Out of range |
| Comparative Example-D3 | 0.38 | 0.08 | 0.011 | 0.035 | 0.003 | 0.003 | 0.003 | 0.001 | 0.005 | 99.5 | Out of range |
| Comparative Example-D4 | 0.2 | 0.04 | 0.03 | 0.01 | 0.2 | 0.001 | 0.001 | 0.001 | 0.002 | 99.5 | Out of range |

Note: Because each value is rounded off to a significant figure, the sums of the metal contents may not be exactly 100%. (Unit: wt %)

Here, with regard to the aluminum alloy plates in Examples D1 to D5, the purity of aluminum is within a predetermined range, specifically within the range defined in the present invention. In contrast, the aluminum alloy plate in Comparative Example D1 has an aluminum purity out of the range defined in the present invention. The aluminum alloy plate in Comparative Example D2 is made to have a general composition as a planographic printing plate of the JIS1050 material by melting an aluminum virgin metal having a purity of 99.7% or more and by adding a mother alloy so that it has a predetermined composition, and has a composition out of the range defined in the present invention. The aluminum alloy plate in Comparative Example D3 uses a used planographic printing plate-use aluminum support in an amount of 70% of the raw material to reproduce Example 3 described in JP-A-7-205534 and has an aluminum purity out of the range defined in the present invention. The aluminum alloy plate in Comparative Example D4 has the same aluminum purity as that in the Comparative Example D3, but has Mn in a relatively large amount.

With regard to the aluminum alloy plates in Examples D1 to D5 and Comparative Examples D1 to D4, the costs of the raw materials were compared with each other and the rolling characteristics when the aluminum alloy plate was manufactured were evaluated. The results are shown in Table 11. The comparison of each cost and the evaluation of the rolling characteristics were made in the following manner.

(1) Comparison of Raw Material Costs

The cost of the raw material mainly consists of the cost of the aluminum ground metal and a processing cost required to process the aluminum ground metal to a plate. If the production processes are the same, the processing costs are the same. Therefore, a comparison of the costs of the aluminum ground metals was made here. For the cost of an aluminum ground metal, a cost (amount of money per gram) equivalent to that of the aluminum ground metal was calculated. Then, the cost (cost equivalent to that of the aluminum ground metal) required to produce the aluminum alloy plate of Comparative Example D2 was defined as 100 and the relative cost of each aluminum alloy plate of Examples D1 to D5 and Comparative Examples D1 to D3 was calculated for evaluation.

(2) Evaluation of Rolling Characteristics

The evaluation of the rolling characteristics was made as to whether or not the aluminum alloy material could be rolled finally to a predetermined plate thickness (0.24 mm by cold rolling). The ratings of the evaluation are as follows.

○: No problem

○Δ: It was possible to roll, but slight cracks occurred.

X: Cracks occurred and it was impossible to roll.

TABLE 11

| | Cost | Rolling characteristics | Appearance | Intermetallic compounds at surface layer | Abnormal coarse pebbles | Printing durability |
|---|---|---|---|---|---|---|
| Example-D1 | 35 | ○Δ | ○ | 34000/mm$^2$ | ○ | 130 |
| Example-D2 | 80 | ○ | ○ | 5000/mm$^2$ | Δ | 105 |
| Example-D3 | 50 | ○ | ○ | 25000/mm$^2$ | ○ | 120 |
| Example-D4 | 45 | ○ | ○ | 10000/mm$^2$ | ○ | 110 |
| Example-D5 | 60 | ○ | ○ | 30000/mm$^2$ | ○ | 125 |
| Comparative Example-D1 | 30 | X | Evaluation impossible | Evaluation impossible | Evaluation impossible | Evaluation impossible |
| Comparative Example-D2 | 100 | ○ | ○Δ | 1500/mm$^2$ | ○ | 100 |
| Comparative Example-D3 | 95 | ○ | ○Δ | 2000/mm$^2$ | ○ | 100 |
| Comparative Example-D4 | 100 | ○ | ○Δ | 2000/mm$^2$ | X | 90 |

Comparative Example D3 was obtained by reproducing Example 3 described in JP-A-7-205534. In Comparative Example D3, a used planographic printing plate was used in an amount of 70% of the raw material to thereby obtain the effect of decreasing the cost of the raw material by 5%. In the case of Examples D1 to D5, an effect of decreasing the cost by 35 to 65%, which was greater than that in the case of Comparative Example D3, was obtained. In the case of Comparative Example D3, there is also the problem that the used planographic printing plate could not be supplied consistently.

Comparative Example D1 produced a large cost reduction effect. However, because the aluminum purity was out of the range defined in the present invention, cracks arose during rolling and therefore the aluminum alloy plate could not be produced stably.

Comparative Example D4 was an aluminum alloy plate which contained Mn in a relatively large amount and Cu in an amount of only 0.03 mass %, which was less than the range preferable in the present invention.

The aluminum alloy plates in Examples D1 to D5 and Comparative Examples D2 to D4, in which an aluminum alloy plate could be finally produced, were subjected to a surface-roughening treatment performed in the following manner.

First, the mechanical surface-roughening treatment of each of the aluminum alloy plates obtained in Examples D1 to D5 and Comparative Examples D2 to D4 was carried out using brush grains (No. 8 brush×3) using a Pamiston suspension (mechanical surface-roughening step). After each aluminum plate was washed with water, it was alkali-etched using a 25% NaOH solution at 75° C. to the extent of 6 g/m$^2$ (alkali etching step). After washing with water, the aluminum alloy plate was then subjected to a desmutting treatment performed using 9 g/l of nitric acid at 40° C., followed by an electrochemical surface-roughening treatment (electrochemical surface-roughening step). The electrochemical surface-roughening treatment was carried out using 9 g/l nitric acid as an electrolyte at 50° C. and using electricity in a quantity of 180 C/dm$^2$.

Then, a desmutting treatment was performed. Specifically, after washing with water, the plate was subjected to an alkali treatment (alkali treatment step) performed using a 25 mass % NaOH solution with a shower method. The NaOH solution had a pH of 13 and a solution temperature of 75° C. Also, alkali treating time and the amount of etching were designed to be 4 seconds and 1 g/m$^2$ respectively. In succession to the alkali treatment, the plate was washed with water and then subjected to an acid treatment (acid treatment step) performed using sulfuric acid having an acid concentration of 170 g/l with a shower method (thus, the desmutting treatment was finished). The time required for the acid treatment was designed to be 4 seconds.

After the electrochemical surface treatment and the desmutting treatment were finished, the plate was evaluated for appearance by visual observation. The results are shown in Table 11. The standard of evaluation is as follows.

○: Irregularities not observed.
○Δ: Slight gritty irregularities observed.
Δ: Gritty irregularities observed.

Also, intermetallic compounds existing on the surface of each plate were observed using an SEM (scanning electron microscope T220A, manufactured by JEOL Ltd.). In this observation, SEM photographs with a magnification of 3000 were taken of five areas (60 μm×50 μm) to calculate occurrences of intermetallic compounds per unit area (number/mm$^2$) based on the occurrences of intermetallic compounds in the areas. The results are shown in Table 11.

In succession to the desmutting treatment, the aluminum alloy plate was subjected to an anodic oxidation treatment (the average current density was designed to be 15 A/dm$^2$ and the amount of the anodic oxide film to be formed was 2.5 g/m$^2$) in which d.c. electrolysis was carried out in a sulfuric acid solution having an acid concentration of 170 g/l at 30° C., followed by washing with water to manufacture a planographic printing plate-use aluminum support.

An undercoat treatment for one surface of the manufactured planographic printing plate-use aluminum support was performed with a usual method and thereafter a light-sensitive solution having the composition shown below was applied to the aluminum support such that the amount of the coating after drying was 2.5 g/m$^2$, to form a light-sensitive layer, thus producing a light-sensitive planographic printing master plate.

| Composition of the light-sensitive solution: | |
|---|---|
| Ester compound of naphthoquinone-1,2-diazido-5-sulfonylchloride, pyrogallol and an acetone resin (a compound described as Example 1 in the specification of U.S. Pat. No. 3,635,709) | 0.75 g |
| Cresol novolac resin | 2.00 g |
| Oil Blue #603 (manufactured by Orient Chemicals) | 0.04 g |
| Ethylene dichloride | 16 g |
| 2-Methoxyethyl acetate | 12 g |

Also, the surface of the support before the light-sensitive layer was applied was observed at magnifications of 1000 and 2000 by using a scanning electron microscope (T20, manufactured by JEOL Ltd.) to examine whether abnormal coarse pebbles were generated or not. The results are shown in Table 11.

The standard of evaluation was as follows.

○: No abnormal coarse pebbles were generated.
Δ: Not abnormal coarse pebbles were generated but slightly large pebbles were.
X: Abnormal coarse pebbles were generated.

Each planographic printing master plate was exposed to an image and developed according to a usual method to produce a planographic printing plate, which was then installed on a printer to evaluate printing durability. The printing durability of each of the Examples and Comparative Examples was evaluated based on a relative value obtained when the printing durability of Comparative Example D2 was defined as 100.

As shown in Table 11, all of Examples D1 to D5 were better than Comparative Example D2, having the composition of the general JIS 1050 material, in printing durability after the surface-roughening treatment and the anodic oxidation treatment were finished. This is thought to be because in the case of Examples D1 to D5, the intermetallic compounds existed in an amount larger than in each of Comparative Examples D2 to D4 and adhesion to the light-sensitive layer was therefore improved, resulting in high printing durability. It is thought that in the case of, particularly, Comparative Example D4, abnormal coarse pebbles that were generated caused reduced adhesion to the light-sensitive layer.

In the above Examples, the case of using a DC casting method as the method of casting aluminum is shown. However, the present invention is not limited by casting method and, for example, a continuous casting method, represented by the twin-roll system or the twin-belt system, may be used. In this case, running costs can be reduced even more than in the case of the DC casting method and therefore larger cost reduction effects can be obtained.

What is claimed is:

1. A process for producing an aluminum support for a planographic printing plate, comprising at least two electrochemically surface roughening steps of electrochemically surface-roughening an aluminum plate in an aqueous acidic solution using an alternating current, wherein in each of the electrochemically surface-roughening steps, a ratio $Q_C/Q_A$ of a cathode-time quantity of electricity of said aluminum plate $Q_C$ to an anode-time quantity of electricity of said aluminum plate $Q_A$ is from 0.95 to 2.5, a duty nib of said alternating current is from 0.25 to 0.5, a frequency of said alternating current is from 30 to 200 Hz, said aqueous acidic solution is an aqueous acidic solution whose principal components are hydrochloric acid and aluminum chloride, wherein the aluminum plate has been prepared from a scrap aluminum or secondary metal containing aluminum in a content of 95 to 99.4 mass % and at least five elements selected from the group consisting of Fe, Si, Cu, Mg, Mn, Zn, Cr and Ti in the following content ranges;

Fe: 0.3 to 1.0 mass %;
Si: 0.15 to 1.0 mass %;
Cu: 0.1 to 1.0 mass %;
Mg: 0.1 to 1.5 mass %;
Mn: 0.1 to 1.5 mass %;
Zn: 0.1 to 0.5 mass %;
Cr: 0.01 to 0.1 mass %; and
Ti: 0.03 to 0.5 mass %, wherein in the respective electrochemically surface-roughening steps, at least one factor selected from the group consisting of the duty ratio of the alternating current, the frequency of the alternating current, the rate $Q_C/Q_A$, the cathode-time quantity of electricity, the anode-time quantity of electricity, a composition of the aqueous acidic solution, a temperature of the aqueous acidic solution and a current density of the alternating current is different.

2. A process for producing an aluminum support for a planographic printing plate, comprising at least two electrochemically surface-roughening steps of electrochemically surface-roughening as aluminum plate in an aqueous acidic solution using an alternating current, wherein in each of the electrochemically surface-roughening steps, a ratio $Q_C/Q_A$ of a cathode-time quantity of electricity of said aluminum plate $Q_C$ to an abode-time quantity of electricity of said aluminum plate $Q_A$ is from 0.95 to 2.5, a duty ratio of said alternating current is from 0.25 to 0.5, a frequency of said alternating current is from 30 to 200 Hz, said aqueous acidic solution, of which principal components are hydrochloric acid and aluminum chloride, is obtained by adding aluminum chloride to an aqueous hydrochloric acid solution containing 5 to 15 g/l hydrochloric acid such that concentration of aluminum ions therein is 1 is 10 g/l, wherein the aluminum plate has been prepared from a scrap aluminum or secondary metal containing aluminum in a content of 95 to 99.4 mass % and at least five elements selected from the group consisting of Fe, Si, Cu, Mg, Mn, Zn, Cr and Ti in the following content ranges;

Fe: 0.3 to 1.0 mass %;
Fe: 0.3 to 1.0 mass %;
Si: 0.15 to 1.0 mass %;
Cu: 0.1 to 1.0 mass %;
Mg: 0.1 to 1.5 mass %;
Mn: 0.1 to 1.5 mass %;
Zn: 0.1 to 0.5 mass %;
Cr: 0.01 to 0.1 mass %; and
Ti: 0.03 to 0.5 mass %, wherein in the respective electrochemically surface-roughening steps, at least one factor selected from the group consisting of the duty ratio of the alternating current, the frequency of the alternating current, the ratio $Q_C/Q_A$, the cathode-time quantity of electricity, the anode-time quantity of electricity, a composition of the aqueous acidic solution, a temperature of the aqueous acidic solution and a current density of the alternating current is different.

3. A process for producing an aluminum support for a planographic printing plate, comprising at least one electrochemically surface-roughening step of electrochemically surface-roughening an aluminum plate in an aqueous acidic solution using an alternating current, followed by a step of chemically etching said aluminum plate in sit aqueous alkaline solution and thereafter desmutting said aluminum plate in an acidic solution, and followed hr at least one additional electrochemically surface-roughening step of electrochemically surface-roughening said aluminum plate in an aqueous acidic solution using an alternating current, wherein in each of the electrochemically surface-roughening steps, a ratio $Q_C/Q_A$ of a cathode-time quantity of electricity of said aluminum plate $Q_C$ to an anode-time quantity of electricity of said aluminum plate $Q_A$ from 0.95 to 2.5, a duty ratio of said alternating current is from 0.25 to 0.5, frequency of said alternating current is from 30 to 200 Hz, said aqueous acidic solution an aqueous acidic solution whose principal components are hydrochloric acid and aluminum chloride, wherein the aluminum plate has been prepared from a scrap aluminum or secondary metal comprising aluminum in a content of 95 to 99.4 mass % and at least five elements selected from the group consisting of Fe, Si, Cu, Mg, Mn, Zn, Cr and Ti in the following content ranges:

Fe: 0.3 to 1.0 mass %;
Si: 0.15 to 1.0 mass %;
Cu: 0.1 to 1.0 mass %;
Mg: 0.1 to 1.5 mass %;
Mn: 0.1 to 1.5 mass %;
Zn: 0.1 to 0.5 mass %;
Cr: 0.01 to 0.1 mass %; and
Ti: 0.03 to 0.5 mass %, wherein in the respective electrochemically surface-roughening steps, at least one factor selected from the group consisting of the duty ratio of the alternating current, the frequency of the alternating current, the ratio $Q_C/Q_A$, the cathode-time quantity of electricity, the anode-time quantity of electricity, a composition of the aqueous acidic solution, a temperature of the aqueous acidic solution and a current density of the alternating current is different.

4. A process for producing an aluminum support for a planographic printing plate, comprising, in the following order (a) a first step of chemically etching 1 to 55 g/m$^2$ of an aluminum plate in an aqueous alkaline solution and thereafter desmutting aluminum plate in an acidic solution;

(b) a second step of electrochemically surface-roughening said aluminum plate in an aqueous acidic solution using an alternating current;

(c) a third step of further chemically etching said aluminum plate in an aqueous alkaline solution and thereafter desmutting said aluminum plate in an acidic solution;

(d) a fourth step of electrochemically surface-roughening said aluminum plate in an aqueous acidic solution using an alternating current;

(e) a fifth step of:

(1) additionally chemically etching said aluminum plate in an aqueous sulfuric acid solution at 60 to 90° C. for 1 to 10 seconds, or (2) additionally chemically etching 0.01 to 5 g/m$^3$ of said aluminum plate in an aqueous alkaline solution, and thereafter desmutting said aluminum plate in an acidic solution or further chemically etching said aluminum plate in an aqueous sulfuric acid solution at 60 to 90° C. for 1 to 10 seconds; and (f) a sixth step of anode oxidizing said aluminum plate, wherein in each of the electrochemically surface roughening steps, a ratio $Q_C/Q_A$ of a cathode-time quantity of electricity of said aluminum plate $Q_C$ to an anode-time of electricity of said aluminum plate, $Q_A$ is from 0.95 to 2.5, a duty of said alternating current is from 0.25 to 0.5, a frequency of said alternating current is from 30 to 200 Hz, said aqueous acidic solution is an aqueous acidic solution whose principal components are hydrochloric acid and aluminum chloride, wherein the aluminum plate has been prepared from a scrap aluminum or secondary metal containing aluminum in a content of 95 to 99.4 mass % and at least five elements selected from the group consisting of Fe, Si, Cu, Mg, Mn, Zn, Cr and Ti in the following content ranges:

Fe: 0.3 to 1.0 mass %;
Si: 0.15 to 1.0 mass %;
Cu: 0.1 to 1.0 mass %;
Mg: 0.1 to 1.5 mass %;
Mn: 0.1 to 1.5 mass %;
Zn: 0.1 to 0.5 mass %;
Cr: 0.01 to 0.1 mass %; and
Ti: 0.03 to 0.5 mass %, wherein in the respective electrochemically surface-roughening steps, at least one factor selected from the group consisting of the duty ratio of the alternating current, the frequency of the alternating current, the ratio $Q_C/Q_A$,the cathode-time quantity of electricity, the anode-time quantity of electricity, a composition of the aqueous acidic solution, a temperature of the aqueous acidic solution and a current density of the alternating current is different.

* * * * *